US007626565B2

(12) United States Patent
Tsuge

(10) Patent No.: US 7,626,565 B2
(45) Date of Patent: Dec. 1, 2009

(54) DISPLAY DEVICE USING SELF-LUMINOUS ELEMENTS AND DRIVING METHOD OF SAME

(75) Inventor: Hitoshi Tsuge, Osaka (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 666 days.

(21) Appl. No.: 11/362,775

(22) Filed: Feb. 28, 2006

(65) Prior Publication Data

US 2006/0232612 A1 Oct. 19, 2006

(30) Foreign Application Priority Data

Mar. 1, 2005 (JP) ..... 2005-056494

(51) Int. Cl.
*G09G 3/30* (2006.01)

(52) U.S. Cl. ..... 345/76; 345/77; 345/82; 345/83; 345/84

(58) Field of Classification Search ..... 345/76–77, 345/82–84
See application file for complete search history.

(56) References Cited

U.S. PATENT DOCUMENTS 7,126,568 B2 * 10/2006 LeChevalier ..... 345/84
7,345,660 B2 * 3/2008 Mizukoshi et al. ..... 345/77
7,400,098 B2 * 7/2008 Ng et al. ..... 315/169.3

OTHER PUBLICATIONS

U.S. Appl. No. 12/361,069, filed Jan. 28, 2009, Takahara, et al.

* cited by examiner

*Primary Examiner*—Richard Hjerpe
*Assistant Examiner*—Leonid Shapiro
(74) *Attorney, Agent, or Firm*—Oblon, Spivak, McClelland, Maier & Neustadt, L.L.P.

(57) ABSTRACT

To provide a current output type semiconductor circuit and a display device which are capable of realizing a reduction in cost by reducing the number of output stages and reducing a chip area. A display device includes three reference current generating units which generate reference currents corresponding to three display colors and outputs the reference currents, a selector which outputs an optimum reference current among the outputs of the three reference current generating units according to a display color of display data in response to a changing display color switching signal, a current output unit which outputs a current corresponding to a value of the display data with respect to a current per one gradation determined by the reference currents, and a selector for distributing the output of the current output unit to respective source signal lines corresponding to the display color.

22 Claims, 61 Drawing Sheets

Fig. 26

| PRE-CHARGE JUDGMENT LINE (251) | | | CURRENT PRE-CHARGE CONTROL LINE (254) | VOLTAGE PRE-CHARGE CONTROL LINE (257) |
|---|---|---|---|---|
| MOST SIGNIFICANT BIT | BIT IN THE MIDDLE | LEAST SIGNIFICANT BIT | | |
| 0 | 0 | 0 | ALWAYS AT "L" LEVEL | ALWAYS AT "L" LEVEL |
| 0 | 0 | 1 | IDENTICAL WITH 256a | IDENTICAL WITH 258 |
| 0 | 1 | 0 | IDENTICAL WITH 256b | IDENTICAL WITH 258 |
| 0 | 1 | 1 | IDENTICAL WITH 256c | IDENTICAL WITH 258 |
| 1 | 0 | 0 | IDENTICAL WITH 256d | IDENTICAL WITH 258 |
| 1 | 0 | 1 | IDENTICAL WITH 256e | IDENTICAL WITH 258 |
| 1 | 1 | 0 | IDENTICAL WITH 256f | IDENTICAL WITH 258 |
| 1 | 1 | 1 | ALWAYS AT "L" LEVEL | IDENTICAL WITH 258 |

Fig. 28

| GRADATION | PRE-CHARGE PULSE TO BE USED |
|---|---|
| 0 | VOLTAGE PRE-CHARGE PULSE 258 |
| 1 | VOLTAGE PRE-CHARGE PULSE 258 AND CURRENT PRE-CHARGE PULSE 256a |
| 2 | VOLTAGE PRE-CHARGE PULSE 258 AND CURRENT PRE-CHARGE PULSE 256b |
| 3,4 | VOLTAGE PRE-CHARGE PULSE 258 AND CURRENT PRE-CHARGE PULSE 256c |
| 5~8 | VOLTAGE PRE-CHARGE PULSE 258 AND CURRENT PRE-CHARGE PULSE 256d |
| 9~15 | VOLTAGE PRE-CHARGE PULSE 258 AND CURRENT PRE-CHARGE PULSE 256e |
| 16~102 | VOLTAGE PRE-CHARGE PULSE 258 AND CURRENT PRE-CHARGE PULSE 256f |
| 103 OR MORE | NONE |

Fig. 29

| CURRENT PRE-CHARGE PULSE | PRE-CHARGE CURRENT OUTPUT PERIOD |
|---|---|
| 256a | 14 μs |
| 256b | 20 μs |
| 256c | 22. 5 μs |
| 256d | 25 μs |
| 256e | 28 μs |
| 256f | 30 μs |

Fig. 41

| JUDGMENT OF PRE-CHARGE OPERATION | VALUE OF PRE-CHARGE JUDGMENT SIGNAL |
|---|---|
| NO PRE-CHARGE | 0 |
| EXECUTE CURRENT PRE-CHARGE 1 | 1 |
| EXECUTE CURRENT PRE-CHARGE 2 | 2 |
| EXECUTE CURRENT PRE-CHARGE 3 | 3 |
| EXECUTE CURRENT PRE-CHARGE 4 | 4 |
| EXECUTE CURRENT PRE-CHARGE 5 | 5 |
| EXECUTE CURRENT PRE-CHARGE 6 | 6 |
| EXECUTE VOLTAGE PRE-CHARGE | 7 |

Fig. 56

| REFERENCE CURRENT SWITCHING SIGNAL | REFERENCE CURRENT LINE 1 (552a) | REFERENCE CURRENT LINE 2 (552b) | REFERENCE CURRENT LINE 3 (552c) |
|---|---|---|---|
| 0 | 61a OUTPUT | 61c OUTPUT | 61b OUTPUT |
| 1 | 61b OUTPUT | 61a OUTPUT | 61c OUTPUT |

DISPLAY DEVICE USING SELF-LUMINOUS ELEMENTS AND DRIVING METHOD OF SAME

CROSS REFERENCE TO RELATED APPLICATIONS

This application is based upon and claims the benefit of priority from the prior Japanese Patent Application No. 2005-56494, filed Mar. 1, 2005, the entire contents of each of which are incorporated herein by reference.

BACKGROUND OF THE INVENTION

1. Field of the Invention

The present invention relates to a driving current output type semiconductor circuit for performing current output, which is used in a display device for performing gradation display according to an amount of current such as an organic field luminous element, and a display device and the like using the same.

2. Related Art of the Invention

Since an organic luminous element is a self-luminous element, the organic luminous element is prospective as a display device of the next generation because of advantages that, for example, a backlight required in a liquid crystal display device is unnecessary and a viewing angle is wide.

A sectional view of an element structure of a general organic luminous element is shown in FIG. 1. The organic luminous element has a structure in which an organic layer 12 is sandwiched by a cathode 11 and an anode 13. When a DC power supply 14 is connected to this organic luminous element, holes and electrons are injected into the organic layer 12 from the anode 13 and the cathode 11, respectively. The injected holes and electrons move to opposite poles in the organic layer 12 by means of an electric field formed by the power supply 14. The electrons and the holes are recombined in the organic layer 12 in the course of the movement to generate excitons. Luminescence is observed in a process in which energy of the excitons is deactivated. Luminescent colors vary depending upon energy inherent in the excitons, and the light has a wavelength of energy substantially corresponding to a value of an energy band gap inherent in the organic layer 12.

In order to take out the light generated in the organic layer to the outside, a material, which is transparent in a visible light region, is used for at least one of the electrodes. A material, which has a low work function, is used for the cathode in order to facilitate injection of electrons into the organic layer. For example, a material such as aluminum, magnesium, or calcium is used. A material such as an alloy of these metals or aluminum-lithium alloy may be used for durability and a lower work function.

On the other hand, a material having a large ionization potential is used for the anode owing to its easiness to inject holes. In addition, since the cathode does not have transparency, a transparent material is often used for this electrode. Therefore, in general, an ITO (Indium Tin Oxide), gold, indium zinc oxide (IZO), or the like is used.

In recent years, in an organic luminous element using a low molecular material, in order to increase luminous efficiency, the organic layer 12 may be constituted by plural layers. This enables the respective layers to share functions of carrier injection, carrier movement to a luminous area, and luminescence of light having a predetermined wavelength, and it is possible to form an organic luminous element having higher efficiency by using efficient materials for the respective layers.

Luminance of the organic luminous element formed in this way is proportional to a current as shown in FIG. 2(*a*) and is in a nonlinear relation with respect to a voltage as shown in FIG. 2(*b*). Therefore, in order to perform gradation control, it is better to control the organic luminous element according to a value of current.

In the case of an active matrix type, display devices are divided into those of two modes, namely, a voltage drive mode and a current drive mode.

The voltage drive mode is a method of using a source driver of a voltage output type, converting a voltage into a current in the inside of a pixel, and supplying the current converted to organic luminous elements.

In this method, since voltage to current conversion is performed by a transistor provided for each pixel, there is a problem of fluctuation occurring in an output current to cause luminance unevenness depending on fluctuation in characteristics of this transistor.

The current drive mode is a method in which a source driver of a current output type is used, only a function of retaining a value of current, which is outputted for one horizontal scanning period, is provided with in a pixel, and the same value of current as the source driver is supplied to organic luminous elements.

An example of the current drive mode is shown in FIG. 3. The mode in FIG. 3 uses a current copier mode for a pixel circuit.

A circuit at the time of operation of a pixel 37 in FIG. 3 is shown in FIG. 4.

When a pixel is selected, as shown in FIG. 4(*a*), a signal is inputted from a gate driver 35 such that a gate signal line 31*a* of a row of the pixel brings a switch into a conduction state and a gate signal line 31*b* of the line brings a switch into a non-conduction state. A state of the pixel circuit at this point is shown in FIG. 4(*a*). At this point, a current flowing to the source signal line 30, which is a current attracted into a source driver 36, flows through a path indicated by dotted line 41. Thus, a current identical with the current flowing to the source signal line 30 flows to a transistor 32. Then, a potential of a node 42 changes to a potential corresponding to a current/voltage characteristic of the transistor 32.

Subsequently, when the pixel changes to an unselected state, the circuit is changed to a circuit as shown in FIG. 4(*b*) by the gate signal lines 31. A current flows from an EL power supply line 34 to an organic luminous element 33 through a path of dotted line indicated by 43. This current depends upon the potential of the node 42 and the current/voltage characteristic of the transistor 32.

In FIGS. 4(*a*) and 4(*b*), the potential of the node 42 does not change. Therefore, a drain current flowing to the identical transistor 32 is identical in FIGS. 4(*a*) and 4(*b*). Consequently, a current of the same value as the value of current flowing to the source signal line 30 flows to the organic luminous element 33. Even if there is fluctuation in the current/voltage characteristic of the transistor 32, values of the current of the dotted line 41 and the current of the doted line 43 are not affected in principle. It is possible to realize uniform display unaffected by fluctuation in characteristics of a transistor.

Therefore, it is necessary to use the current drive mode to obtain uniform display. For that purpose, the source driver 36 has to be a driver IC of a current output type.

An example of an output stage of a current driver IC, which outputs a value of current depending on gradation, is shown in FIG. 6. An analog current is outputted from 64 by a digital/analog conversion unit 66 with respect to display gradation data 54. The analog/digital conversion unit 66 is constituted by plural (at least the number of bits of the gradation data 54) current sources for gradation display 63 and switches 68 and a common gate line 67 which regulates a value of current fed by one current source for gradation display 63.

In FIG. 6, an analog current is outputted with respect to gradation data 54 which is four-bit input. Selecting by the switches 68 that the current sources 63 of the number corresponding to a weight of bits are connected to a current output 64 enables a current corresponding to gradation to be outputted in such a manner that a current equivalent to one current source 63 is outputted in the case of data 1 and a current equivalent to seven current sources 63 is outputted in the case of data 7. It is possible to realize a current output type driver by arranging these structures 66 corresponding to the number of outputs of the driver. In order to compensate for a temperature characteristic of transistors used for the current sources for gradation display 63, a voltage of the common gate line 67 is determined by a distributing mirror transistor 62. The distributing mirror transistor 62 and the current sources for gradation display 63 are formed in a current mirror structure. A current per one gradation depends upon a value of a reference current 99. With this structure, an output current changes depending on gradation and a current per one gradation depends upon a reference current.

Besides gradation display based on the difference in the number of current sources for gradation display 63, in FIG. 6, a drain electrode consolidates the plural current sources for gradation display 63 connected to the identical switch 68 into one. It is also possible to realize the current output type driver with a method of forming the current sources for gradation display 63 by changing a channel size ratio such that a current flowing via the switches 68 does not change (In this case, the current output type driver is constituted by at least four transistors of the current sources 63 for gradation display).

Moreover, the current output type drive may be implemented by combining a current change based on the number of transistors of the current sources for gradation display 63 and a current change due to the change in a channel size ratio.

A value of the reference current 99 depends upon a resistance value of a resistance element 60 and a power supply voltage of the power supply 69. Since a reference current determining a current per one gradation is generated by a circuit including the resistance element 60, the distributing mirror transistor 62, and the power supply 69, the circuit is specified as a reference current generating unit 61.

In the current output type source driver, when a current output is constituted with an arrangement of transistors as shown in FIG. 6, an area is required for the number of transistors arranged. Taking into account fluctuation of a reference current, it is necessary to keep fluctuation among adjacent terminals in a chip and among chips within 2.5%. Thus, it is desirable to set fluctuation of an output current in FIG. 58 (current fluctuation at an output stage) to 2.5% or less. It is advisable that a transistor size of 63 is equal to or larger than 160 square microns.

When the transistors are constituted in each output stage in this way, an area of at least 1280 square microns per one terminal, that is, a maximum area of 40800 square micros is required. This occupies one fifth to a half of a total chip area.

Consequently, for a reduction in cost, it is necessary to reduce the number of transistors. For that purpose, it is necessary to reduce the number of output terminals.

Therefore, it is an object of the present invention to realize a display device which has a small circuit size and uses low-cost self-luminous elements and a driving method without reducing the number of horizontal scan lines of the display device.

SUMMARY OF THE INVENTION

In order to solve the problem, a first aspect of the present invention is a display device using self-luminous elements, comprising:

a reference current output unit which generates a first current adjusted depending on respective luminescent colors of self-luminous elements of a display device and outputs said first current for each of said luminescent colors, said display device being constituted by pixels in which said self-luminous elements are arranged in a matrix and displaying at least two or more colors on the basis of current value control;

plural current output units which convert said first current outputted from said reference current output unit into a second current reflecting information of display gradation data sent from a signal line and output said second current to a display area side; and a first selector unit which switches an output destination of said second current outputted from said current output units to respective pixel columns corresponding to said respective luminescent colors, wherein said reference current output unit outputs said first current in response to switching in said first selector unit.

A second aspect of the present invention is the display device using self-luminous elements according to the first aspect of the present invention, wherein said reference current output unit includes:

plural reference current generating units which separately generate reference currents corresponding to said first current adjusted for each of said luminescent colors and output said reference currents; and a second selector unit which is connected between said plural reference current generating units and said plural current output units and outputs said reference currents depending on the switching in said first selector unit as said first current at same timing as the switching in said first selector unit.

A third aspect of the present invention is the display device using self-luminous elements according to the second aspect of the present invention, wherein said second selector unit outputs said reference currents, which are outputted by said plural reference current generating units, as said first current in synchronization with a time division clock in one horizontal scanning period in accordance with a predetermined order.

A fourth aspect of the present invention is the display device using self-luminous elements according to the second aspect of the present invention, wherein said second selector unit outputs said reference currents, which are outputted by said plural reference current generating units, as said first current in association with an electric switching instrument in accordance with a predetermined order.

A fifth aspect of the present invention is the display device using self-luminous elements according to the second aspect of the present invention, comprising a display color switching signal line which is connected to a pre-stage of said first selector unit and inputs a display color switching signal for actuating said first selector unit and said second selector unit in association with each other to said first selector unit.

A sixth aspect of the present invention is the display device using self-luminous elements according to the second aspect of the present invention, wherein a number of the pixel columns connected to said current output units via said first selector unit is two or three.

A seventh aspect of the present invention is the display device using self-luminous elements according to the second aspect of the present invention, wherein said luminescent colors are two or more luminescent colors selected out of red, blue, green, yellow, cyan, and magenta.

An eighth aspect of the present invention is the display device using self-luminous elements according to the first aspect of the present invention, comprising a pre-charge voltage generating unit which determines a pre-charge voltage for changing a voltage of a source signal line at high speed and generates and outputs said pre-charge voltage.

A ninth aspect of the present invention is the display device using self-luminous elements according to the eighth aspect of the present invention, comprising a voltage application selecting unit which is connected between said pre-charge voltage generating unit and said first selector unit and judges whether said voltage pre-charge should be carried out, wherein said pre-charge voltage generating unit outputs said pre-charge voltage according to a result of the judgment by said voltage application selecting unit.

A tenth aspect of the present invention is the display device using self-luminous elements according to the eighth aspect of the present invention, wherein said reference current output unit includes:

plural reference current generating units which separately generate reference currents corresponding to said first current adjusted for each of said luminescent colors and output said reference currents; and a second selector unit which is connected between said plural reference current generating units and said plural current output units and outputs said reference currents depending on the switching in said first selector unit as said first current at same timing as the switching in said first selector unit.

An eleventh aspect of the present invention is the display device using self-luminous elements according to the tenth aspect of the present invention, wherein said second selector unit outputs said reference currents, which are outputted by said plural reference current generating units, as said first current in synchronization with a time division clock in one horizontal scanning period in accordance with a predetermined order.

A twelfth aspect of the present invention is the display device using self-luminous elements according to the tenth aspect of the present invention, wherein said second selector unit outputs said reference currents, which are outputted by said plural reference current generating units, as said first current in association with an electric switching instrument in accordance with a predetermined order.

A thirteenth aspect of the present invention is the display device using self-luminous elements according to the tenth aspect of the present invention, comprising a display color switching signal line which is connected to a pre-stage of said first selector unit and inputs a display color switching signal for actuating said first selector unit and said second selector unit in association with each other to said first selector unit.

A fourteenth aspect of the present invention is the display device using self-luminous elements according to the tenth aspect of the present invention, wherein a number of the pixel columns connected to said current output units via said first selector unit is two or three.

A fifteenth aspect of the present invention is the display device using self-luminous elements according to the tenth aspect of the present invention, wherein said luminescent colors are two or more luminescent colors selected out of red, blue, green, yellow, cyan, and magenta.

A sixteenth aspect of the present invention is a driving method for a display device using self-luminous elements, comprising:

a reference current outputting step of generating a first current adjusted depending on respective luminescent colors of self-luminous elements of a display device and outputs said first current for each of the luminescent colors, said display device being constituted by pixels in which said self-luminous elements are arranged in a matrix and displaying at least two or more colors on the basis of current value control;

plural current outputting steps of converting said first current into a second current reflecting information of display gradation data sent from a signal line and outputting said second current to a display area side; and a first selecting step of switching an output destination of said second current to respective pixel columns corresponding to said respective luminescent colors, wherein, in said reference current outputting step, said first current is outputted in response to switching in said first selecting step.

A seventeenth aspect of the present invention is the driving method for a display device using self-luminous elements according to the sixteenth aspect of the present invention, comprising a pre-charge voltage generating step of determining a pre-charge voltage for changing a voltage of a source signal line at high speed and generates and outputs said pre-charge voltage.

An eighteenth aspect of the present invention is the driving method for a display device using self-luminous elements according to the seventeenth aspect of the present invention, comprising a voltage application selecting step of judging whether said voltage pre-charge should be carried out, wherein, in said pre-charge voltage generating step, said pre-charge voltage is outputted according to the judgment in said voltage application selecting step.

A nineteenth aspect of the present invention is the driving method for a display device using self-luminous elements according to the sixteenth aspect of the present invention, wherein said reference current outputting step includes:

a reference current generating step of separately generating reference currents corresponding to said first current adjusted for each of said luminescent colors and outputting said reference currents; and a second selecting step of outputting said reference currents depending on the switching in said first selecting step as said first current at same timing as the switching in said first selecting step.

A twelfth aspect of the present invention is the driving method for a display device using self-luminous elements according to the ninteenth aspect of the present invention, wherein, in said second selecting step, the reference currents, which are outputted in said reference current generating step, is outputted as said first current in synchronization with a time division clock in one horizontal scanning period in accordance with a predetermined order.

A twenty first aspect of the present invention is the driving method for a display device using self-luminous elements according to the nineteenth aspect of the present invention, wherein, in said second selecting step, the reference currents, which are outputted in said reference current generating step, is outputted as said first current in association with an electric switching instrument in accordance with a predetermined order.

A twenty second aspect of the present invention is the driving method for a display device using self-luminous elements according to the nineteenth aspect of the present invention, comprising a display color switching step of inputting a display color switching signal for actuating said first selecting step and said second selecting step in association with each other.

A twenty third aspect of the present invention is the driving method for a display device using self-luminous elements according to the nineteenth aspect of the present invention, wherein an output destination in said current output step is two or three pixel columns.

A twenty fourth aspect of the present invention is the driving method for a display device using self-luminous elements according to the nineteenth aspect of the present invention, wherein said luminescent colors are two or more luminescent colors selected out of red, blue, green, yellow, cyan, and magenta.

According to the present invention, it is possible to provide a display device using self-luminous elements which has a small circuit size and is low cost compared with the conventional display device and a driving method.

BRIEF DESCRIPTION OF THE DRAWINGS

FIG. 2(*b*) is a diagram showing the current-voltage-luminance characteristic of the organic luminous element;

FIG. 4(*b*) is a diagram showing an operation of the current copier circuit;

FIG. 15(*b*) is a current-voltage characteristic chart of a transistor;

FIG. 24(*b*) is a diagram for comparing source signal line potentials according to time during which voltage pre-charge is performed;

FIG. 26 is a table showing a relation of input/output signals of a pulse selecting unit 252;

FIG. 28 is a table showing correspondence between respective gradations and pre-charge pulses to be used;

FIG. 29 is a table showing a relation between display gradation and a necessary pre-charge current output period;

FIG. 41 is a table showing a relation between a pre-charge operation and a pre-charge judgment signal;

FIG. 42 is a diagram showing a circuit structure of a display device in which a source driver and a control IC are built in;

FIG. 56 is a table showing an operation of a selector 551;

DESCRIPTION OF SYMBOLS

Figure 1:
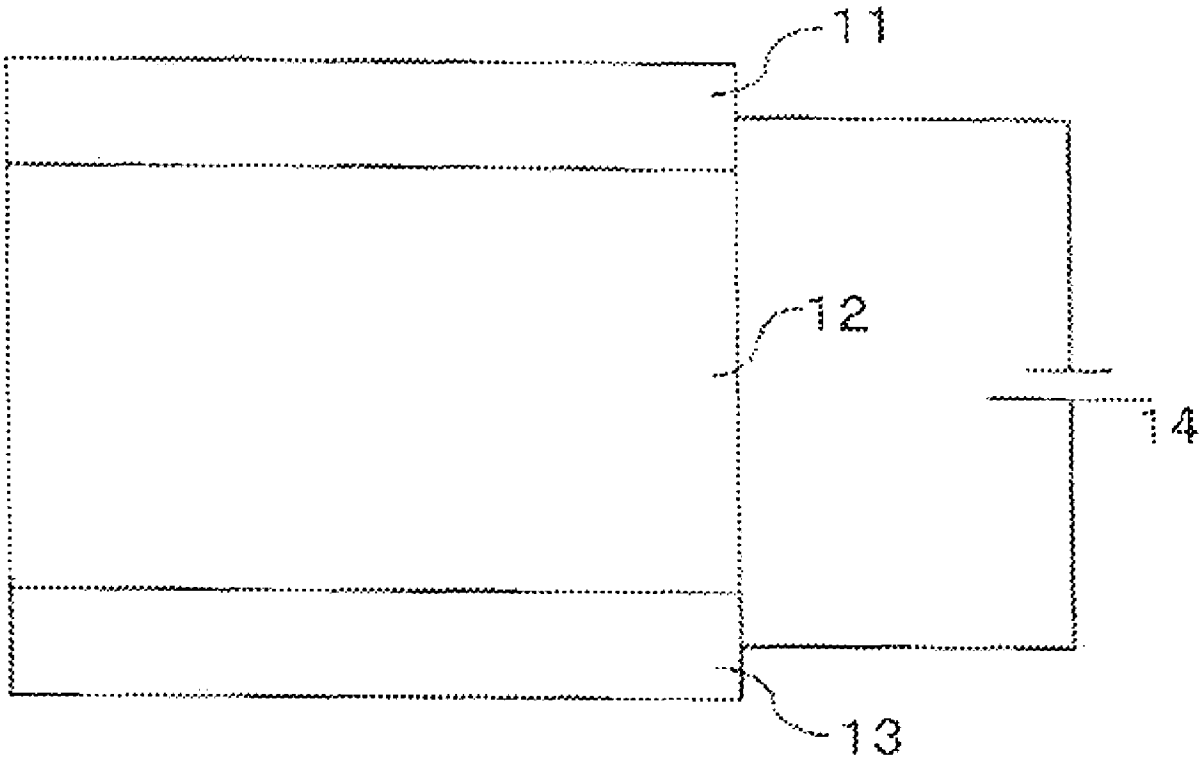
FIG. 1 is a diagram showing a structure of an organic luminous element.
Figure 2B:
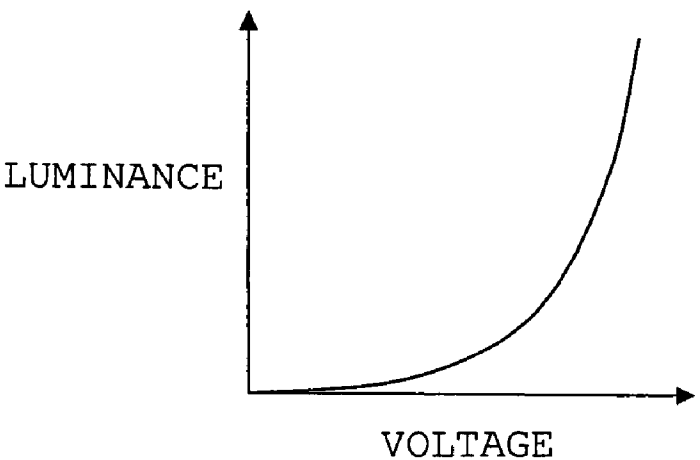
FIG. 2(*a*) is a diagram showing a current-voltage-luminance characteristic of the organic luminous element.
Figure 2A:
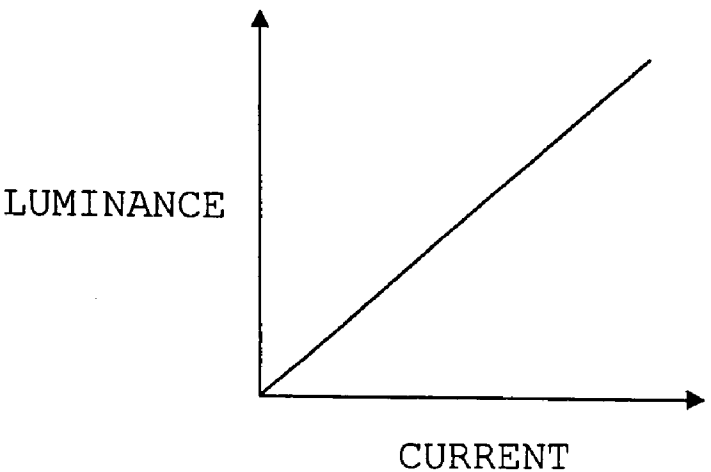

11 Cathode
12 Organic layer
13 Anode
14 Power supply
28 Control IC
30, 30*a*, 30*b*, 30*c* Source signal lines
31*a*, 31*b* Gate signal lines
32 Driving transistor
33 Organic luminous element
34 EL power supply line
35 Gate driver
36 Driver IC (Source driver)
37 Pixel
39*a*, 39*b*, 62, 491 Transistors
60 Resistance element
61*a*, 61*b*, 61*c* Reference current generating units
63 Display current source for gradation
64 Current output
65 Current output circuit
66 Digital analog converting unit
67 Common gate line
68 Switch
95 Voltage adjusting unit
98 Electronic volume
111, 112 Display areas
169 Application judging unit
151 Stray capacitance
152 Current source
252 Pulse selecting unit
253*a*, 253*d*, 253*f* Voltage application selecting units
255*a*, 255*b* Current output unit
256 Current pre-charge pulse group
258 Voltage pre-charge pulse
313 Dividing circuit
314 Source driver clock
317 Counter
319 Pulse generating unit
323 Pre-charge voltage generating unit
324 Electronic volume
330 EL cathode power supply
333 Control apparatus
337 Storing instrument
381, 382 Areas
384 Latch unit
323 Pre-charge voltage generating unit
402 Black data inserting unit
403 Gamma correction circuit
406 Pre-charge flag
422 ROM
471, 472, 531, 551 Selectors
473 Display data
474 Reference current line
475 Display color switching signal
491 Transistor
511 Gate signal enable circuit
514 Decode unit
541 Pulse generating unit

PREFERRED EMBODIMENTS OF THE INVENTION

A structure and an operation of a display device using self-luminous elements with three luminescent colors, which is an embodiment of the present invention, will be explained. A driving method for the display device using self-luminous elements of the present invention will be simultaneously explained. In the embodiment described below, an organic luminous element will be explained as an example of the self-luminous element.

Figure 7:
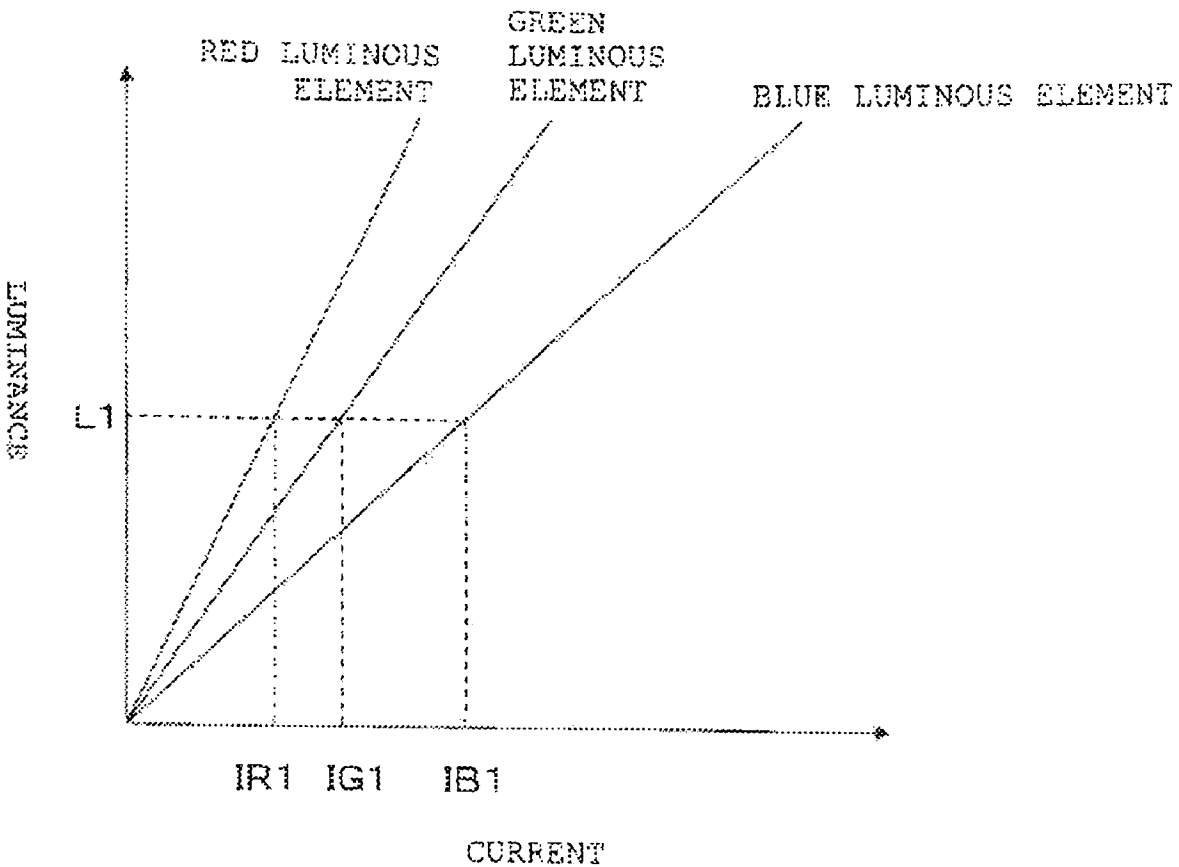
FIG. 7 is a graph showing luminous efficiency of the organic luminous element for each display color.

In a display device using a color organic luminous element, when pixels are formed using a different material for each of three primary colors, as shown in FIG. 7, a luminous efficiency is different for each display color, and a current of each display color at the time of white display takes a different value depending upon chromaticity of each luminescent color. Thus, it is necessary to separately set a current per one gradation.

Figure 8:
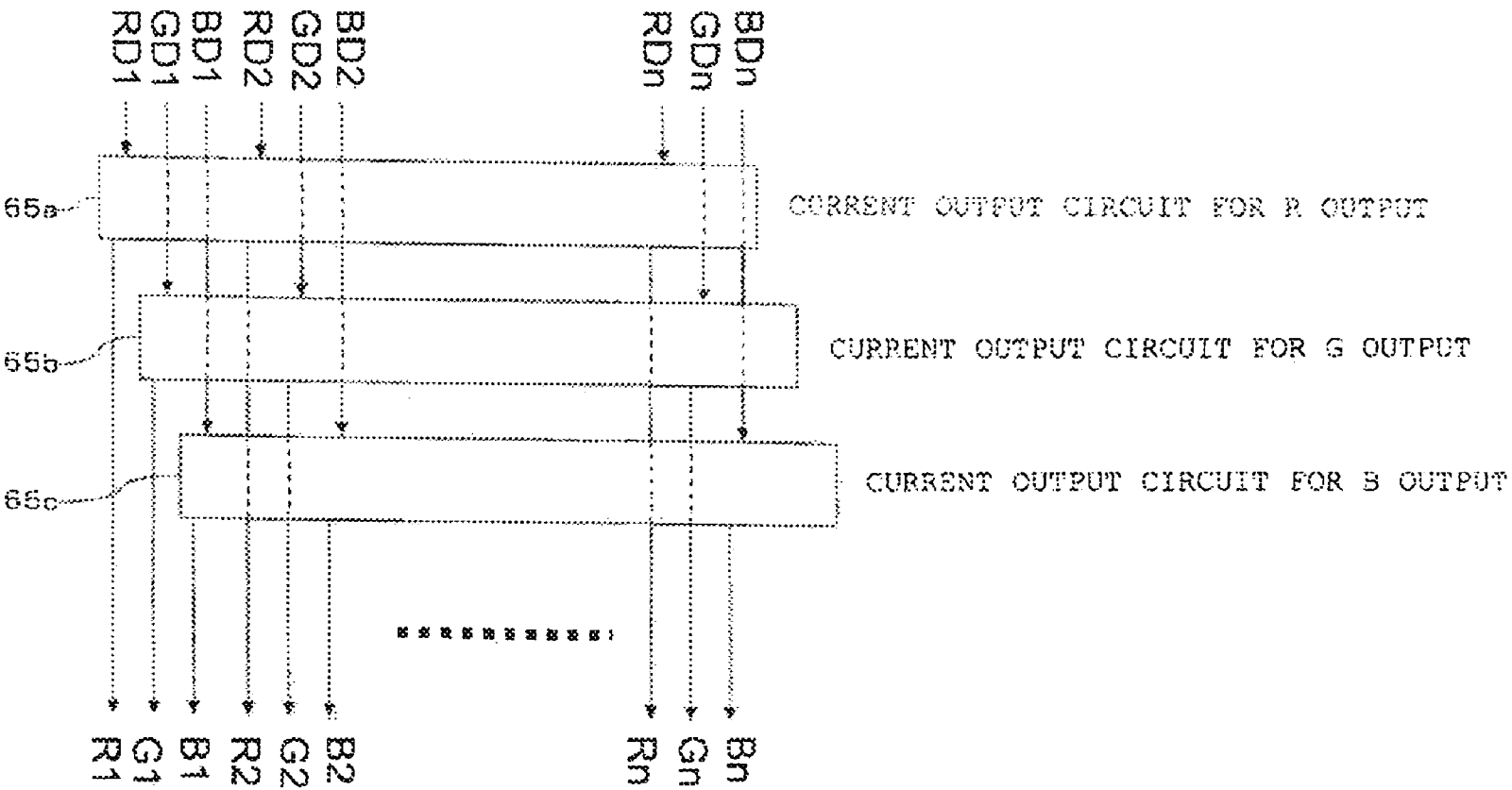
FIG. 8 is a diagram for explaining that a current output circuit is separately prepared for each display color.

Thus, as shown in FIG. 8, a current output circuit 65 including a reference current generating unit 61 is separately prepared for each display color to make it possible to set panel luminance and chromaticity to target values by changing a value of a resistance element 60 even if a luminous material used in the display device is changed.

Figure 9:
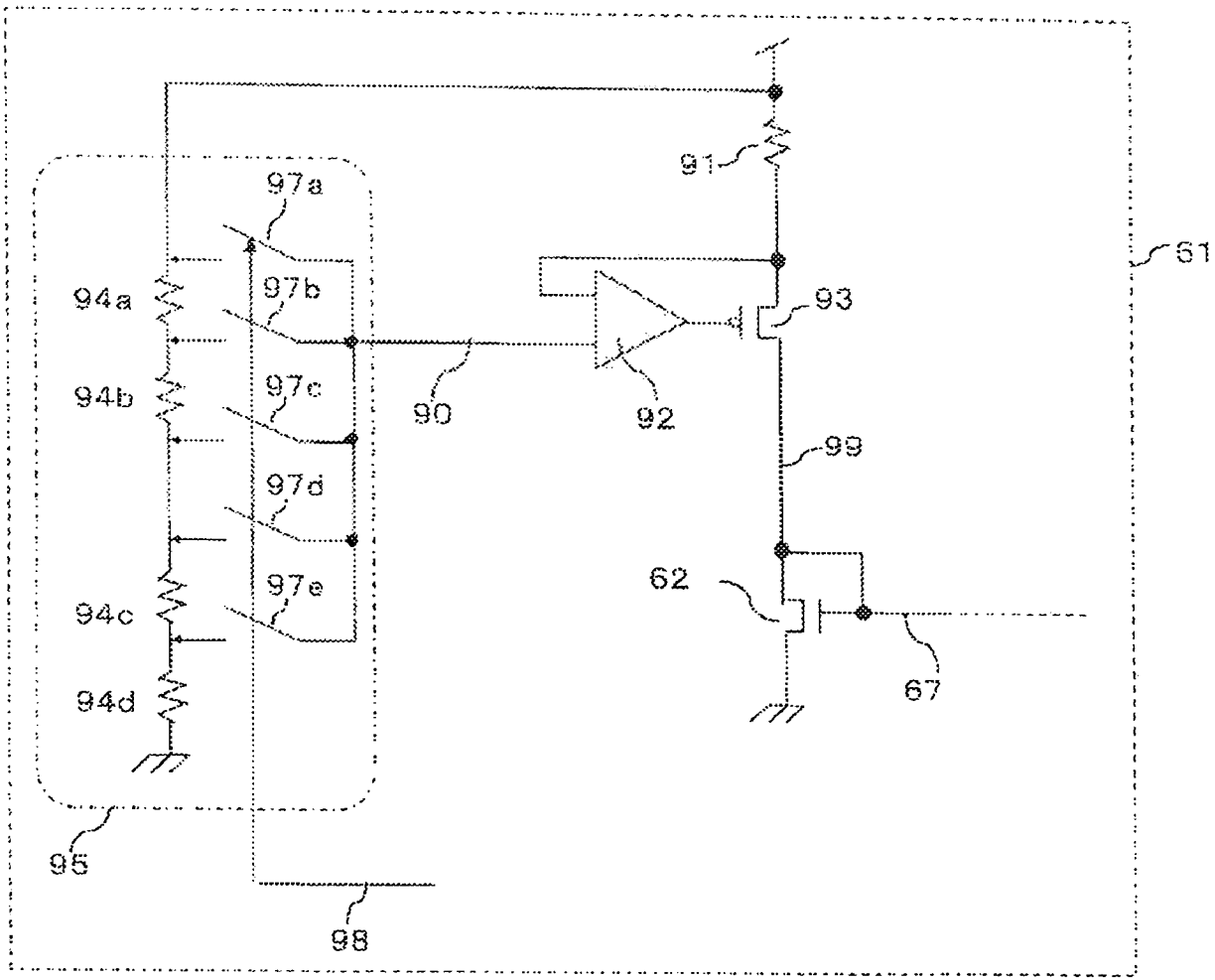
FIG. 9 is a diagram showing an example of a structure of a reference current generating unit.

Moreover, fluctuation in a luminous efficiency for each color of a luminous material affects white chromaticity and a white color looks different for each panel. In order to cope with this problem, as shown in FIG. 9, in the reference current generating unit 61, a circuit structure including an electronic volume and a constant current source is adopted instead of the resistance element 60, a value of control data 98 is changed according to a luminous efficiency, and a reference current is changed to adjust an output current value. This makes it possible to adjust luminance to be within a fixed range. It is also possible to adjust chromaticity to be within a fixed range in the same manner. The control data 98 will be referred to as a reference current electronic volume.

Figure 10:
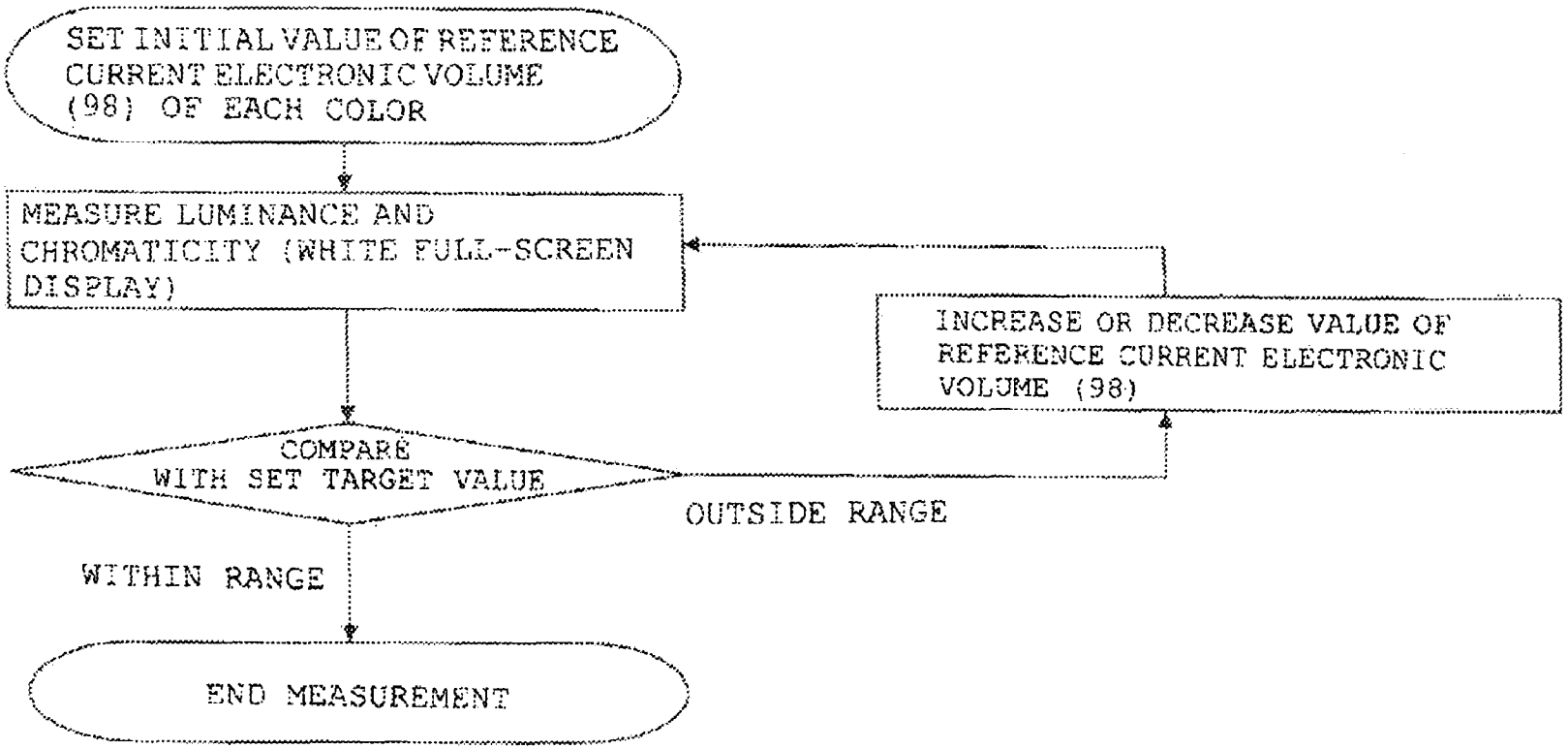
FIG. 10 is a diagram showing an adjusting method for an output current.

An adjusting method is shown in FIG. 10.

Full screen white display is performed according to an initial value of the reference current electronic volume calculated from a luminous efficiency assumed. In this case, measurement of luminance and chromaticity is carried out. If measurement data is within a range of a design specification of the panel, this initial value is determined as an electronic volume. However, when the measurement data is outside the range, the measurement data is compared with a set value, value of the reference current electronic volume 98 for each color is increased or decreased, and white display is performed again to measure luminance and chromaticity. This operation is repeatedly carried out until luminance and chromaticity come into the design range. Finally, an optimum value of the reference current electronic volume 98 is determined for each panel.

As a stride of a voltage adjusting unit 95 of an electronic volume is finer, fine tuning of a reference current value is more effective and it is possible to set the reference current value to a value closer to a target value. As a width between a maximum value and a minimum value is larger, it is possible to more properly adjust a reference current value to a value as designed even if fluctuation in a luminous efficiency is large. However, when the volume adjusting unit 95 is designed to satisfy this condition, a circuit size of the voltage adjusting unit 95 increases. This increases an area of a driver IC 36 to cause an increase in cost. Thus, it is practically preferable to set an adjustment range about twice as large as the range (fluctuation in a luminance efficiency is within twice as large as the fluctuation) and to set a stride to a current change of 1% to constitute the display device with an electronic volume of six bits. This makes it possible to set fluctuation of chromaticity for each panel to be equal to or smaller than ±0.005 on both x and y.

In Japanese Patent Application No. 2005-56494 which is a basic application of priority claim of this application, a display device using self-luminous elements which carries out voltage pre-charge and current pre-charge for solving a phenomenon in which a boundary of areas is blurred and a phenomenon in which luminance on a first row is high regardless of low gradation display on an entire surface is explained.

The voltage pre-charge and the current pre-charge described in the basic application will be hereinafter explained.

Figure 11:
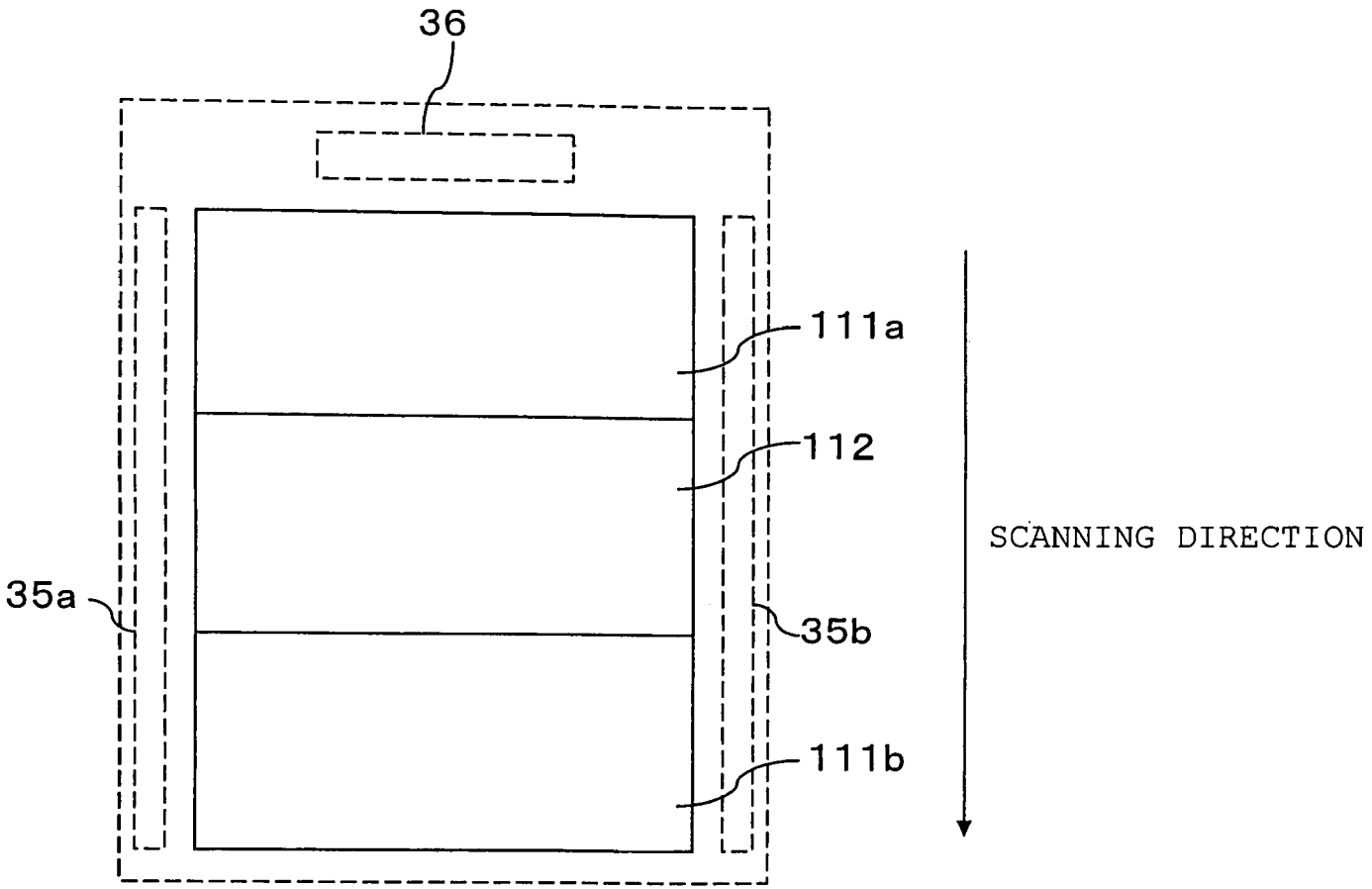
FIG. 11 is a diagram showing a display pattern for explaining a problem at the time of current drive.

As a problem at the current drive time, in a display pattern shown in FIG. 11, a phenomenon in which a boundary of areas is blurred occurs when gradation of an area 111 is equal to or lower than a half tone and equal to or higher than a ¼ tone and when low gradation display is carried out in an area 112.

Figure 12:
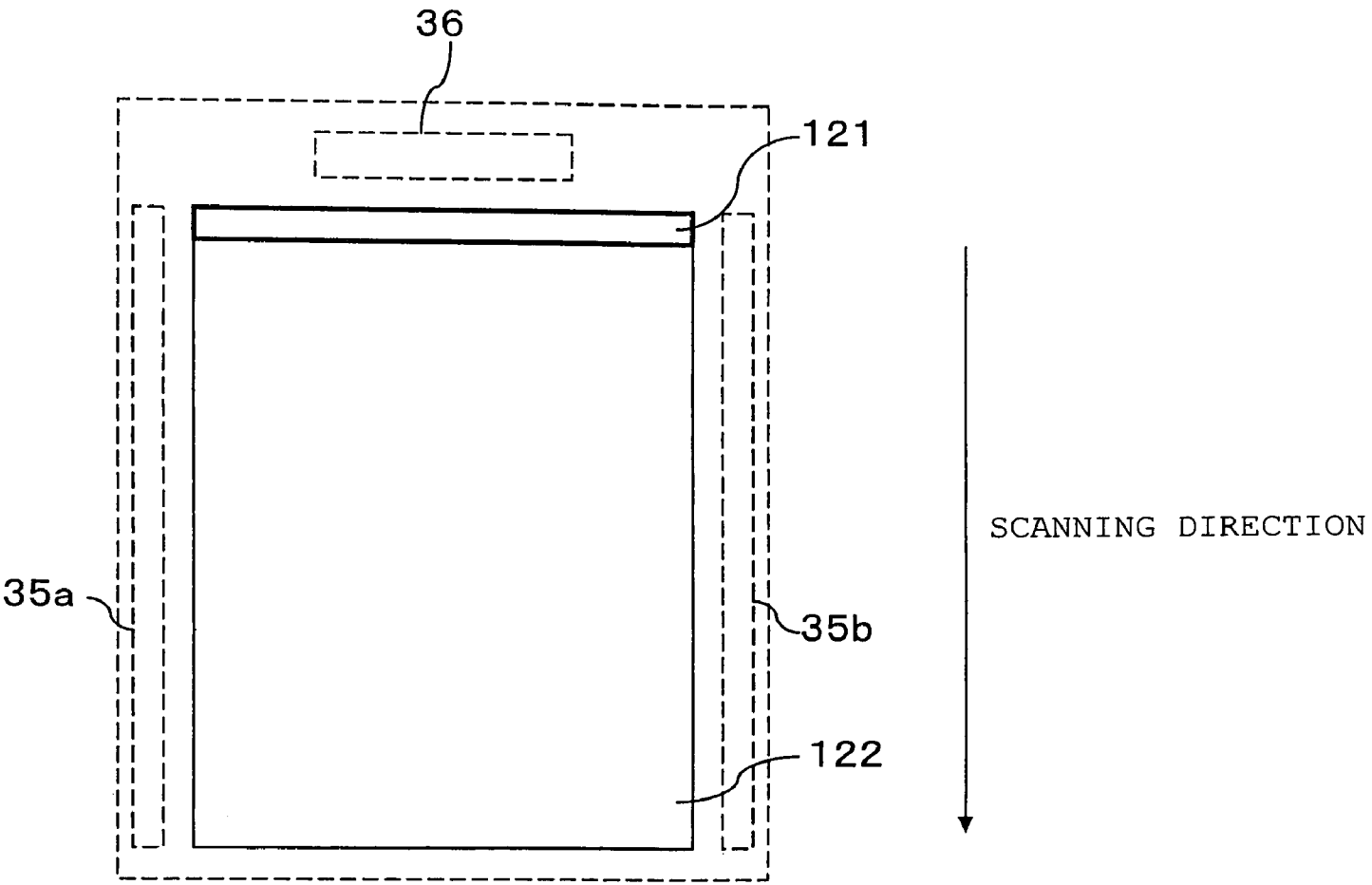
FIG. 12 is a diagram showing a display pattern for explaining a problem at the time of current drive.

A phenomenon in which luminance of a display first row (an area 121) is higher than that of other rows when an entire surface is in low gradation display as shown in FIG. 12 occurs.

This is because a writing current in each pixel is small (about 10 nA), charge and discharge of a stray capacitance of a source signal line at the writing current are difficult, and the writing current cannot change to a predetermined current value in one horizontal scanning period.

This is known in, for example, a document Proc. EuroDisplay 2002, pp 855 to 858.

Figure 3:
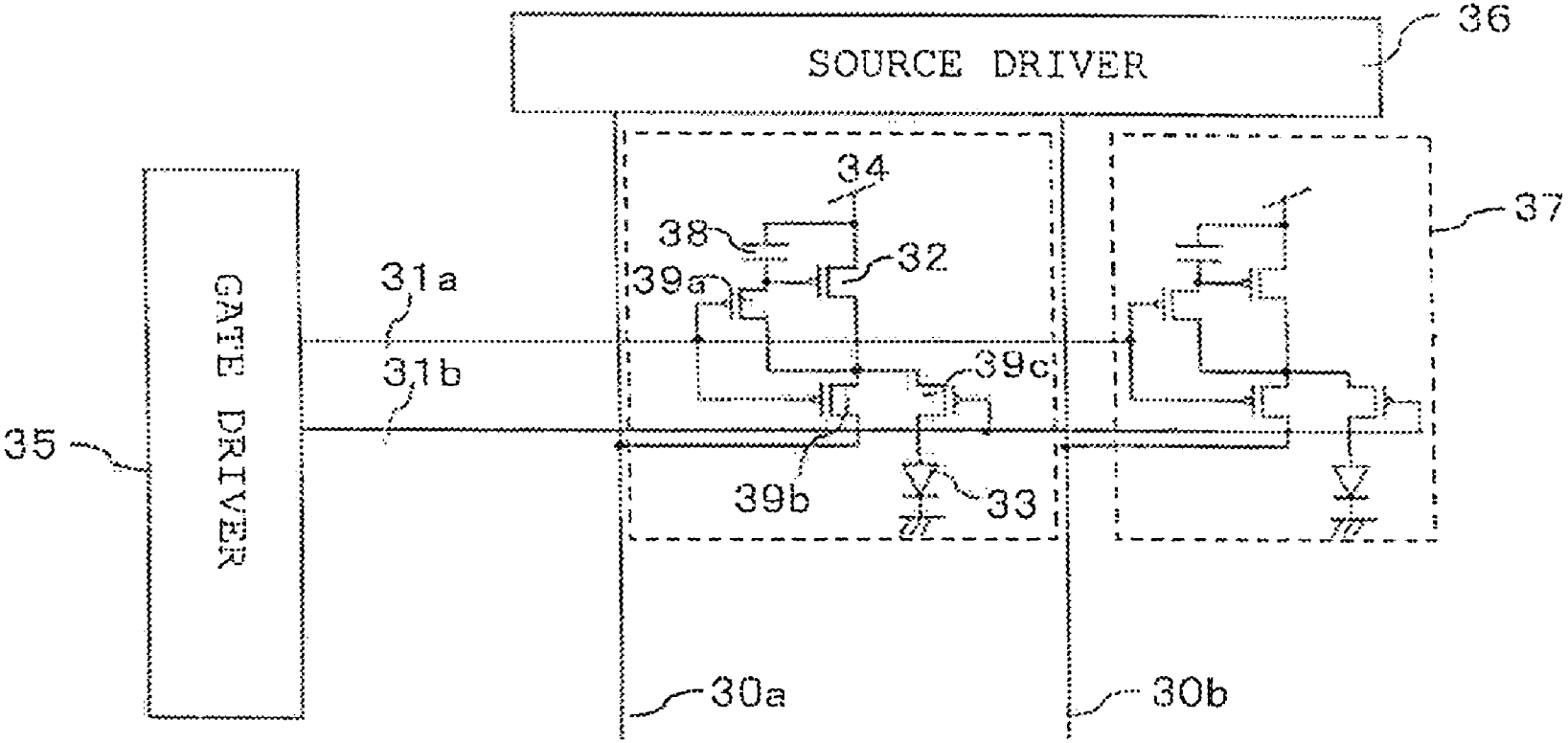
FIG. 3 is a diagram showing a circuit of an active matrix display device using a pixel circuit of a current copier structure.
Figure 4B:
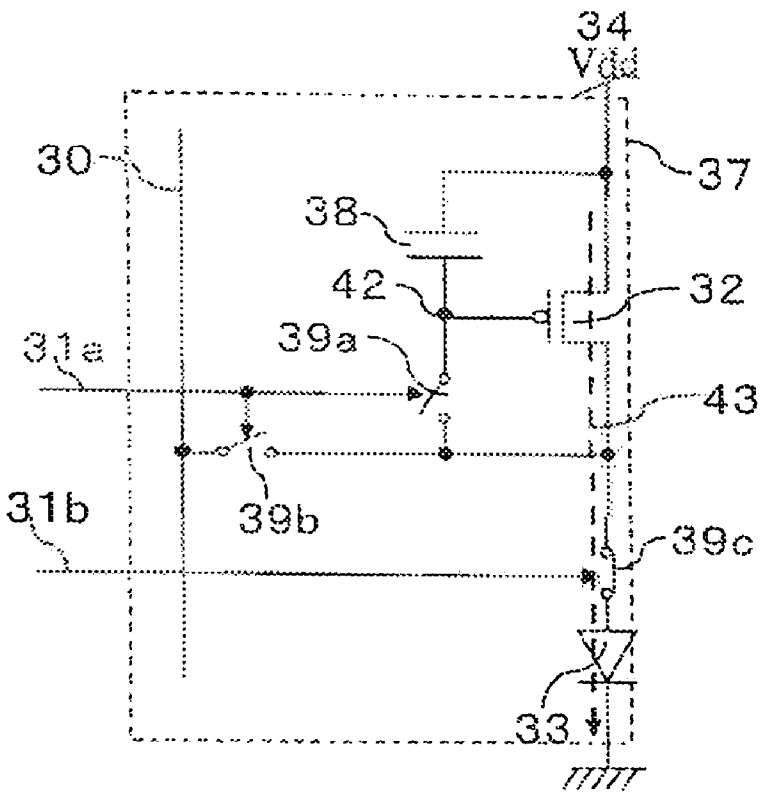
FIG. 4(*a*) is a diagram showing an operation of a current copier circuit.
Figure 4A:
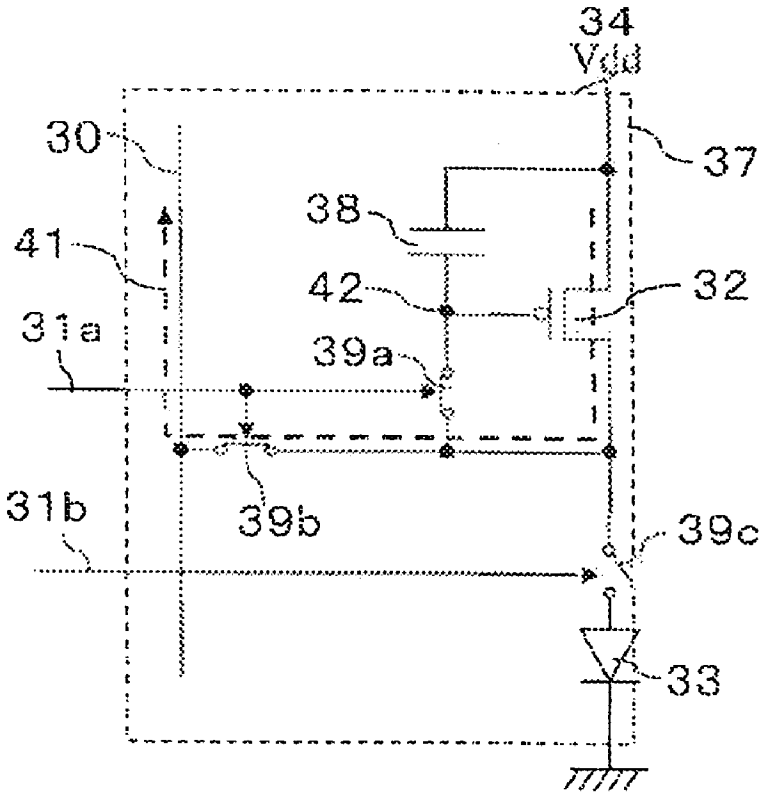
Figure 15B:
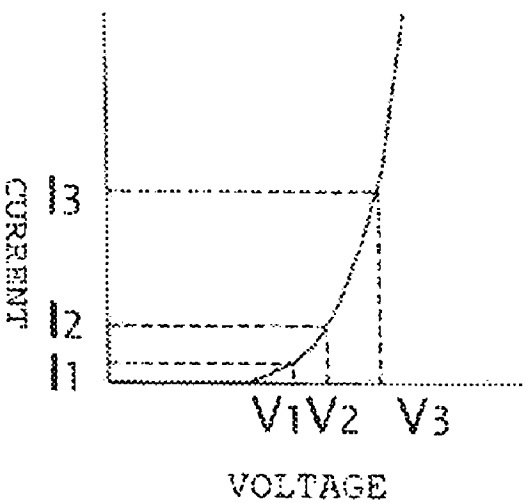
FIG. 15(*a*) is a diagram showing an equalizing circuit at the time when a source signal line current flows to a pixel.
Figure 15A:
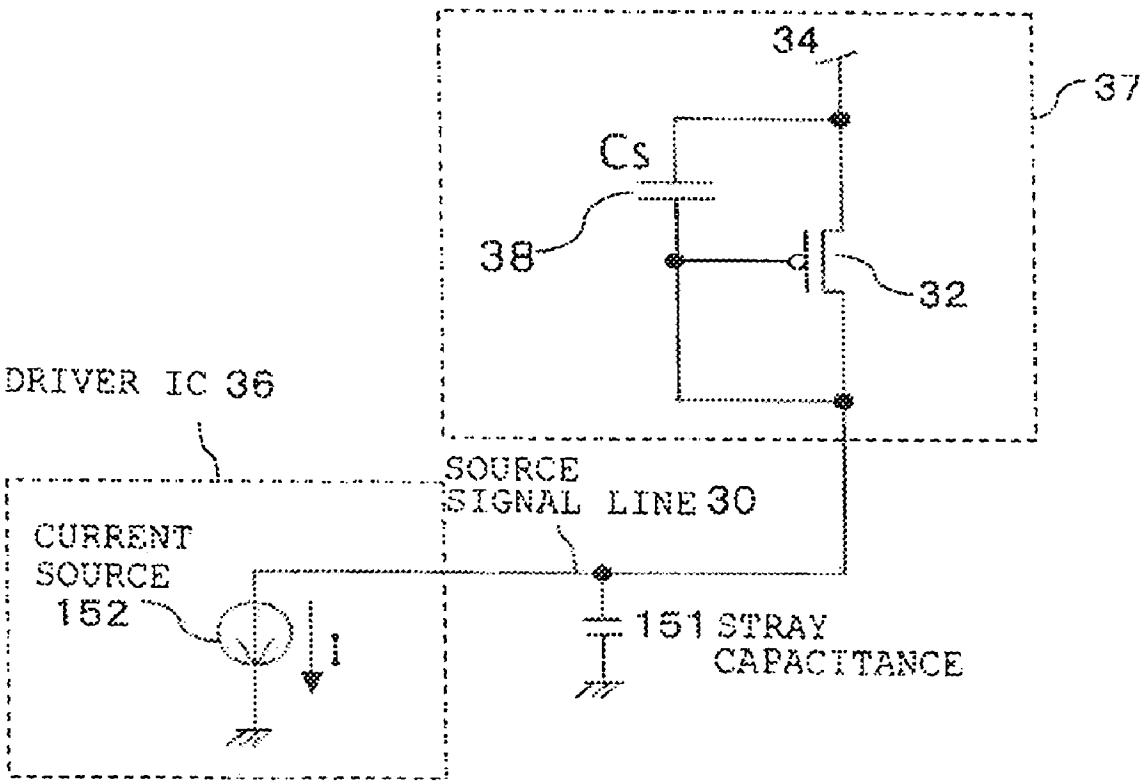

For example, a case in which a predetermined current value is written in a certain pixel from a source signal line in an active matrix display device of the pixel structure shown in FIG. 3 will be considered. A circuit obtained by extracting a circuit related to a current path from an output stage of the source driver IC 36 to the pixel is as shown in FIG. 15(*a*).

A current I corresponding to gradation flows from the inside of the driver IC 36 as an attracted current in a form of a current source 152. This current is taken into the inside of the pixel 37 through the source signal line 30. The current taken into the pixel 37 flows through the driving transistor 32. In other words, the current I flows from the EL power supply line 34 to the source driver IC 36 via the driving transistor 32 and the source signal line 30 in the pixel 37 selected.

When a video signal changes and a current value of the current source 152 changes, a current flowing to the driving transistor 32 and the source signal line 30 also changes. At that point, a voltage of the source signal line changes according to a current-voltage characteristic of the driving transistor 32. When the current-voltage characteristic of the driving transistor 32 is FIG. 15(*b*), for example, if a current value fed by the current source 152 changes from I2 to I1, the voltage of the source signal line changes from V2 to V1. This change in the voltage is caused by the current of the current source 152.

A stray capacitance 151 is present in the source signal line 30. It is necessary to draw a charge of this stray capacitance in order to change the source signal line voltage from V2 to V1. Time ΔT required for this drawing is ΔQ (the charge of the stray capacitance)=I (a current flowing to the source signal line)×ΔT=C (a stray capacitance value)×ΔV.

When it is assumed that gradation of the area 111 is 32 and gradation of the area 112 is 0 in the panel requiring a current of 1 μA in white (a 255 gradation level), since ΔV (a signal line amplitude of gradation 32 display time from the black display time) is 3 [V], C=10 pF, and a current I at the time of 32 gradation display=125 nA, time of ΔT=240 microseconds is required. This means that, since the time is longer than one horizontal scanning time (75 microseconds) at the time when QCIF+size (the number of pixels 176×220) is driven at a frame frequency of 60 Hz, if it is attempted to apply 32 gradation display to a pixel to be scanned next to a black display pixel, a half tone is memorized in the pixel because switch transistors 39*a* and 39*b* for writing a current in the pixel close while a source signal line current is changing, whereby the pixel shines at luminance in the middle of 32 gradations and black.

Since the change requires the time ΔT, luminance for plural rows takes a value in the middle of a predetermined value and that of the previous pixel. Thus, as display, it looks as if the luminance gently changes. As a result, a boundary of the pixels looks blurred.

Since a value of I becomes smaller as gradation falls, it is difficult to draw a charge of the stray capacitance 151. Thus, the problem in that a signal before changing to predetermined luminance is written in the pixel appears more markedly in lower gradation display. To put it in an extreme way, a current of the current source 152 is 0 at the black display time and it is difficult to draw a charge of the stray capacitance 151 without feeding a current (precisely, the driving transistor 32 feeds a current equivalent to gradation 32 in an initial state and a source signal line potential is changed using this current to reduce a drain current) (corresponding to the area 112 below the area 111).

Figure 13:
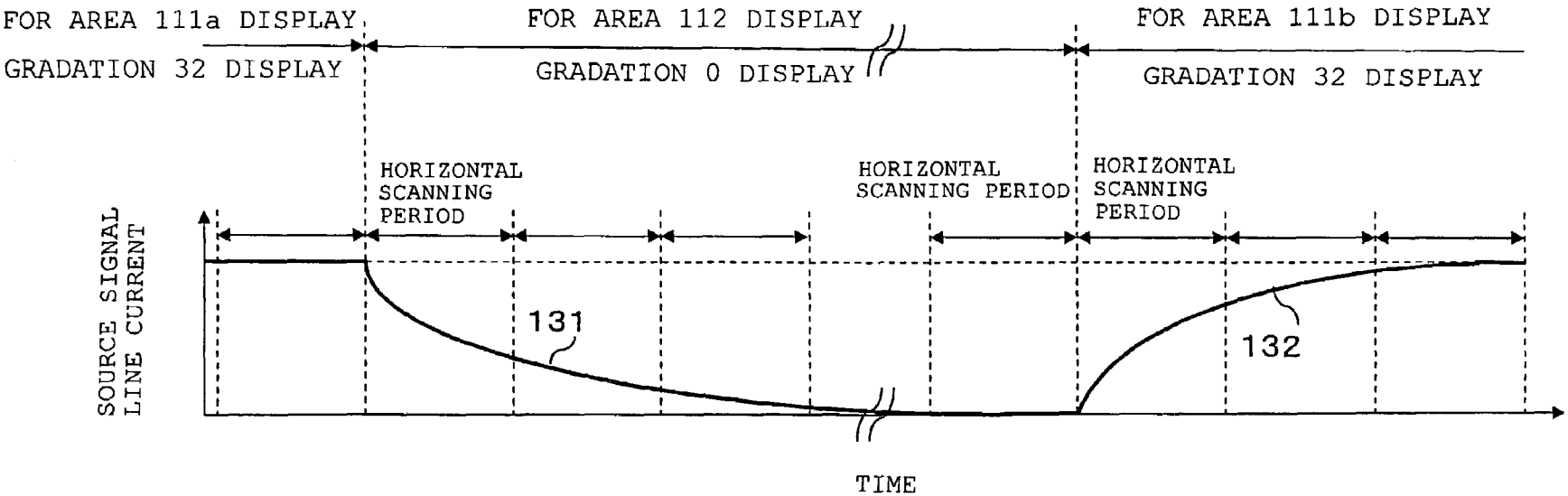
FIG. 13 is a diagram showing a temporal change in a current in a source signal line.

Therefore, a temporal change in the source signal line at the time when the area 111 has the gradation 32 and the area 112 has gradation 0 in the display shown in FIG. 11 is gentle as shown in FIG. 13. Display abnormality is found in a row in the middle of the change.

The phenomenon in which luminance of a scanning first row is higher than that of the other rows as shown in FIG. 15 will be explained using an example in which gradation 5 is in full screen display.

In a vertical blanking period, the source signal line is not connected to any pixel circuit. The source driver IC 36 only performs an operation for attempting to draw a current.

Figure 14:
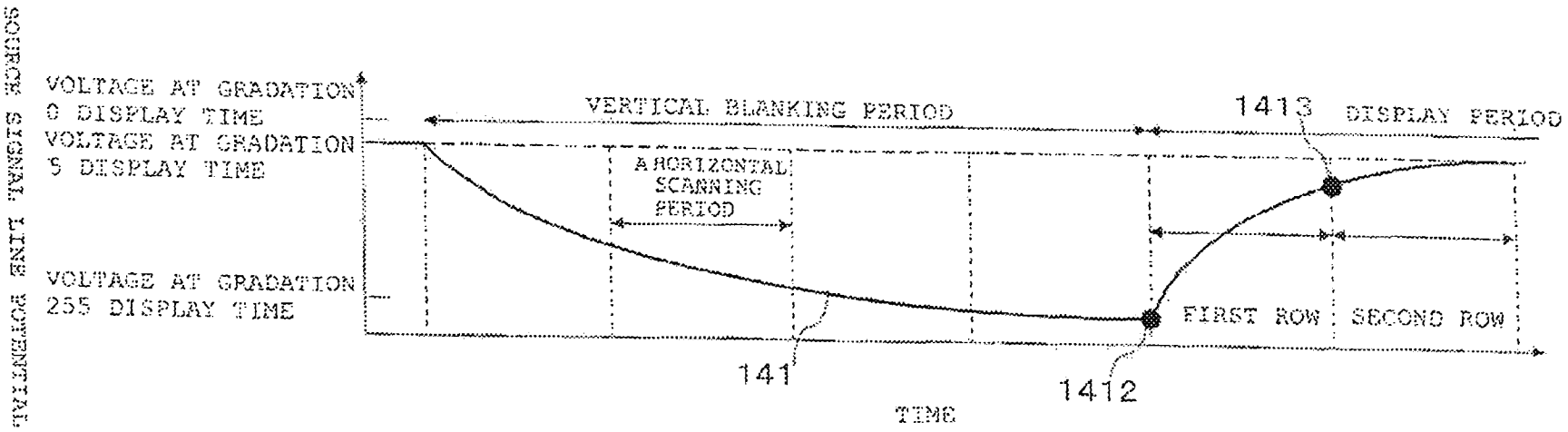
FIG. 14 is a diagram showing a temporal change in a potential in the source signal line.

As a result, as shown in FIG. 14, a potential of the source signal line 30 falls with the current source 63 as time elapses to be a potential corresponding to white gradation when the vertical blanking period ends. When it is attempted to perform gradation 5 display in this state, it is necessary to greatly change a signal line potential in the first row. As in the example in FIG. 11, the change takes time and a potential in the middle of white and target gradation is memorized (a point 1413 in FIG. 14). As a result, luminance is displayed high and the first row looks bright.

In order to solve these problems, the display device is driven using a pre-charge method.

Concerning the problem in that gradation 0 cannot be displayed, a voltage corresponding to gradation 0 display is applied to the pixel 37 by a voltage at the gradation display time to accelerate the change to a gradation 0 state. The voltage at this point is called a pre-charge voltage. A method of changing a state of a source signal line to a black display state at high speed by applying a voltage at the time of current drive is called voltage pre-charge.

Figure 16:
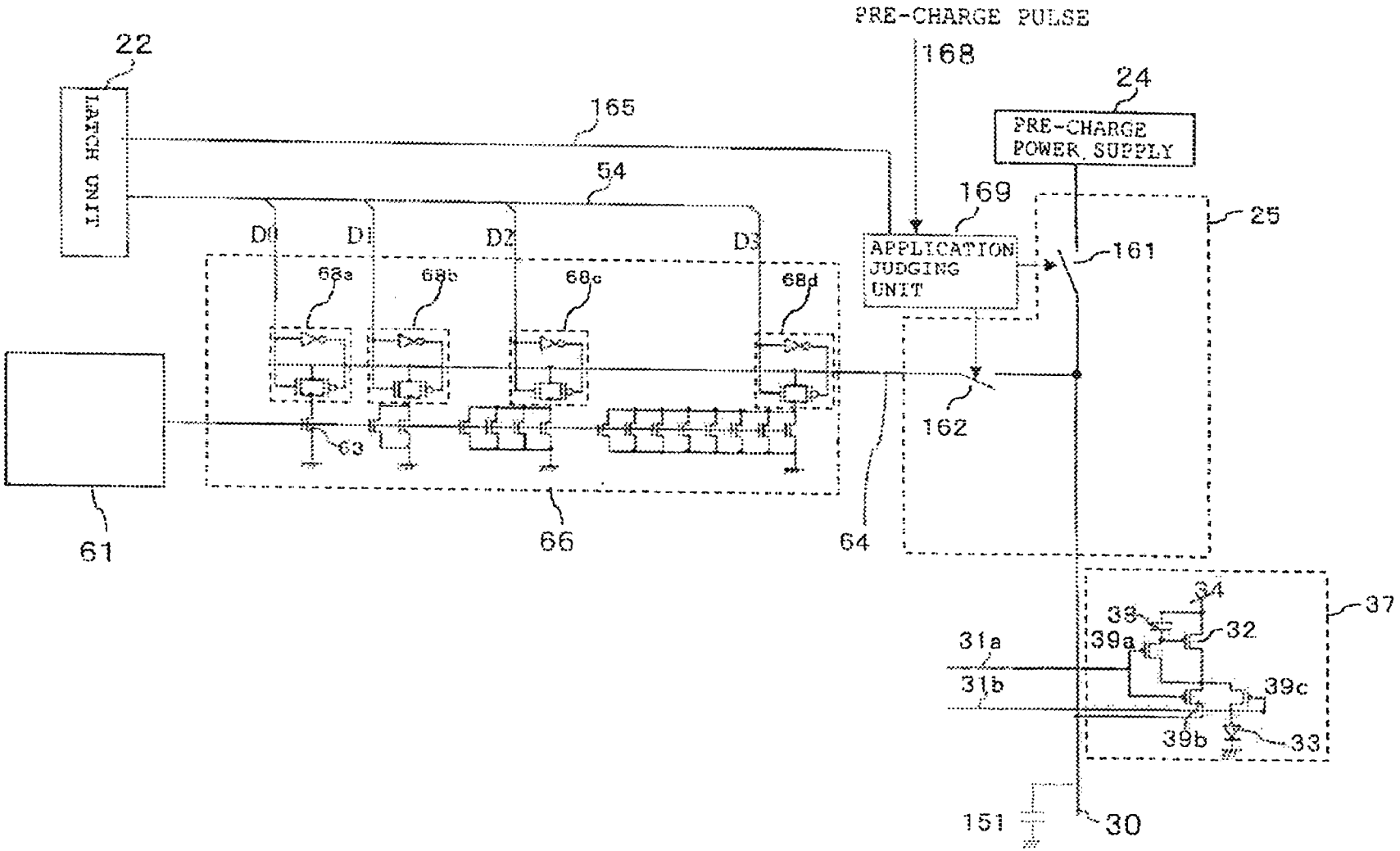
FIG. 16 is a diagram showing a relation between a current output at one output terminal and a pre-charge voltage applying unit and a changeover switch.
Figure 17:
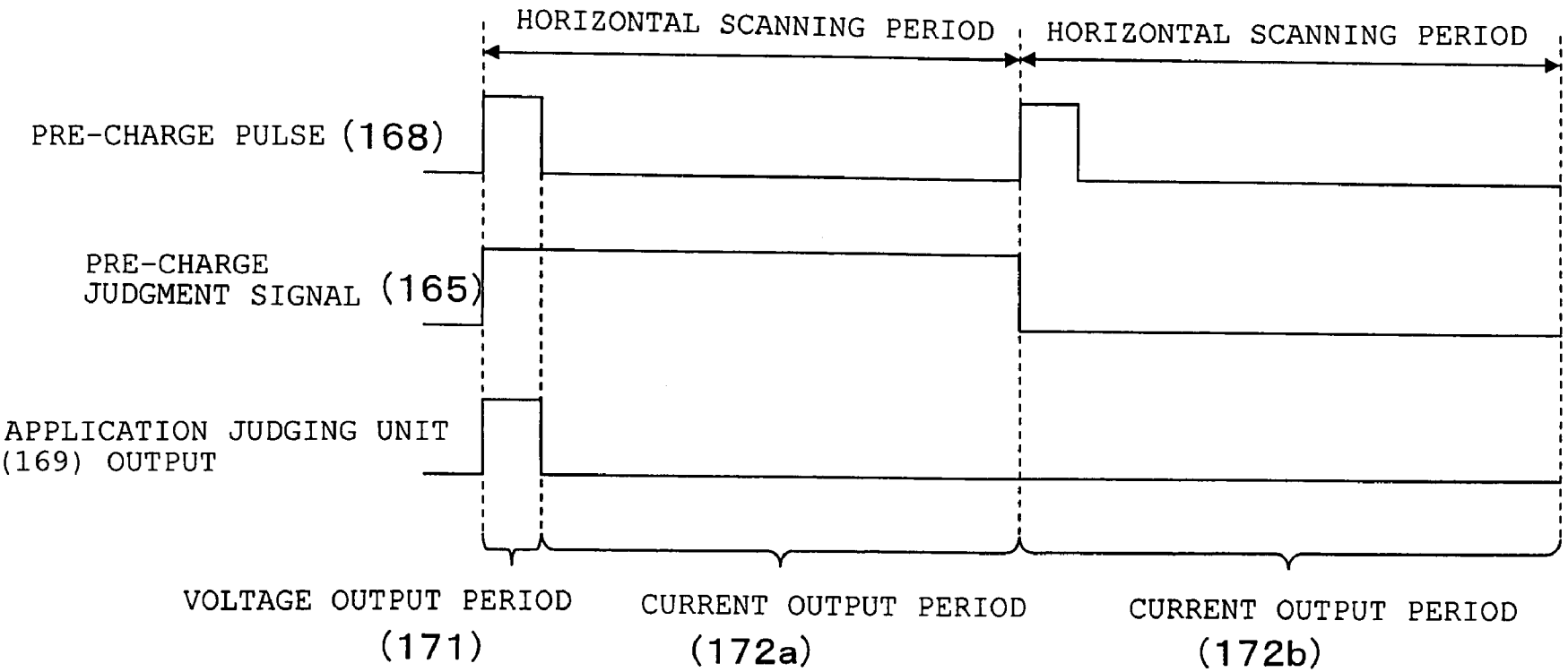
FIG. 17 is a diagram showing a relation among a pre-charge pulse, a pre-charge judgment signal, and an application judging unit output.

A structure of an output stage of the source driver 36 is shown in FIG. 16. The source driver 36 is different from the conventional driver in that a pre-charge power supply 24 for supplying a voltage to be applied at the time of gradation 0 display and an application judging unit 169 for judging whether the pre-charge power supply 24 should be applied to a pixel are added and, in order to transmit judgment data to the application judging unit 169 in synchronization with a video signal, the number of bits of a latch unit 22 is increased. A period for carrying out the voltage pre-charge depends upon a pre-charge pulse 168. Source driver operations at the time when the voltage pre-charge is present and absent are shown in FIG. 17.

Length of a voltage period depends upon the stray capacitance 151 of the source signal line 30, length of a horizontal scanning period, and buffer ability of the pre-charge power supply 24. The length is set to about 2 microseconds. The ability of the pre-charge power supply 24 is designed such that a potential of the stray capacitance 151 (about 10 pF) can be changed by about 5 V in 2 microseconds.

Figure 18:
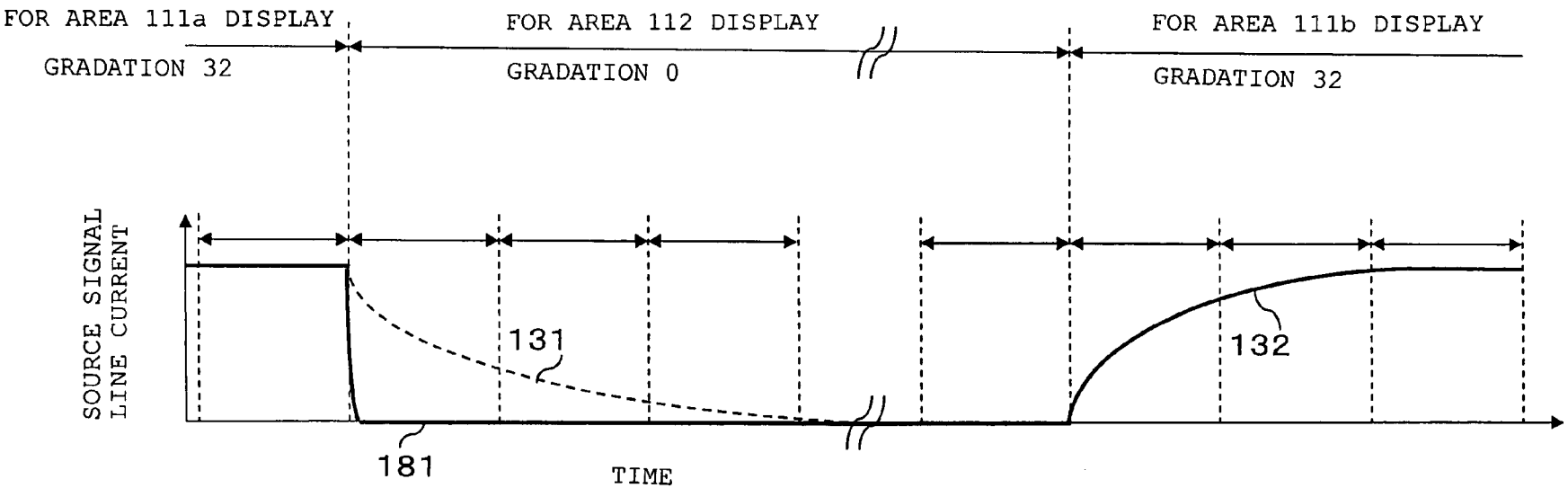
FIG. 18 is a diagram showing a temporal change in a current in the source signal line at the time when current pre-charge is performed.

Consequently, whereas a source signal line current changes as indicated by 131 in FIG. 13 conventionally, the source signal line current changes as indicated by 181 in FIG. 18. This makes it possible to perform display at gradation 0 from the display first row in the area 112.

Figure 19:
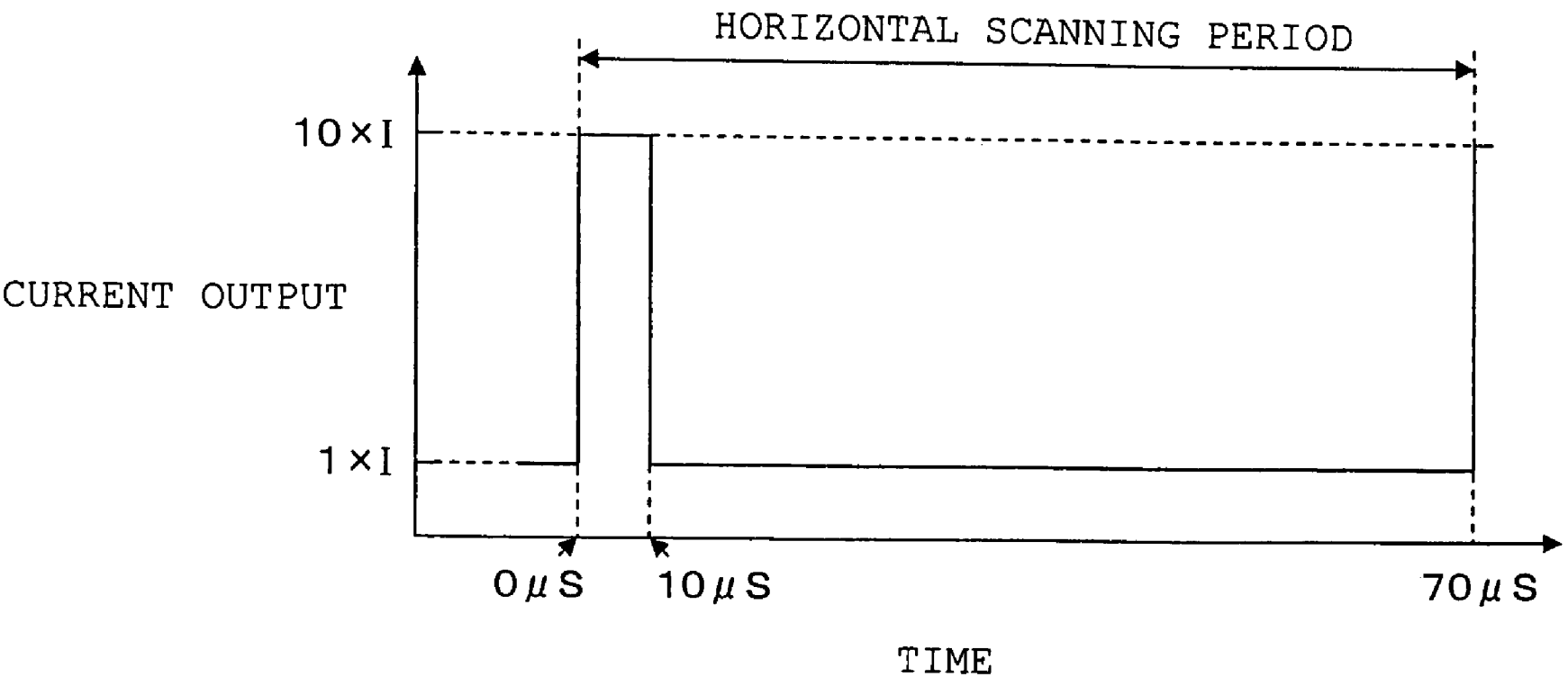
FIG. 19 is a diagram showing a temporal change in a source driver output at the time when a current ten times as large as a predetermined current is outputted at the beginning of a horizontal scanning period.

This method does not have an effect on a change indicated by 132. Thus, as means for increasing change speed, as shown in FIG. 19, a method of providing a period in which an amount of current is temporarily increased, increasing change speed in the period, and quickly changing the amount of current to a predetermined amount of current is adopted. In an example in FIG. 19, a current ten times as large as the amount of current is fed. It is effective to feed a current larger than a predetermined gradation current, for example, to feed a maximum gradation current even if the current is not ten times as large as the amount of current. A method of providing a period in which a large current is fed is called current pre-charge. The current to be fed in a large quantity is called a pre-charge current.

Figure 20:
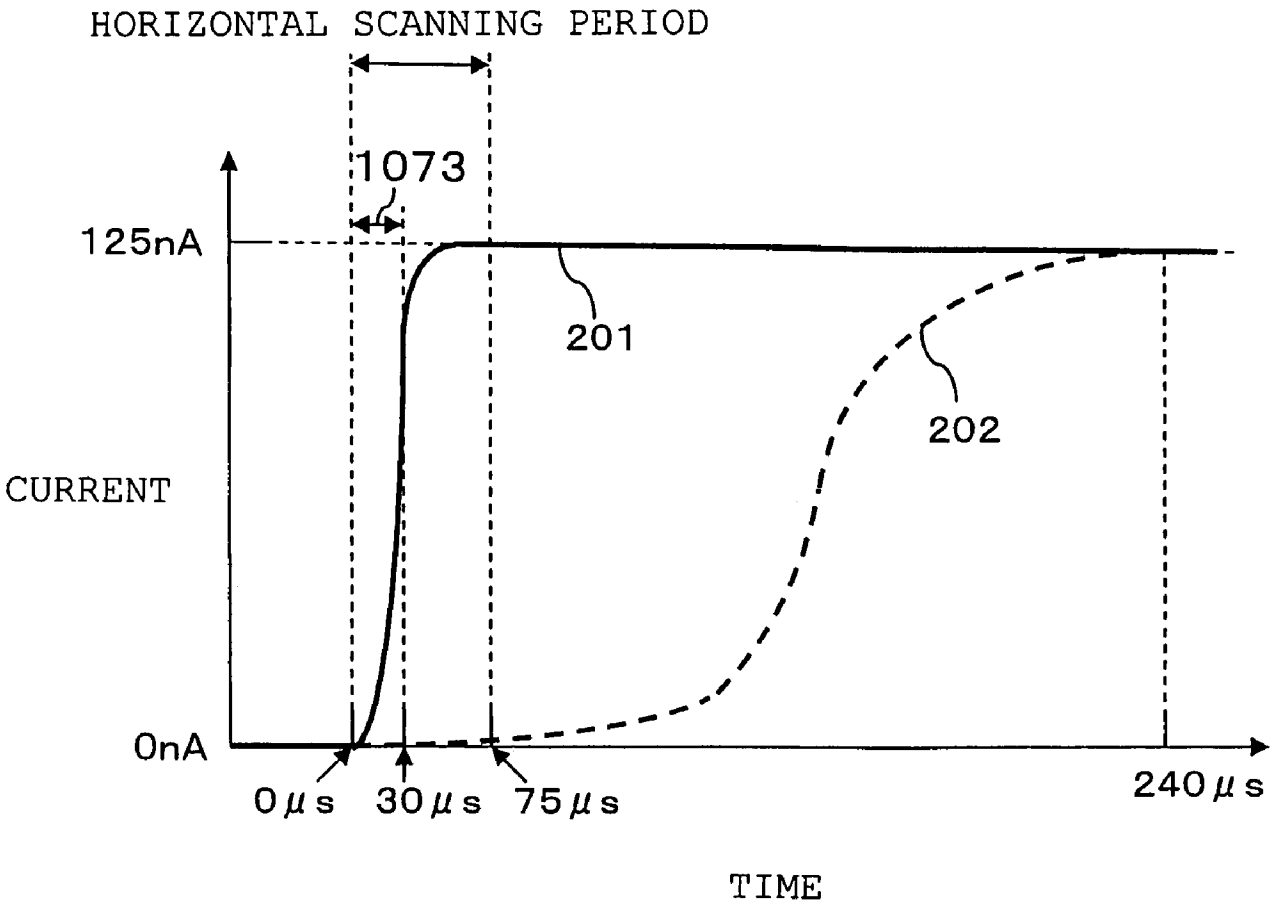
FIG. 20 is a diagram showing a state of a change in a source signal line current at the time when the current pre-charge is performed.

A state of a current change in the case in which a current is changed to a current of a 32 gradation level using this method is shown in FIG. 20. In a conventional curve 202, it takes 240 microseconds until the current is changed to 125 nA. It becomes possible to change the current to 125 nA within 75 microseconds by carrying out the present invention. In this example, a pre-charge current equivalent to a maximum gradation current of a driver (255 gradations in an example of 8 bits) is fed. Therefore, if a current pre-charge period 1073 shown in FIG. 20 is about 30 microseconds, it is possible to change the current to a current closer to a predetermined current value. A predetermined gradation display current is fed using the remaining 45 microseconds to correct unevenness of the driving transistor 32 which is characteristic in a pixel structure of a current copier. Consequently, a current quickly changes and it is possible to display predetermined luminance even if gradation is low.

Time of change to a predetermined current by the current pre-charge depends upon a state of a source signal line in a row immediately preceding a relevant row. For example, an amount of a voltage change is different in the case in which a black level in the immediately preceding row is changed to 32 gradations and the case in which 3 gradations in the immediately preceding row are changed to 32 gradations. Thus, even if writing is performed with a 32 gradation current, a writing state is different. It is easier to perform writing in the case of 3 gradations in the immediately preceding row. Thus, a period of the current pre-charge has to be short (comparison in the case in which a pre-charge current value is identical. The same holds true when a current value is reduced and length is reduced).

Consequently, simply speaking, 256×256 kinds of pre-charge periods are necessary. This makes it complicated to judge and output a current.

Figure 21:
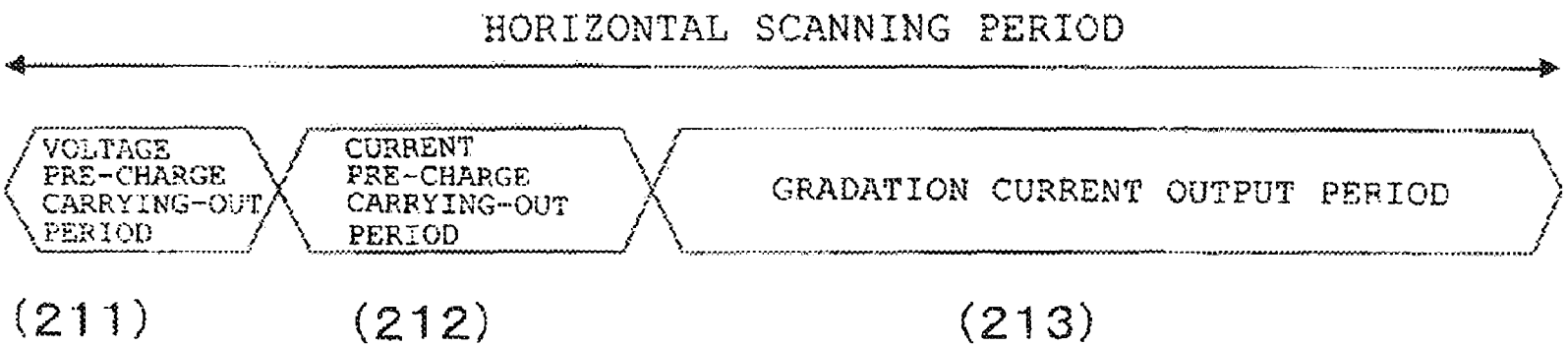
FIG. 21 is a sequence chart at the time when the current pre-charge is carried out in one horizontal scanning period.

Thus, in order to reduce the types of pre-charge, before carrying out the current pre-charge, a state of a source signal line is fixed to a certain value to change gradation from the state to a predetermined gradation. This makes it possible to perform predetermined display simply by setting a current pre-charge period depending on gradation of the relevant row. A sequence at the time when the current pre-charge is carried out in one horizontal scanning period is shown in FIG. 21. First, the voltage pre-charge is carried out (211). Consequently, a voltage is set in a black display state. Subsequently, the current pre-charge is carried out (212) Consequently, a current value changes to a value close to a predetermined current. Finally, potential correction for the driving transistor 32 is performed to carry out gradation display in a gradation current output period (213).

Figure 22:
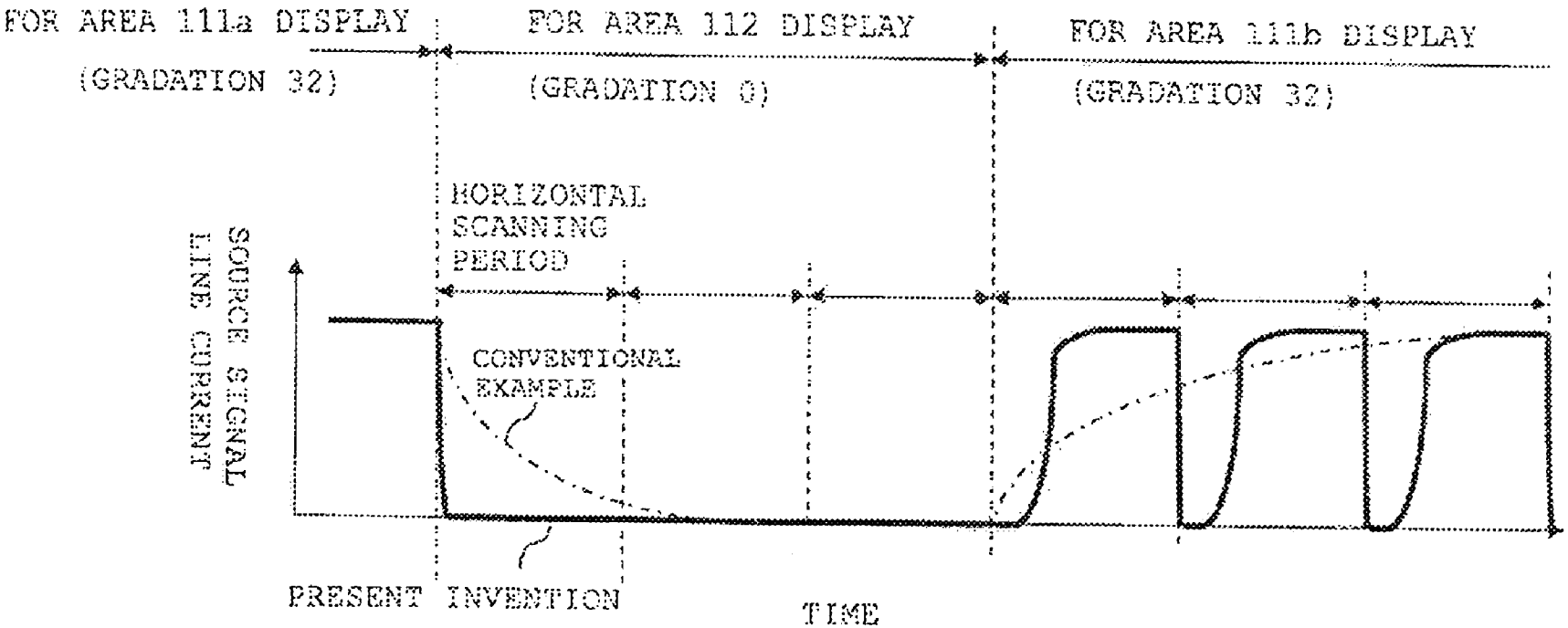
FIG. 22 is a diagram showing a temporal change in a source signal line current at the time when the current pre-charge is carried out.

Consequently, in the display pattern in FIG. 11, as shown in FIG. 22, speed of a change from an area 111*a* to the area 112 and change from the area 112 to an area 111*b* increase. Predetermined gradation could be properly displayed even in the first row after the change as shown in FIG. 22.

Figure 23:
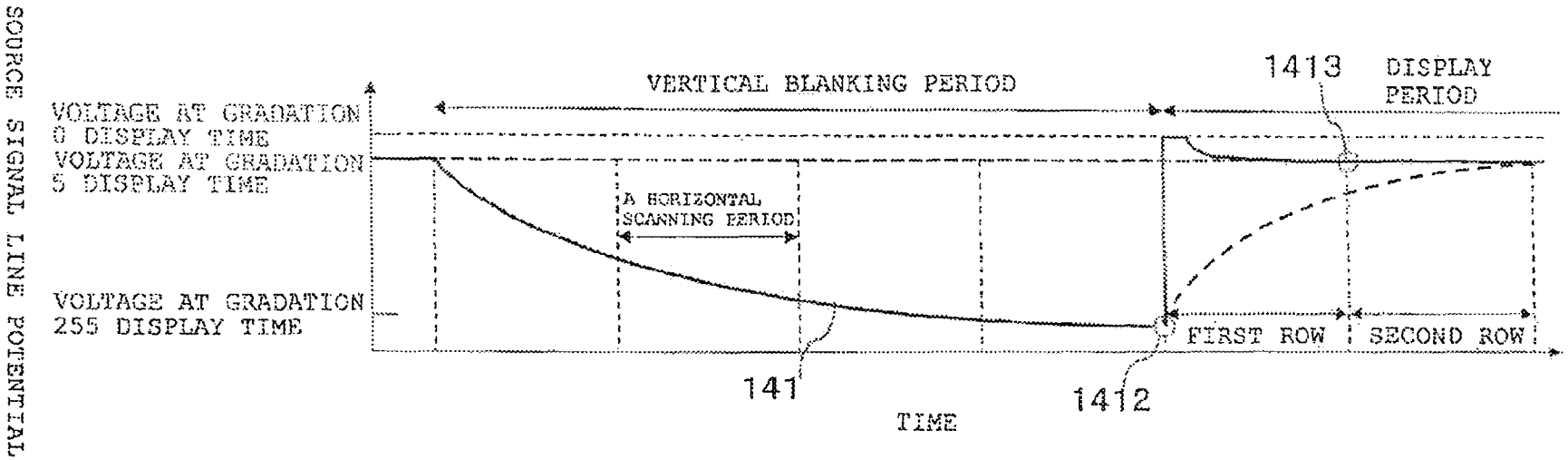
FIG. 23 is a diagram showing a state of a source signal line change in the case in which the current pre-charge is performed in a first row.

If this is always carried out in the display first row, as shown in FIG. 23, it is possible to carry out gradation 5 display from the first row.

Figure 24A:
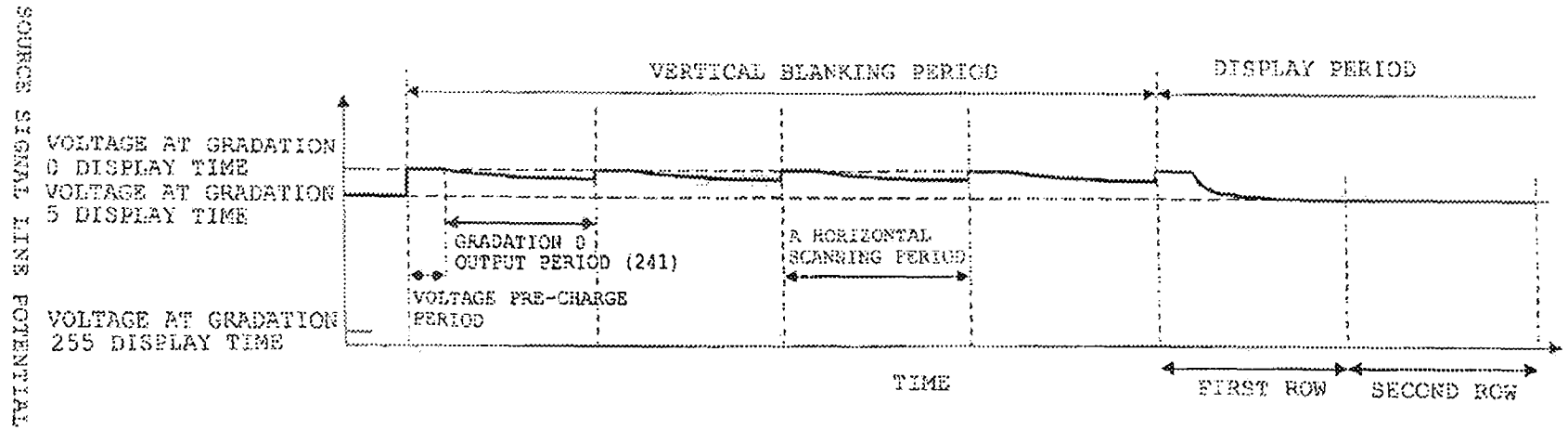
FIG. 24(*a*) is a diagram for comparing source signal line potentials according to time during which voltage pre-charge is performed.
Figure 24B:
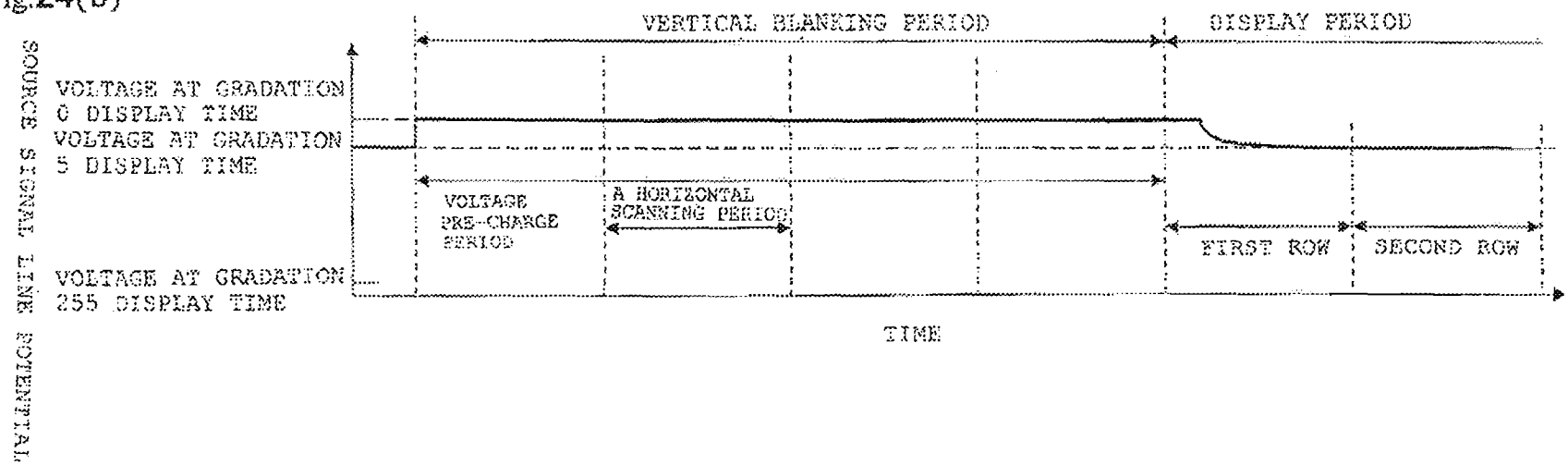

In order to prevent a potential fall in a vertical blanking period, there is a method of forcibly setting a source driver output to a gradation 0 output (i.e., no current attraction) in the vertical blanking period or carrying out the voltage pre-charge in the vertical blanking period to fix a potential to a black potential. The voltage pre-charge may be performed by a method of performing the voltage pre-charge only for about 2 microseconds in the same manner as the usual voltage pre-charge as shown in FIG. 24(*a*) or a method of always performing the voltage pre-charge as shown in FIG. 24(*b*). In the case of FIG. 24(*a*), since there is a gradation output period, it is preferable to fix gradation to gradation 0 to set a gradation 0 output period 241.

Figure 25:
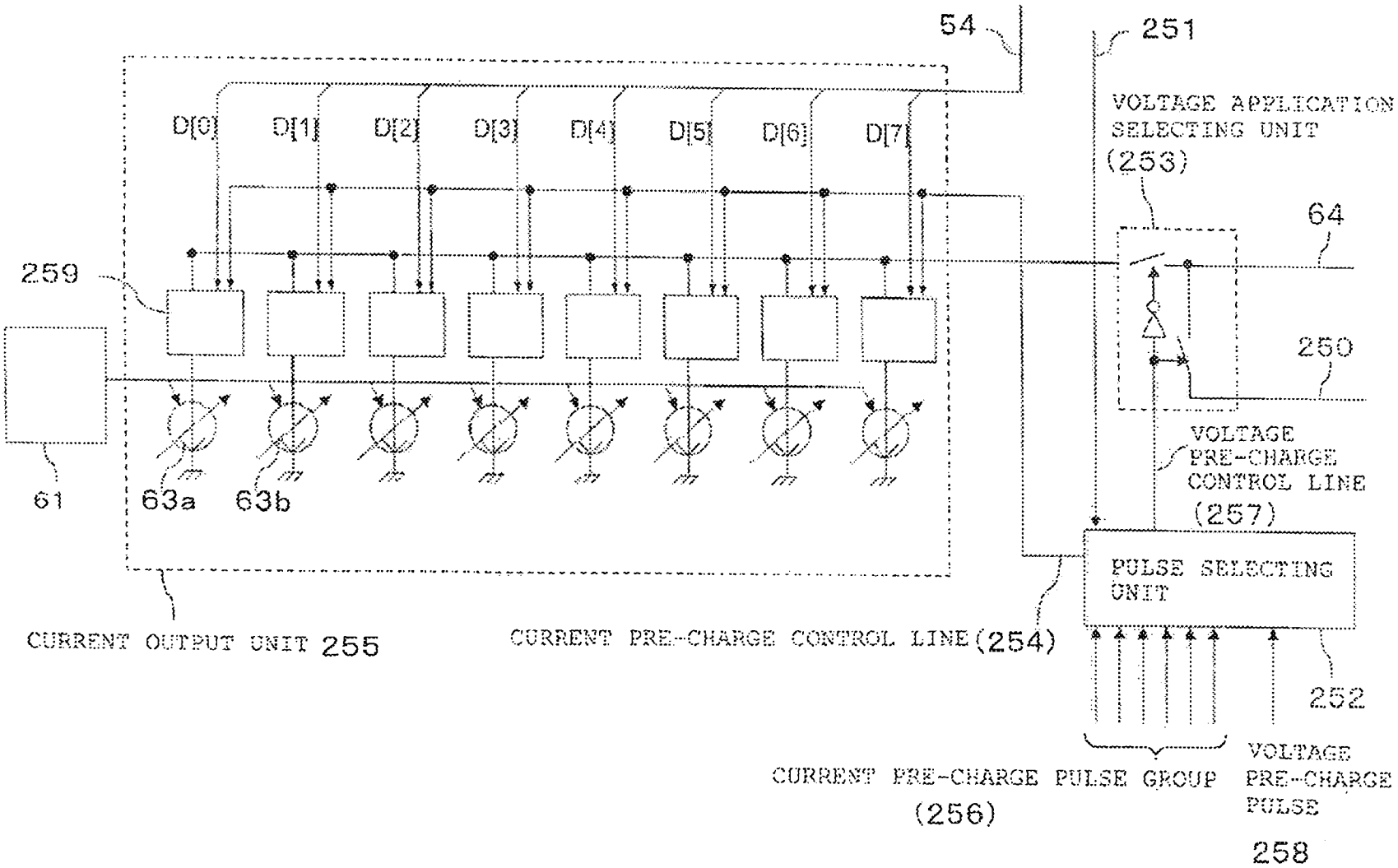
FIG. 25 is a diagram showing a circuit of a current output unit 255 which has a function of performing the current pre-charge.

A current output unit structure for performing the current pre-charge and the voltage pre-charge is shown in FIG. 25. In the figure, a selecting unit 259 connects the current source for gradation display 63 to the current output 64 when the gradation data 54 or a current pre-charge control line 254 is at a high level. The selecting unit 259 is means for determining whether the current source for gradation display 63 should be connected to the current output 64. The voltage pre-charge carrying-out period 211 shown in FIG. 21 depends upon a pulse width of a voltage pre-charge pulse 258. The current pre-charge carrying-out period 212 depends upon a current pre-charge pulse group 256. There are plural current pre-charge pulses because an optimum current pre-charge period is different depending upon a display gradation. A current pre-charge pulse having an optimum pulse width is selected depending on gradation. A period in which neither the current pre-charge pulse 256 nor the voltage pre-charge pulse 258 is inputted is the gradation current output period 213 shown in FIG. 21.

A pre-charge judging line 251 selects an optimum current pre-charge pulse 256 depending on gradation and sets presence or absence of a voltage pre-charge pulse. A signal is inputted to the pre-charge judging line 251 in synchronization with the gradation data 54. For example, as shown in FIG. 26, a pulse selecting unit 252 outputs a pre-charge pulse in response to a value of the pre-charge judging line 251. When a value of the pre-charge judging line 251 is 0, since a pre-charge pulse is not outputted, the pulse selecting unit 252 performs usual gradation output. When a value of the pre-charge judging line 251 is 7, the pulse selecting unit 252 performs only the voltage pre-charge. In other cases, after carrying out the voltage pre-charge, an operation for carrying out the current pre-charge is performed.

Figure 27:
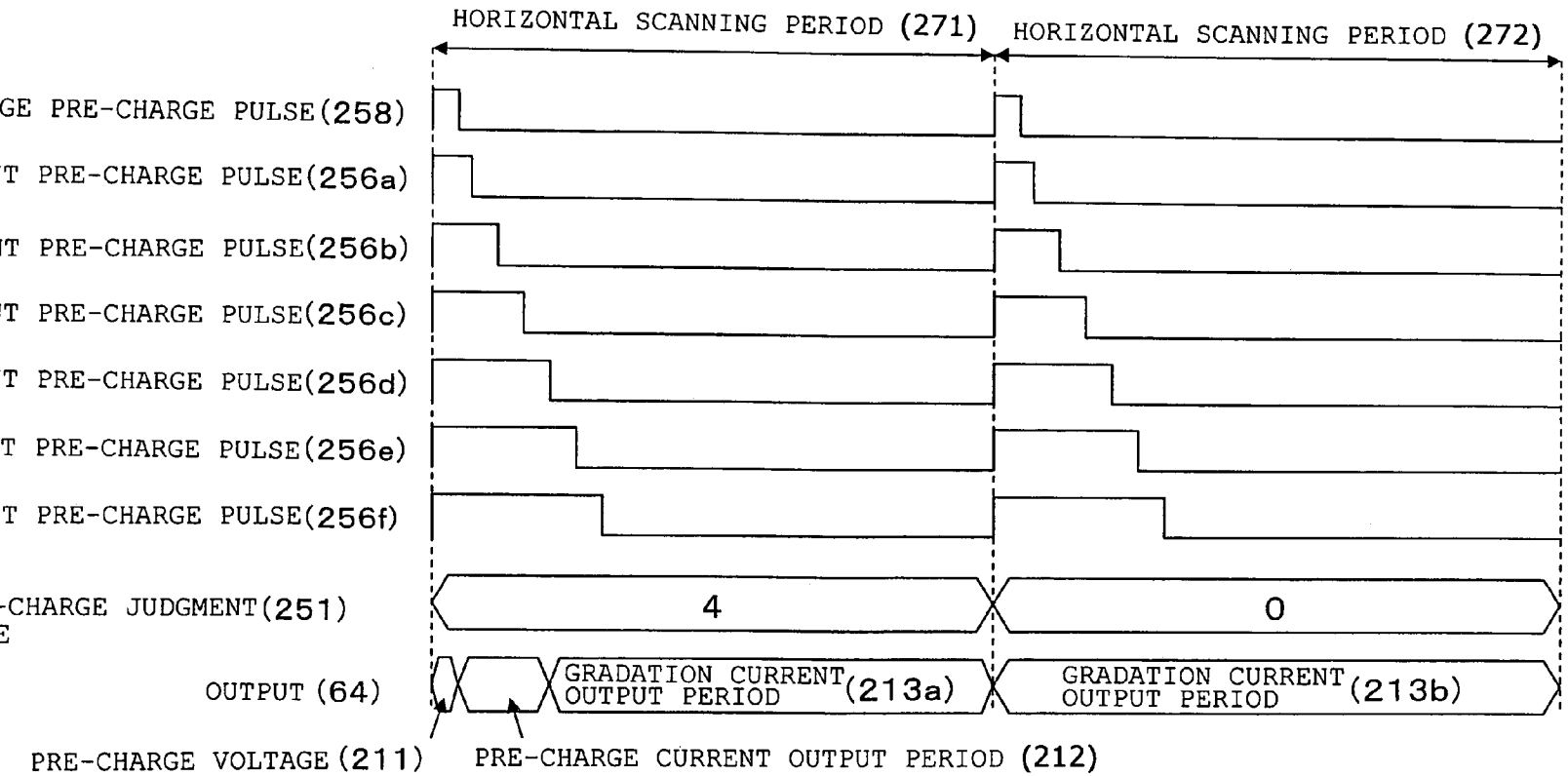
FIG. 27 is a diagram showing temporal changes in a pre-charge pulse group, a pre-charge judgment line, and an output.

An example of setting of respective pre-charge pulses is shown in FIG. 27. When the voltage pre-charge pulse 258 and the current pre-charge pulse 256 are simultaneously inputted, the voltage pre-charge pulse 258 is caused to act preferentially by a voltage application selecting unit 253. Thus, the pulses simultaneously rise at the time of the start of a horizontal scanning period. Six kinds of current pre-charge pulses are prepared. The current pre-charge pulses are set longer in order from one denoted by "a".

If a value of the pre-charge judging line 251 is 4, as shown in FIG. 27, first, the voltage pre-charge carrying-out period 211 is set by the voltage pre-charge pulse 258. The current pre-charge carrying-out period 212 (only a period set by a current pre-charge pulse 256*d*) follows. The remaining time is the gradation current output period 213.

If a value of the pre-charge judging line 251 is 0, as indicated by a horizontal scanning period 272, the entire period is the gradation current output period 213.

FIG. 28 indicates how pre-charge is carried out for respective gradations. In the case of gradation 0, the voltage pre-charge is carried out as described above. In gradation 1 to gradation 102, the current pre-charge is carried out. A current pre-charge period (a voltage pre-charge is always present before the current pre-charge) is set to be longer as gradation increases. In gradation 103 or higher gradations, when a current is 1 μA at the 255 gradation time in an example of a pixel of QCIF+, even if gradation is gradation 0 in the immediately preceding row, it is possible to change the gradation within 75 microseconds. Thus, the pre-charge is unnecessary. Therefore, output only by a gradation current is performed.

An example of respective pre-charge pulse widths is shown in FIG. 29. The pre-charge pulse widths are set according to an amount of a voltage change from a pre-charge voltage value corresponding to gradation 0 display. Combinations of gradations with respect to respective pre-charge pulses are as shown in FIG. 28.

In FIG. 28, the plural gradations can share an identical pre-charge pulse. This is because, if a potential is fluctuated to a value close to a target value by the current pre-charge, it is possible to correct the potential to a predetermined value using a gradation current.

Figure 30:
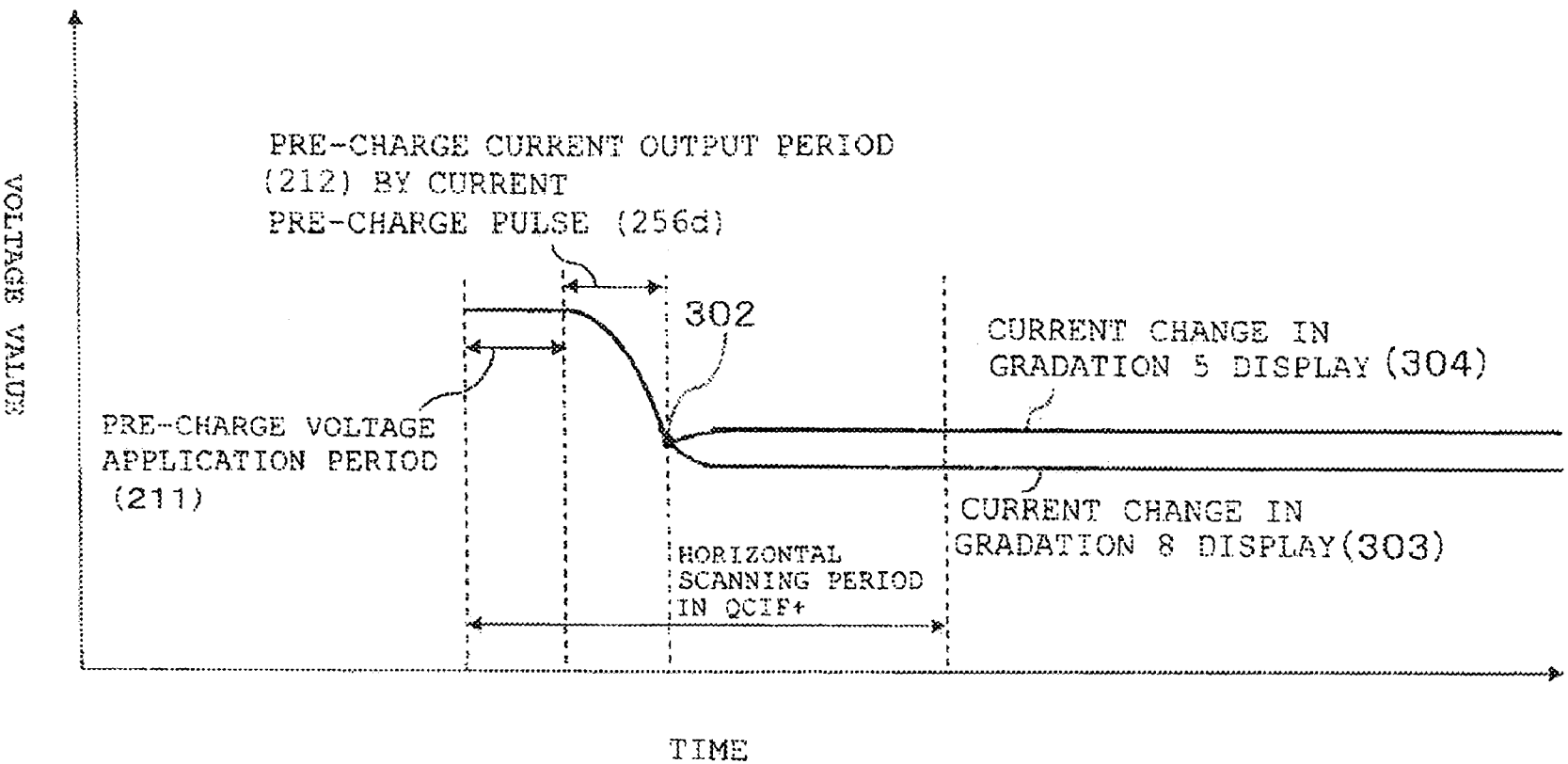
FIG. 30 is a diagram showing a temporal change in a source signal line current at the time when a current pre-charge pulse 256*d* is selected.

FIG. 30 shows a state of a current change in the case in which the current pre-charge pulse 256*d* is applied at gradation 5 and gradation 8. In the case of gradation 5 display, 2.4 V is required as a potential change in a source signal line from a black display state. In the case of gradation 8 display, 2.65 V is required.

When length of the current pre-charge shown in FIG. 29 is set in the current pre-charge period 212, a potential change is 2.5 V. Thereafter, the potential is changed to a predetermined potential using a gradation current. In gradation 5 display, as indicated by 304, it is necessary to change a potential by about 0.1 V to reduce a current. Since a current value is 20 nA and the gradation current output period 213 is 55 microseconds, it is possible to change a potential by 0.11 V using a gradation 5 current. It is seen that it is possible to display a predetermined gradation if the current pre-charge 256*d* is used. On the other hand, in gradation 8, since a current value is 31 nA, it is possible to change a potential by 0.16 V in 55 microseconds. Thus, it is possible to change the potential sufficiently with respect to a voltage value 0.15 V necessary for the change. In this way, it is possible to perform display of gradations 5 to 8 using the identical pre-charge pulse 256*d*.

In this way, the optimum current pre-charge pulse 256 is selected for each gradation. This makes it possible to perform display without insufficiency of writing for all the gradations.

Figure 31:
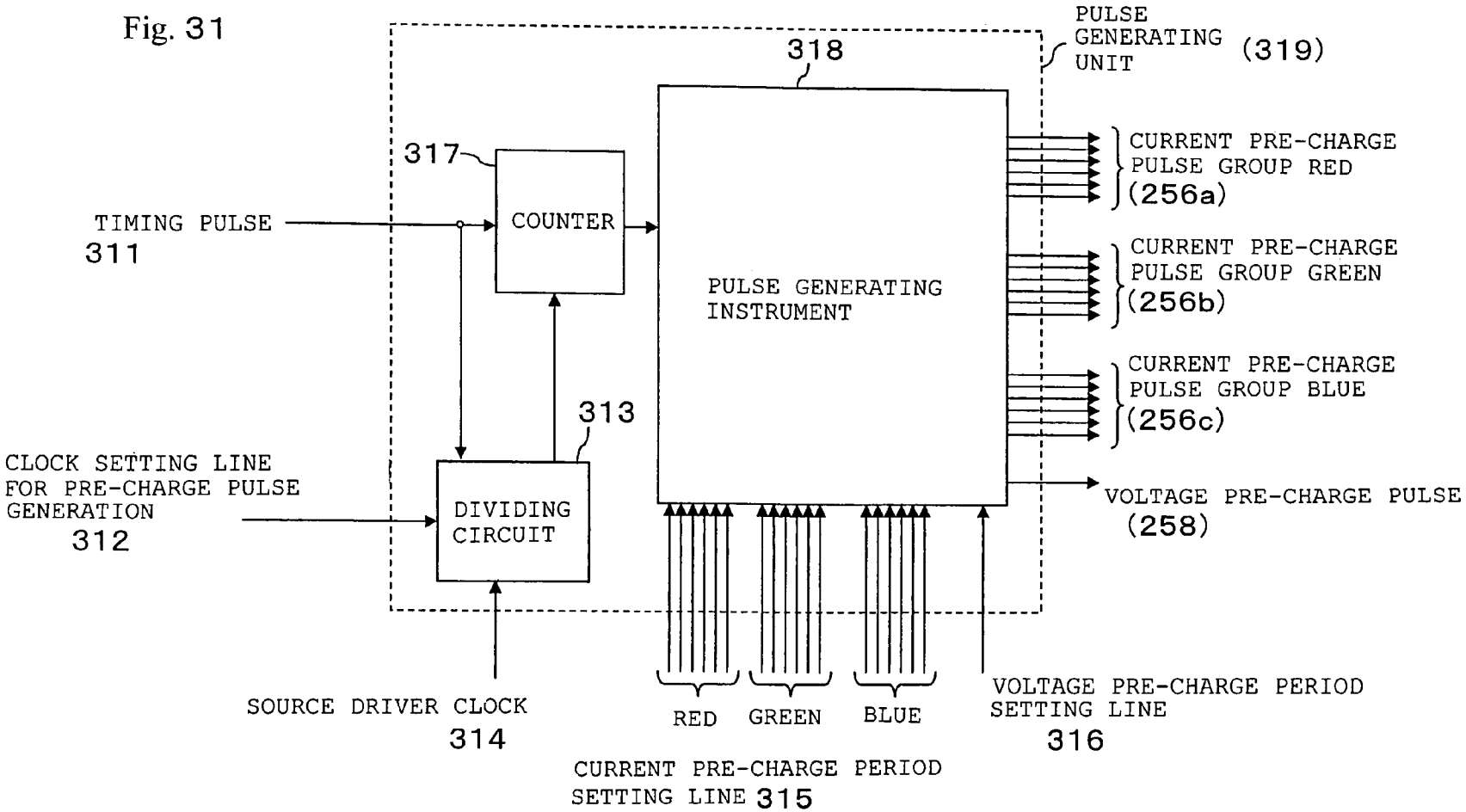
FIG. 31 is a diagram showing a circuit structure of a pulse generating unit which outputs a different current pre-charge period for each luminescent color.

A pre-charge pulse is supplied from a pulse generating unit as shown in FIG. 31. Since the pre-charge is carried out after the start of a horizontal scanning period, a pulse is generated by a timing pulse 311 for determining analog output timing of a source drive. Thereafter, in order to determined length of respective pre-charge pulses, a value of a clock 314 and a counter 317 and a value of pre-charge period setting lines (315, 316) are compared. Pulses are continuously generated until the values coincide with each other.

Current pre-charge pulse groups are set separately for each color because a value of a gradation current is different for each color and it is likely that time for changing to a predetermined current value is different even if the current pre-charge is carried out with a maximum gradation current.

Concerning the voltage pre-charge, a potential is forcibly changed to a certain potential using a voltage and a necessary pre-charge period does not change depending upon a voltage value. Thus, a voltage pre-charge pulse is set commonly for all the colors.

The respective pre-charge pulses are generated by the source driver clock 314. Thus, depending upon a frequency of a clock, a problem occurs in that a pulse width can only be set short (in the case of application to a panel with high resolution) or a pulse width can only be set long (a panel with low resolution). There is a method of increasing the number of bits of the setting line 315 for setting a period in the pulse generating unit to expand a variable range. However, in this case, a circuit size of a pulse generating instrument 318 has to be larger. A dividing circuit 313 which divides the source driver clock 314 to control a clock frequency is provided. A clock after division is inputted to a circuit of the counter 317 for pulse generation. Consequently, it is possible to set a pulse width without being affected by resolution of a screen to some extent.

Figure 32:
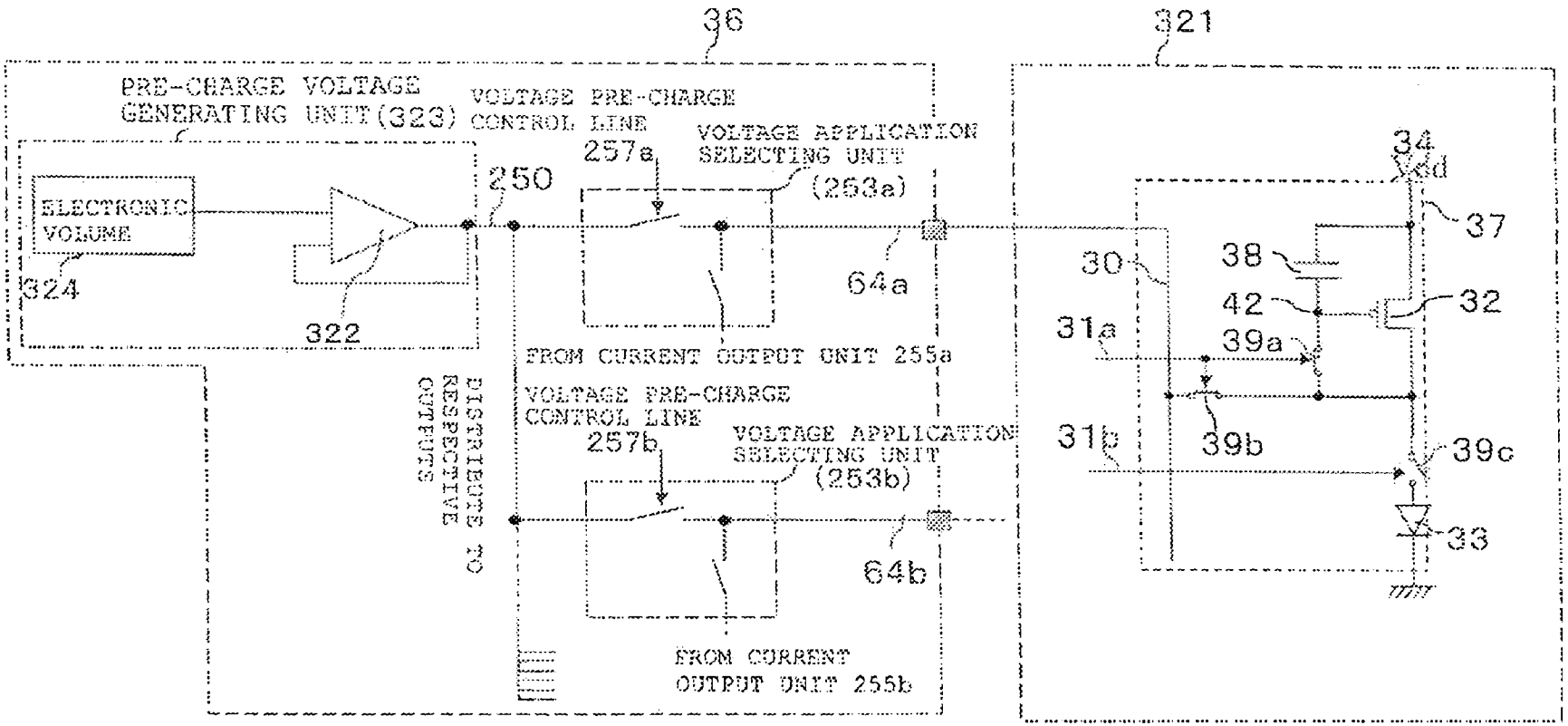
FIG. 32 is a diagram showing a circuit structure for performing the voltage pre-charge.

A circuit structure for applying the voltage pre-charge to the current output unit in FIG. 25 is shown in FIG. 32. A pre-charge voltage generating unit 323 is constituted to be capable of changing an output voltage value using a command in an electronic volume 324. An output of the pre-charge voltage generating unit 323 is connected to the outputs 64 via a voltage pre-charge control line 257. A common voltage is outputted to all the outputs. Since voltage setting at the time of black display cannot be separately made for each color, circuits for separately setting voltages are not necessary. Only one circuit is present for a reduction in a circuit size.

Figure 33:
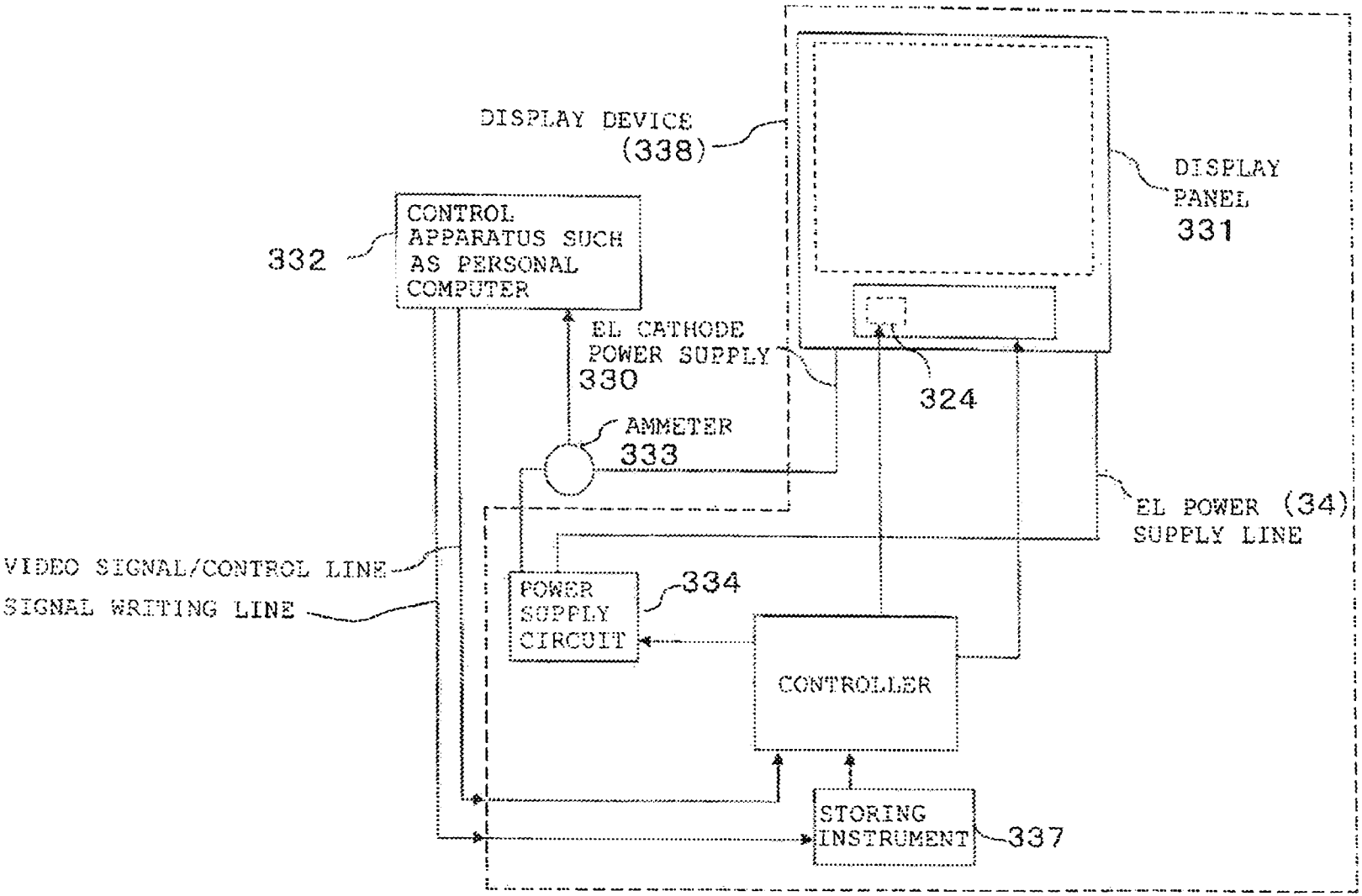
FIG. 33 is a diagram showing a circuit structure for adjusting black luminance.

The electronic volume 324 is used for adjusting black luminance different for each panel to control fluctuation in luminance. A circuit structure for adjusting black luminance is shown in FIG. 33. Originally, for adjustment of black luminance, it is necessary to measure luminance with a luminance meter and adjust the luminance to be fixed. However, in the organic luminous element which is self luminous, black luminance is equal to or lower than 0.05 candela. For the measurement, adjustment in a dark room is required in addition to selection of a luminance meter. Thus, in the present invention, instead of luminance measurement, a method of measuring a sum of current values flowing to all pixels to adjust the currents to be within a fixed range making use of the fact that a luminance-current characteristic of the organic luminous element is substantially in a proportional relation is adopted. Thus, in FIG. 33, an ammeter 333 is inserted in an EL cathode power supply line 330 where a sum of currents flowing to the organic luminous element is known, a value of the ammeter 333 is readout, and a control apparatus 332 such as a personal computer controls the electronic volume 324 in the source driver via a controller. Finally, an optimum electronic volume value is stored in a storing instrument 337. (The storing instrument is mounted on a final module and, after writing, modulated to form a pair with an adjusted panel.) After the adjustment, a voltage value of the voltage pre-charge operates as the voltage stored in the storing instrument 337.

Figure 34:
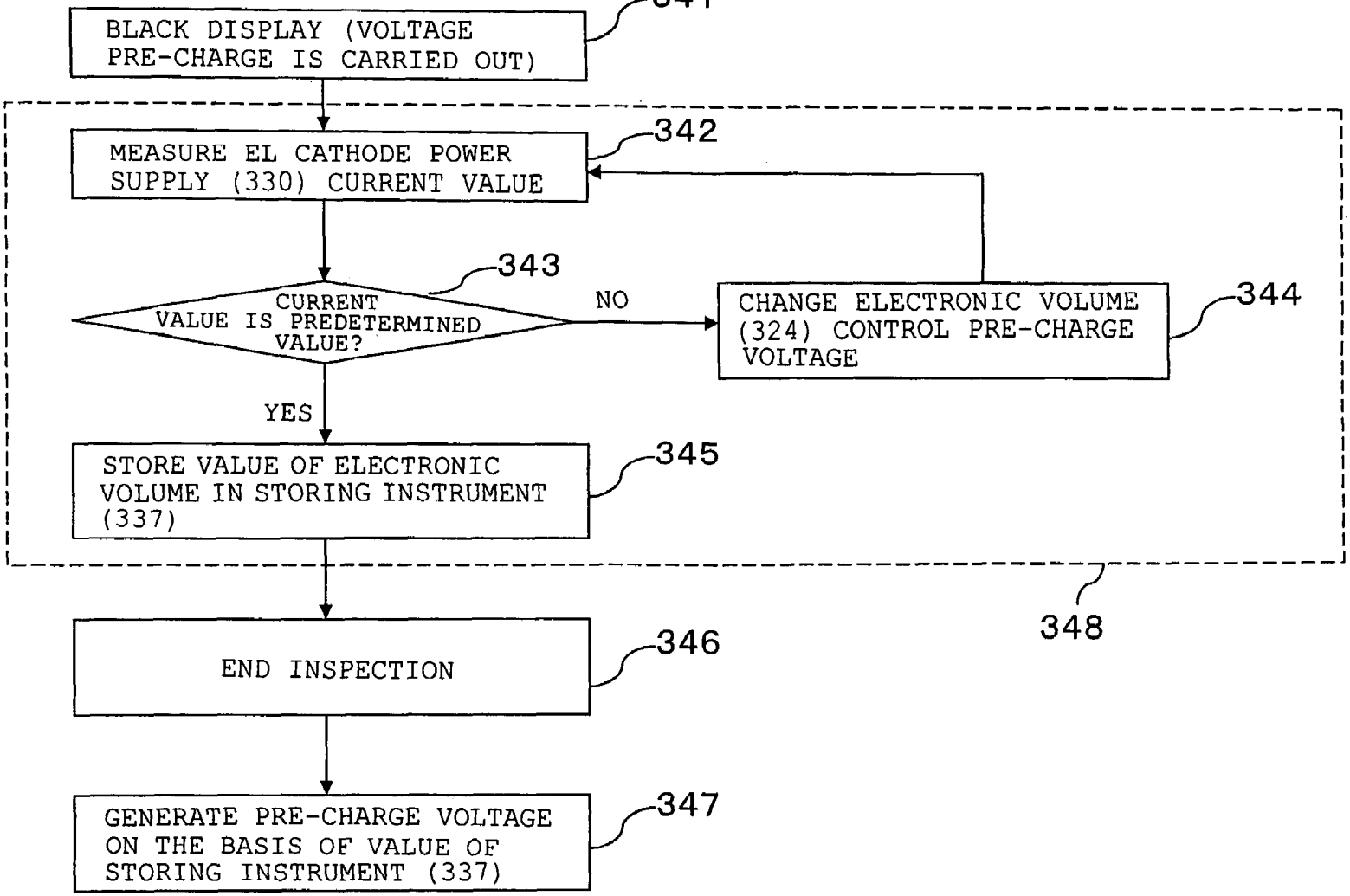
FIG. 34 is a diagram showing an adjusting method at the time of black adjustment.

An adjustment method at the time of black adjustment is shown in FIG. 34. The voltage pre-charge is carried out to perform black display (341). Subsequently, a current value of the EL cathode power supply 330 is measured. It is judged whether the current value is within a predetermined range. If the current value is outside the range, a value of the electronic volume for voltage pre-charge 324 is changed to measure an EL cathode current again such that the current value is within the range. This is repeated until the current value comes into the range.

When the current value is within the predetermined range, an electronic volume value at this point is written in the storing instrument 337. This is the end of the adjustment. Finally, it is checked whether the value written in the storing instrument is correct and the inspection is completed. After that, a pre-charge voltage based on the value in the storing instrument 337 is generated. Consequently, a display device with less black luminance fluctuation among panels is realized.

Figure 35:
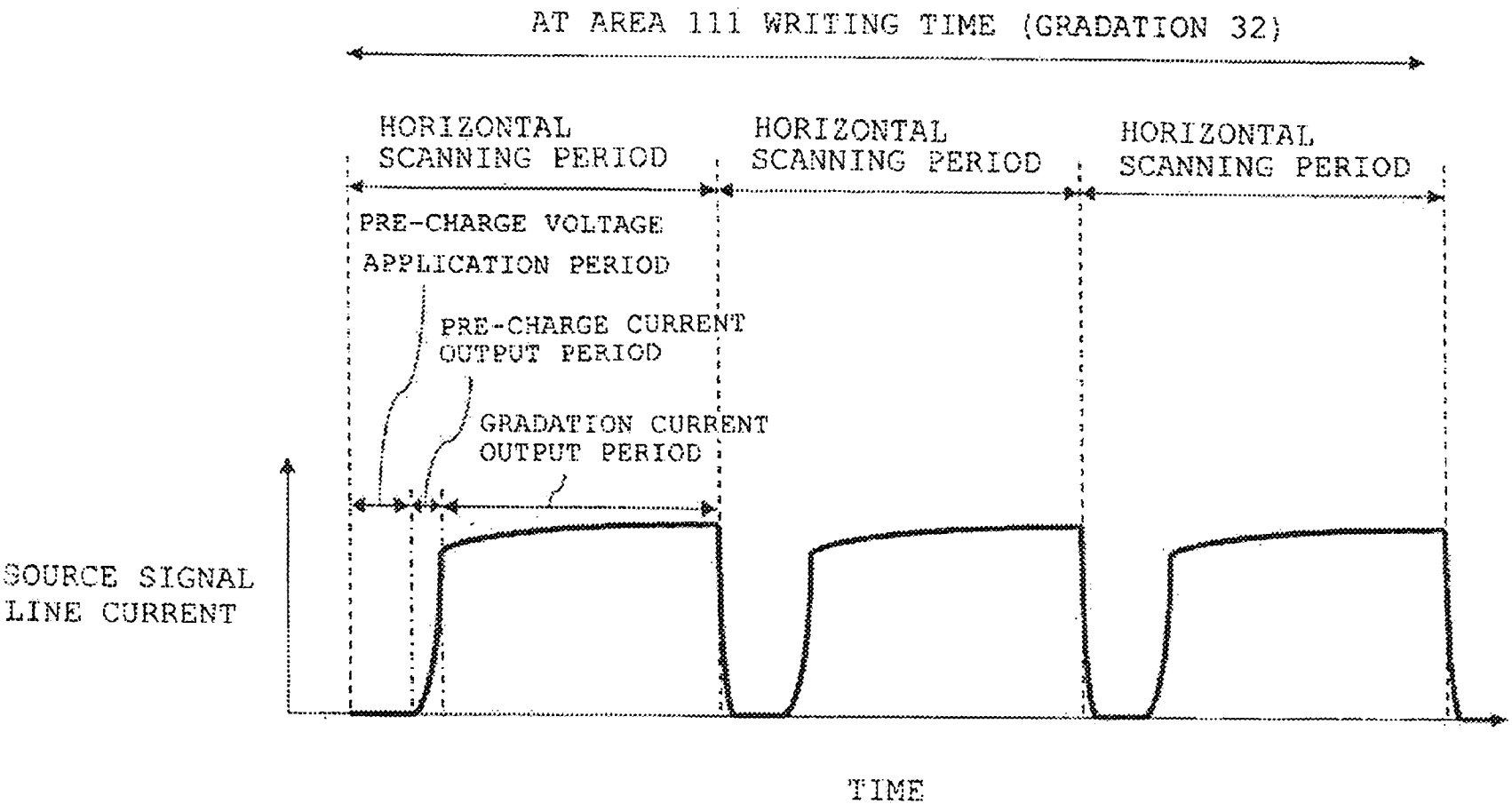
FIG. 35 is a diagram showing a temporal change in a source signal line current.

The display without insufficiency of writing is realized by carrying out the current pre-charge and the voltage pre-charge. However, when fixed luminance is displayed over plural rows, since the pre-charge is carried out every time, a change in a signal line potential may be more intense than that before the pre-charge is carried out. For example, the change may occur when the gradation 32 is displayed in the 111 area shown in FIG. 11. A state of a change in a signal line current is shown in FIG. 35. A current greatly changes to 0 once at the start of each horizontal scanning period. On the other hand, in the conventional method without the pre-charge, there is a problem in that a predetermined current is not obtained among several rows after a change on an area. However, in the case of an identical gradation in plural rows, a constant current is always fed and display with a less current change is realized. Thus, in an operation of this method, it is easier to write a current.

Figure 36:
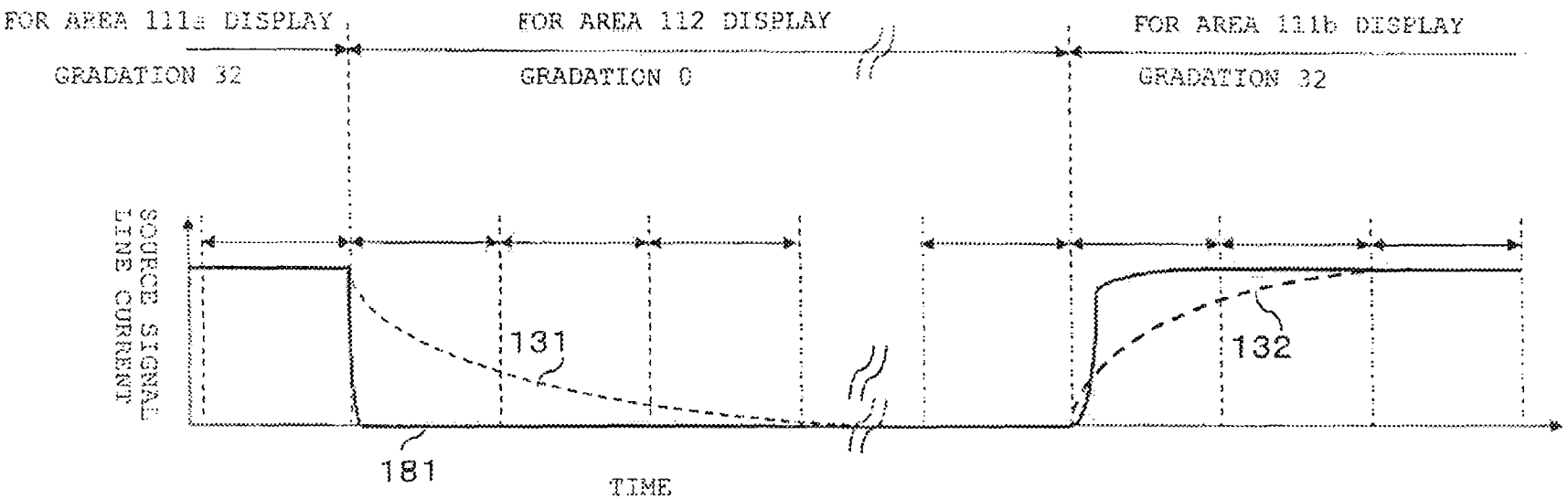
FIG. 36 is a diagram showing a temporal change in a source signal line current.

Thus, a method of judging whether the pre-charge should be performed according to a state of a row immediately preceding a relevant row is devised. This is a method of performing the pre-charge at points of change from the area 111 to the area 112 and from the area 112 to the area 111 but not performing the pre-charge in the area 111 and the area 112 in which there is no gradation change. This is processing for judging that the pre-charge is not carried out when a current can be written without the necessity of the pre-charge. Length of the pre-charge is determined according to a relevant gradation as in the past. Consequently, as shown in FIG. 36, it is possible to properly display a portion with a large current change. Moreover, it is possible to reduce a current change by stopping the pre-charge in a portion where a current change is small. A display panel with an improved display quality is realized.

A method of determining judgment criteria for judging whether the pre-charge should be performed will be explained. The judgment depends upon whether it is possible to change display to a predetermined state without the pre-charge. The pre-charge is performed when the display cannot be changed.

Whether writing is possible or not depends upon a display gradation (a writing current) and an amount of change from the immediately preceding row (a potential difference)

Figure 38:
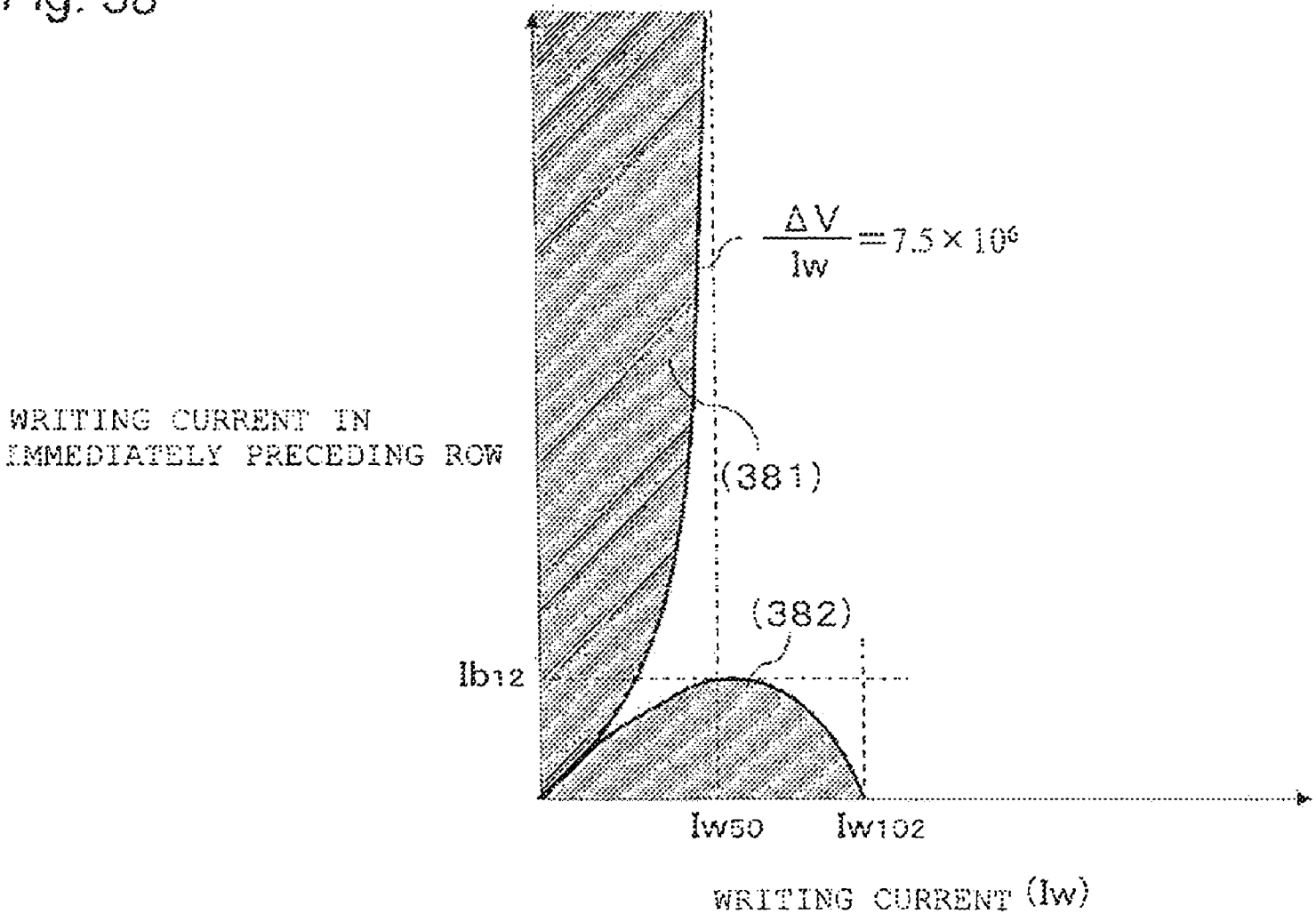
FIG. 38 is a diagram showing a correspondence relation between a writing current in an immediately preceding row and a writing current in the case in which 255 gradations are a current of 1 μA and a capacitance of a source signal line is 10 pF at the number of pixels of QCIF+.

A relation between a combination of a writing current in the immediately preceding row and a writing current in a display row and areas (381 and 382) where a current cannot be written without the pre-charge is shown in FIG. 38. A boundary line of the areas 381 and 382 is a line represented by $\Delta V \times C = Iw \times T$ (C is a stray capacitance of 10 pF, Iw is a writing current, and T is a horizontal scanning period of 75 microseconds). The areas 381 and 382 indicate areas where $\Delta V \times C / Iw > 75$ microseconds and a writing current cannot change (a current cannot be written) within the horizontal scanning period.

Thus, the judgment on whether the pre-charge should be performed only has to be carried out at the time of a combination of the immediately preceding row and the relevant row in the areas of 381 and 382. In this case, since a multiplication is included in the judgment, a judgment logic has a large circuit size.

Therefore, in the present invention, in order to eliminate the multiplication, it is judged whether the pre-charge should be performed depending on gradation of the relevant row is above or below a fixed value or gradation of the immediately preceding row is above or below the fixed value such that the areas 381 and 382 are not reduced.

FIG. 38 is an example in the case in which 255 gradations are a current of 1 μA, the number of pixels is QCIF+, and a source line capacitance is 10 pF. The pre-charge only has to be performed when a writing current is less than 103 gradations (Iw 103) and a current in the immediately preceding row is less than 12 gradations (Ib 12) and when a writing current is less than 50 gradations (Iw 50). However, if gradation in the immediately preceding row and gradation in the relevant row are identical, it is possible to write a current value regardless of the current value. Thus, judgment that the pre-charge is not performed when the gradations are identical is added.

Figure 37:
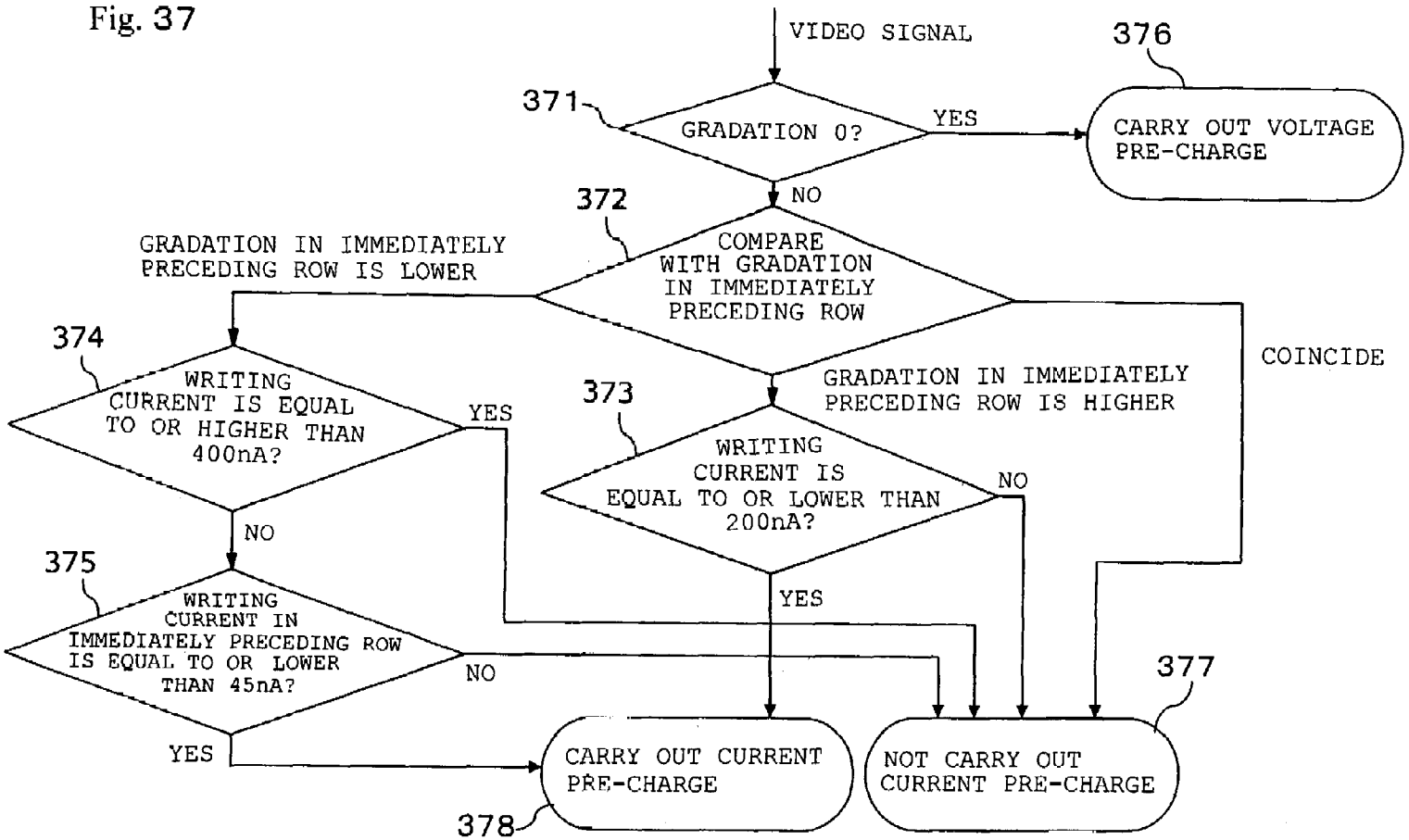
FIG. 37 is a flowchart showing a method of judging whether pre-charge should be preformed.

A judgment section method for carrying out this judgment is shown in FIG. 37.

First, it is judged whether gradation to be displayed is 0 (371). When the gradation is 0, the voltage pre-charge is performed. Even if the gradation 0 continues for plural rows, since a pre-charge voltage value is a potential at the time of the gradation 0, the problem of increasing potential fluctuation shown in FIG. 35 caused by performing the pre-charge every time does not occur. Thus, the pre-charge is performed every time.

When the gradation is not 0, subsequently, the gradation is compared with gradation data in the immediately preceding row (372). In order to carry out the comparison, a circuit for storing data for one row is required as a RAM, a latch circuit, or the like.

When the gradation is compared with the gradation data in the immediately preceding row and coincides with the gradation data, it is possible to perform writing regardless of a display gradation (a writing current) (This is because a potential of the source signal line does not change.) Therefore, in this case, the current pre-charge is not carried out.

If the gradation in the immediately preceding row is larger, taking into account the area 381 in FIG. 38, the current pre-charge is carried out when a current to be written is equal to or lower than 200 nA equivalent to gradation 50. The pre-charge is carried out in an area larger than the area 381. However, priority is given to prevention of image quality deterioration due to insufficiency of writing. The judgment is performed in this way taking into account convenience of processing. When the current is larger than 200 nA, it is possible to change a source signal line potential to a predetermined current value without the pre-charge using a writing current. Thus, the current pre-charge is not performed.

When the gradation in the immediately preceding row is lower, the area 382 in which writing by a gradation current is impossible is taken into account. First, when the writing current is equal to or larger than 400 nA equivalent to gradation 103, writing is possible without the pre-charge regardless of the writing current in the immediately preceding row. Thus, it is judged in judgment 374 that the pre-charge is not performed.

In gradation 102 or lower gradations, writing is possible or impossible depending upon the writing current in the immediately preceding row. Thus, when the current in the immediately preceding row is equal to or lower than 45 nA equivalent to gradation 12 in a judging section 375, the pre-charge is carried out.

Consequently, a combination for carrying out the pre-charge is determined in a form including the area 382 in which writing cannot be performed without the pre-charge. This makes it possible to select ON and OFF of the pre-charge as required.

Figure 39:
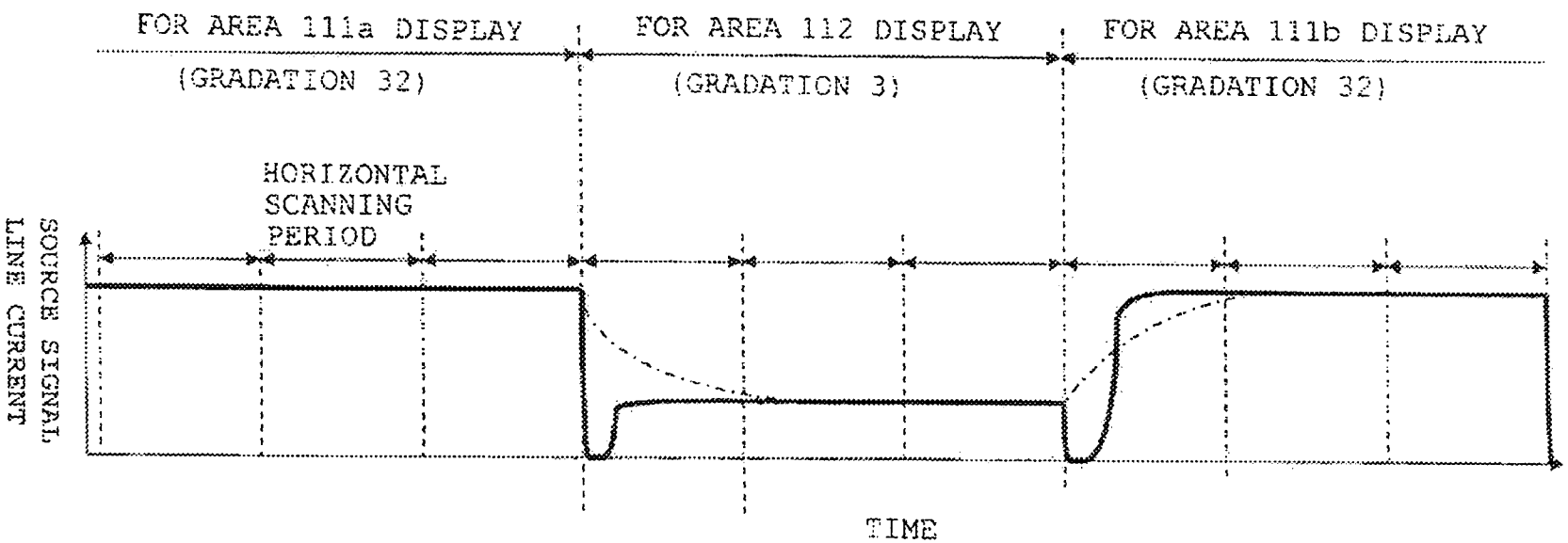
FIG. 39 is a diagram showing a temporal change in a source signal line current at the time of judgment processing in FIG. 37.

A state of a source signal line current change in the case in which the judgment processing in FIG. 37 is included is shown in FIG. 39. Compared with the circuit structure without the pre-charge (indicating the case in which the area 111 has the gradation 32 and the area 112 has the gradation 3 in FIG. 11), speed at the time of a change in a current is improved and gradation display can be properly realized in a border row of areas.

Figure 40:
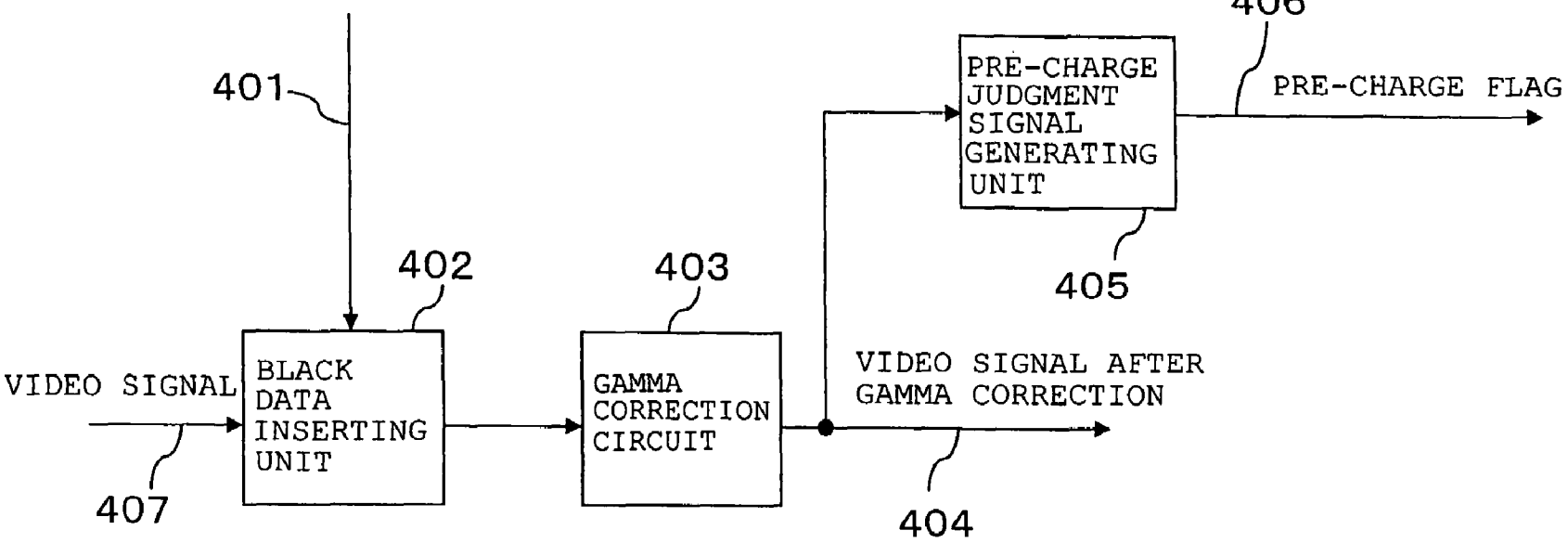
FIG. 40 is a diagram showing a circuit structure for inserting gradation 0 in a video signal in a vertical blanking period and outputting a specific signal in a pre-charge judgment signal generating unit.

A circuit for judging that an optimum pre-charge pulse is selected or pre-charged is not performed depending on gradation needs to carry out, according to a data enable signal 401, pre-charge judgment for a video signal 407 transmitted from the outside of a display panel on the basis of data which passes through a black data inserting unit 402 which outputs black data regardless of an input in the vertical blanking period and is transmitted to a source driver by an output of a gamma correction circuit 403 which performs gamma correction. Therefore, a structure shown in FIG. 40 is adopted. The pre-charge judgment is performed using a video signal after gamma correction 404. The video signal 404 is transmitted to the source driver as a pre-charge flag 406 in synchronization with this data. The pre-charge flag 406 is transmitted in a relation shown in FIG. 41 in association with FIG. 26 such that the pre-charge flag 406 does not contradict with the pulse selecting unit 252 on the source driver side.

In processing for the first row, there is no video signal to be compared in a comparing section with data in the immediately preceding row. However, since the black data inserting unit 402 for inserting black data in the vertical blanking period is added this time, gradation is always black gradation for which the voltage pre-charge is carried out before the first row. Data transmitted at timing of the immediately preceding row is always stored in a storing instrument to be comparison data. This data is also held and, when the pre-charge for the first row is judged, it is automatically judged that the pre-charge at the time when the gradation 0 display is in the immediately preceding row should be performed. Thus, it is possible to perform the processing for the first row in the same manner as that for the second and subsequent rows.

Figure 42:
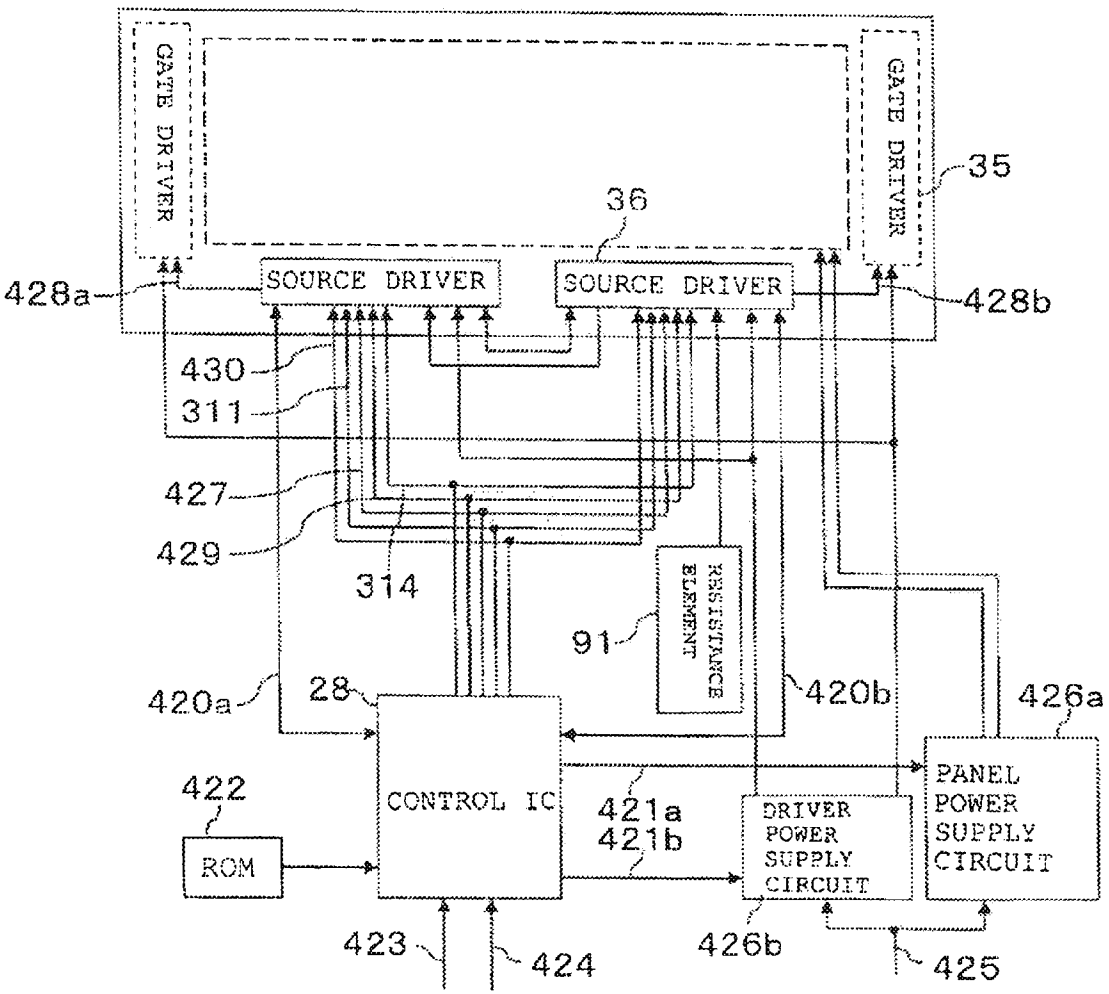
Figure 43:
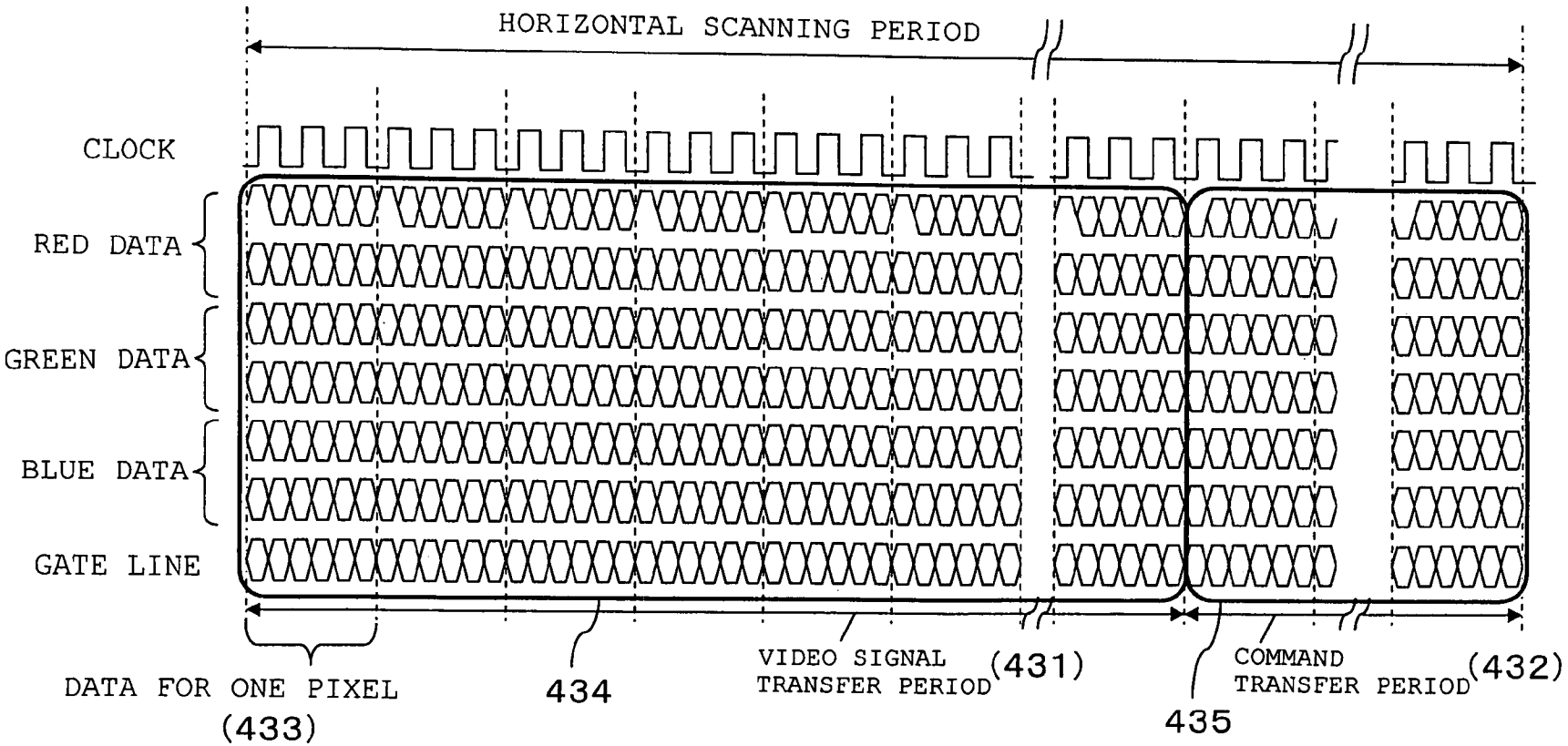
FIG. 43 is a method of serially transferring data for one pixel at a clock frequency N times as large as the data.

It is unnecessary to judge a pulse width of the pre-charge pulse 256 for each video signal. The pulse width is a fixed value in an identical panel. Thus, the pre-charge pulse 256 is separately transmitted to the source driver according to command setting or the like. A pre-charge flag is required in synchronization with the video signal. Moreover, there are a large number of commands such as a command for setting a charge pulse and a command for setting a pre-charge voltage value. Thus, in the case of a module in which a controller and a driver are constituted by separate chips (FIG. 42), it is assumed that the number of control signal lines between the two ICs increases to make external wiring complicated. Thus, for example, there is a method of reducing external signal lines by a method of serially transferring data necessary for one pixel by multiplying the data by a clock frequency N as shown in FIG. 43 and a method of setting various commands in signal lines identical with video signal input lines using a horizontal blanking period (432). The ROM 422 is present for storing different setting for each panel. The ROM 422 stores electronic volume values of pre-charge voltages and reference current electronic volume values of respective colors.

Figure 44:
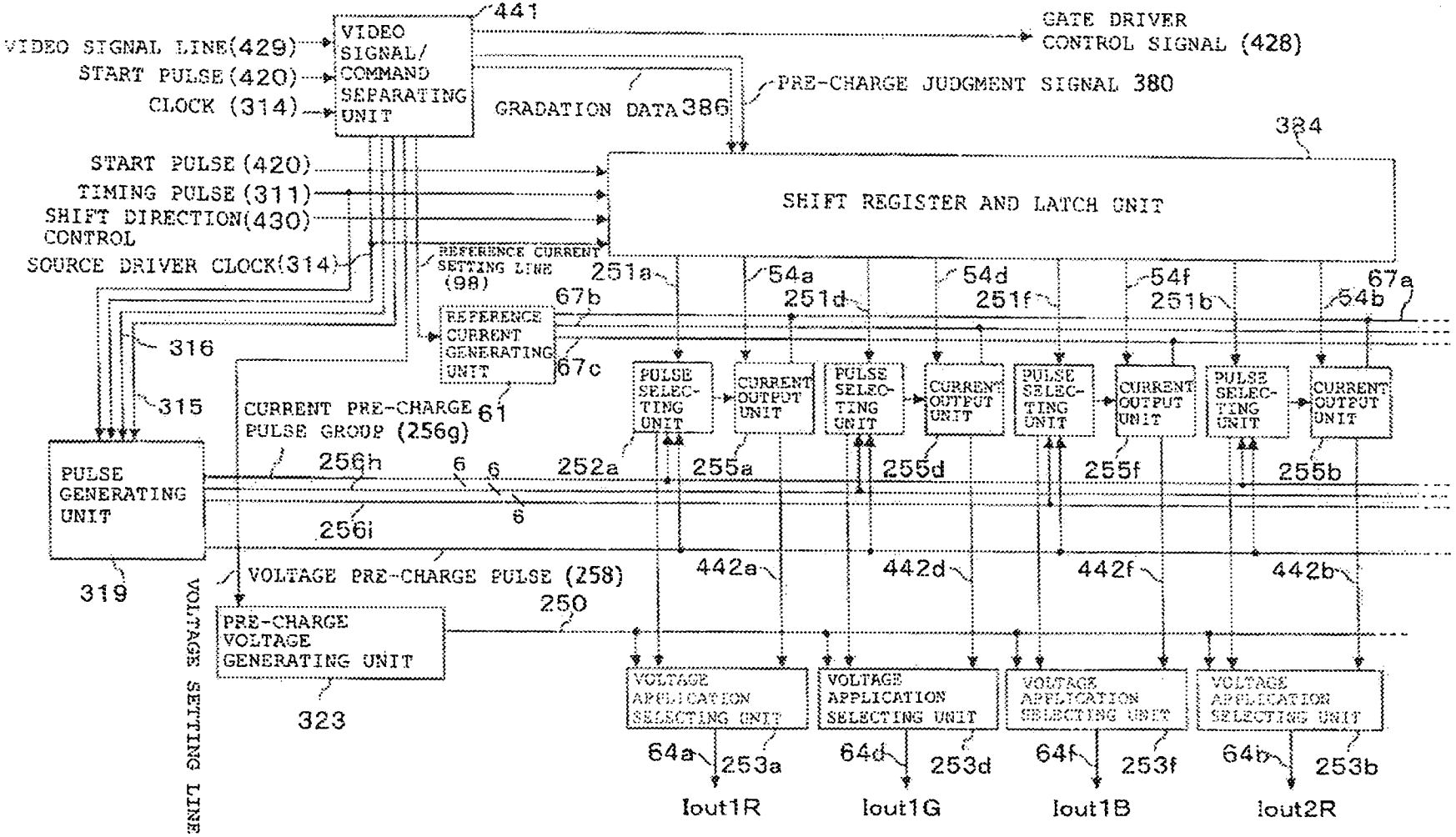
FIG. 44 is a diagram showing a circuit structure of a source driver which carries out the current pre-charge and the voltage pre-charge.

A circuit structure of a source driver capable of carrying out the current pre-charge and the voltage pre-charge is shown in FIG. 44. In this example, as shown in FIG. 43, a video signal 434 and a command 435 are transmitted on an identical line (a video signal line 429). Video signal line data is separated, into commands (315, 316, 98, and 502), gradation data 386, a pre-charge judgment signal 380, and a gate driver control signal 428 by a video signal/command separating unit.

Six kinds of current pre-charge pulses 256 are generated by a pulse generating unit 319, generate six pulses of each color, and are inputted to the pulse selecting unit 252. A current output unit 255 outputs current on the basis of the gradation data 54 and current setting per one gradation generated by the reference current generating unit 61. According to an operation of the pulse selecting unit 252 at this point, a period in which a maximum gradation is outputted according to a pulse width of a current pre-charge pulse is formed (the current pre-charge). In the final stage, the voltage application selecting unit determines judgment on whether the voltage pre-charge should be carried out. The judgment is determined according to an output of the pulse selecting unit. A voltage to be outputted is a voltage determined by the pre-charge voltage generating unit. Consequently, a source driver capable of performing the current pre-charge and the voltage pre-charge is realized.

In the above explanation, there are six kinds of current pre-charge pulses. However, depending upon efficiency of an organic luminous element, a current value per one gradation further decreases. In the relation between gradation and a pre-charge pulse shown in FIG. 28, plural gradations cannot be shared by an identical pre-charge pulse. Thus, the necessary number of pulses increases. For example, when the current value is halved, current values of the gradations 16 and 102 in the past decrease to current values equivalent to the gradations 8 and 51. Different current pre-charge pulses are selected in the gradations 8 and 51. In this case, three kinds of pre-charge pulses are selected. In other words, the necessary number of pre-charge pulses increases. Therefore, it is possible that the number of current pre-charge pulses is larger than six.

In this case, the number of current pre-charge pulse groups 256 is increased. Consequently, the number of selections for the operation of the pulse selecting unit 252 also increases. Therefore, it is necessary to increase the number of bits of the pre-charge judging line 251 to cope with the increase in the number of selections.

Concerning the relation in FIG. 28, even if a current is halved, it is possible to cope with the current by allocating gradations in a range of the increased number of pre-charge pulses.

For example, when sixteen kinds of pre-charge pulses are necessary, the pre-charge judging line 251 has 5 bits. For the allocation of gradations, a method of preparing a separate pre-charge pulse for each gradation on a low gradation side and sharing plural gradations for a higher gradation is used.

If kinds of pre-charge pulses necessary for solving insufficiency of writing are prepared, it is possible to obtain the same effects as those explained above. It is also possible to prepare kinds of pre-charge pulses by an arbitrary number (to put it in an extreme way, the number of gradations −1).

Figure 5:
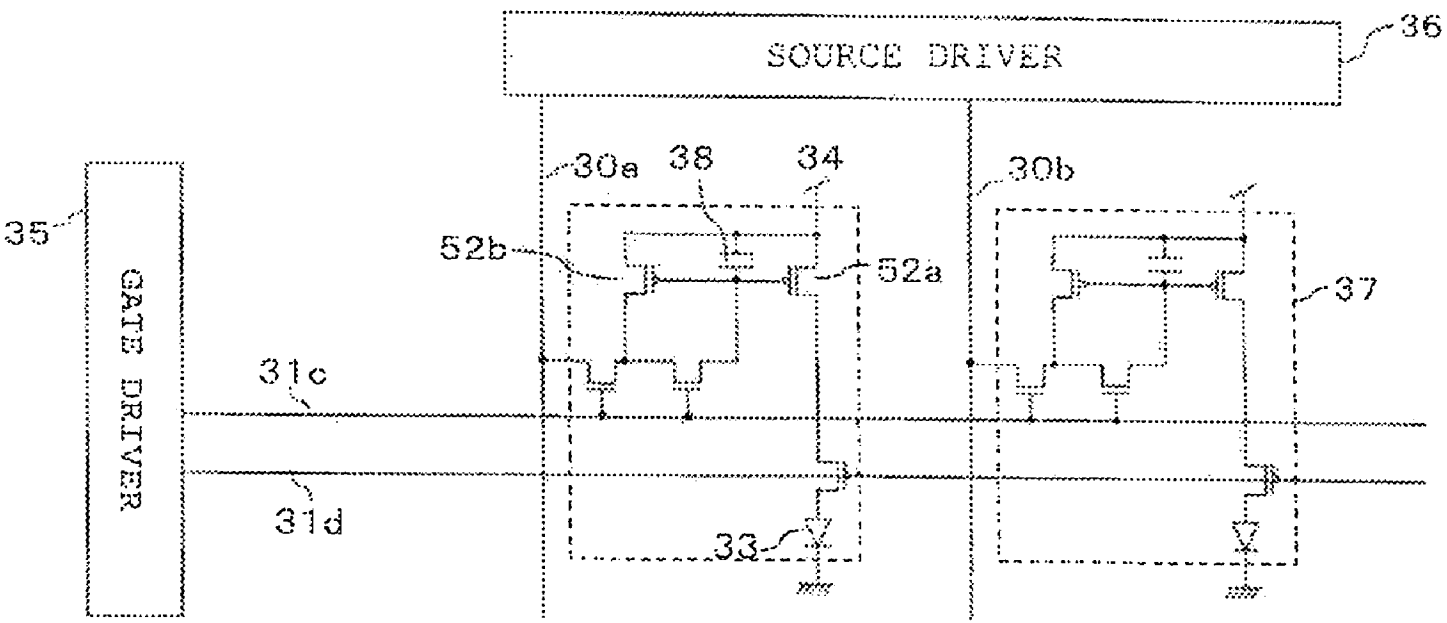
FIG. 5 is a diagram showing a circuit structure of a current mirror.
Figure 6:
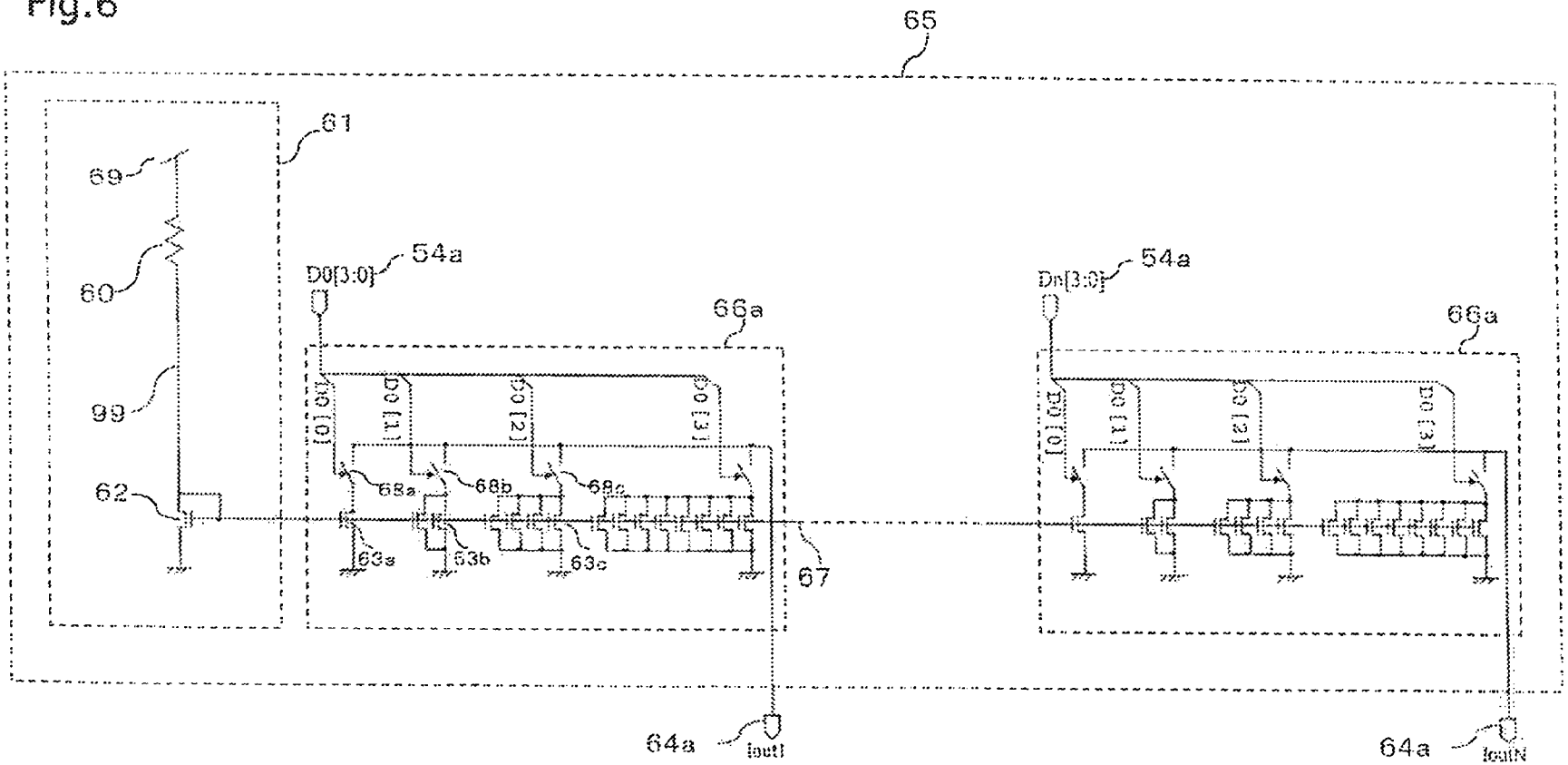
FIG. 6 is a diagram showing a circuit for outputting currents to respective outputs of the conventional current output type driver.

It is possible to implement the source driver used in the explanation of the present invention not only in the current copier circuit structure in FIG. 3 but also in the current mirror circuit structure shown in FIG. 5. This is because the operation for changing a gate potential of the driving transistor 52 (i.e., a source signal line potential) according to a micro-current and writing the gate potential is the same.

The display device using self-luminous elements which implements the voltage pre-charge and the current pre-charge described in the basic application (Japanese Patent Application No. 2005-56494) has been described.

However, it is the object of the present invention to realize a display device which has a small circuit size and uses low-cost self-luminous elements and a driving method without reducing the number of horizontal scan lines of the display device.

Thus, the number of output stages is reduced and a chip area is reduced to realize a reduction in cost by outputting outputs to source signal lines for two or three colors from one output in a time division manner. Details will be described below.

As described above, in the display device using an organic luminous element, depending upon a combination of luminous efficiency and chromaticity of each luminescent color, a current value per one gradation is different. Therefore, in FIG. 44, the reference current generating unit 61 and the pulse generating unit 319 which generates the current pre-charge pulse 256 are separately required for each color.

Figure 47:
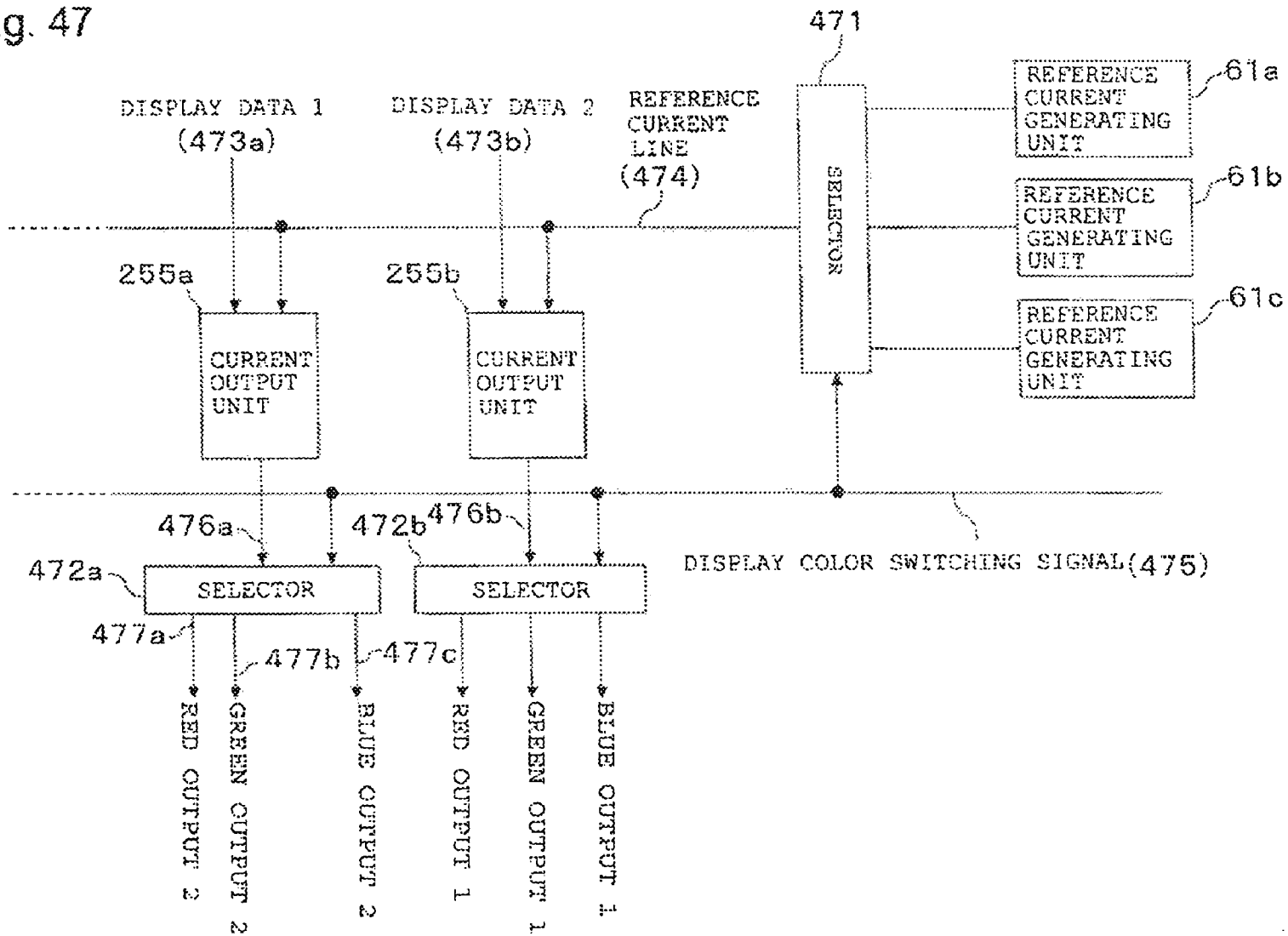
FIG. 47 is a diagram showing a circuit structure for outputting currents from one output in a time division manner.

A circuit structure for outputting outputs to source signal lines for three colors of the present invention for the reference current generating unit from one output in a time division manner is shown in FIG. 47.

FIG. 47 is a diagram showing a circuit structure of a current output unit in the case in which three reference current generating units 61 are connected to one current output unit 255 via a reference current line 474 and a selector 471. The three reference current generating units 61 correspond to three display colors. A display color switching signal 475 changes according to a display color of display data 473. The reference current generating unit 61 corresponding to a display color is outputted to the reference current line 474 according to an operation of the selector 471. Since an optimum reference current is inputted to the current output units 255 according to a display color of the display data 473, it is possible to output a gradation current corresponding to the display color.

A selector 472 is present for distributing an output of the current output unit 255 to a source signal line corresponding to a display color. The selector 472 distributes the output in association with the display color. The selector 472 connects the output of the current output unit 255 to an output of an optimum color according to the display color switching signal 475.

For example, assuming that a reference current generating unit 61*a* is a reference current generating unit for red, a reference current generating unit 61*b* is a reference current generating unit for green, and a reference current generating unit 61*c* is a reference current generating unit for blue, the selector 472 is designed to select a red output 477*a* when the selector 471 selects the reference current generating unit 61*a*. Consequently, a current corresponding to gradation is outputted as the red output according to a reference current for red.

Similarly, when the reference current generating unit 61*b* is selected by the selector 471, the selector 472 selects a green output (477*b*). When the reference current generating unit 61*c* is selected by the selector 471, the selector 472 selects a blue output (477*c*).

It is necessary to switch the selectors 471 and 472 in synchronization with each other. It is also necessary to make it possible to control from the outside which color should be selected. Therefore, the display color switching signal 475 is necessary. The display color switching signal 475 is inputted to the selectors 471 and 472.

For the purpose of reduction in the number of outputs of a driver IC, the selector 472 is often formed on an array substrate between a source driver and a pixel circuit.

The number of current output units 255 present is at least the number obtained by narrowing down the number of source signal lines with the selector 472.

For example, when there are nine hundred sixty source signal lines and the number of selections of the selector 472 is three, three hundred twenty current output units 255 are necessary (however, the total number in all the driver ICs 36 will be necessary when plural driver ICs 36 are used in the display device).

Consequently, six hundred forty current output units could be reduced.

The reference current generating units 61 are provided by the number equivalent to the number of display colors. The reference current generating units 61 are required to cope with a difference of a current value for each display color. In addition, the reference current generating units 61 are required to adjust luminance chromaticity to be within a fixed range according to adjustment of an electronic volume value to cope with EL efficiency fluctuation among panels at the time of white adjustment shown in FIG. 10. The difference of a current value for each display color is corrected mainly with a resistance value of a resistor 91 (in this case, the resistor 91 is often externally attached to the outside of the source driver). The efficiency fluctuation among panels is coped with by separately setting a value of the control data 98 for each panel. In the case of such a use method, one reference current generating unit 61 shown in FIG. 9 is required for each color. Therefore, the selector 471 is inserted between the reference current generating units 61 and the reference current line 474.

In order to perform current output corresponding to plural pixels using one terminal in an identical horizontal scanning period, a horizontal scanning period is divided into periods equivalent to the number of pixels corresponding thereto. In the example in FIG. 47, since the circuit is implemented by three pixels, the horizontal scanning period is divided into three periods. In association with the respective three periods divided, a reference current equivalent to a color corresponding to the display data 473 is supplied to the current output unit 255 by the selector 471. The display data is transmitted in advance at timing when the display data can be serially transferred in a time division manner.

For example, assuming that the reference current generating unit 61*a*, the reference current generating unit 61*b*, and the reference current generating unit 61*c* determine currents per one gradation of red, green, and blue, respectively, the display color switching signal 475 controls the selector 471 according to a display color of a signal of the display data 473. A reference current corresponding to the display color is inputted to the current output unit 255 through the reference current line 474.

The current output unit 255 outputs a current according to a value of display data in response to a current per one gradation determined by a reference current.

Figure 48:
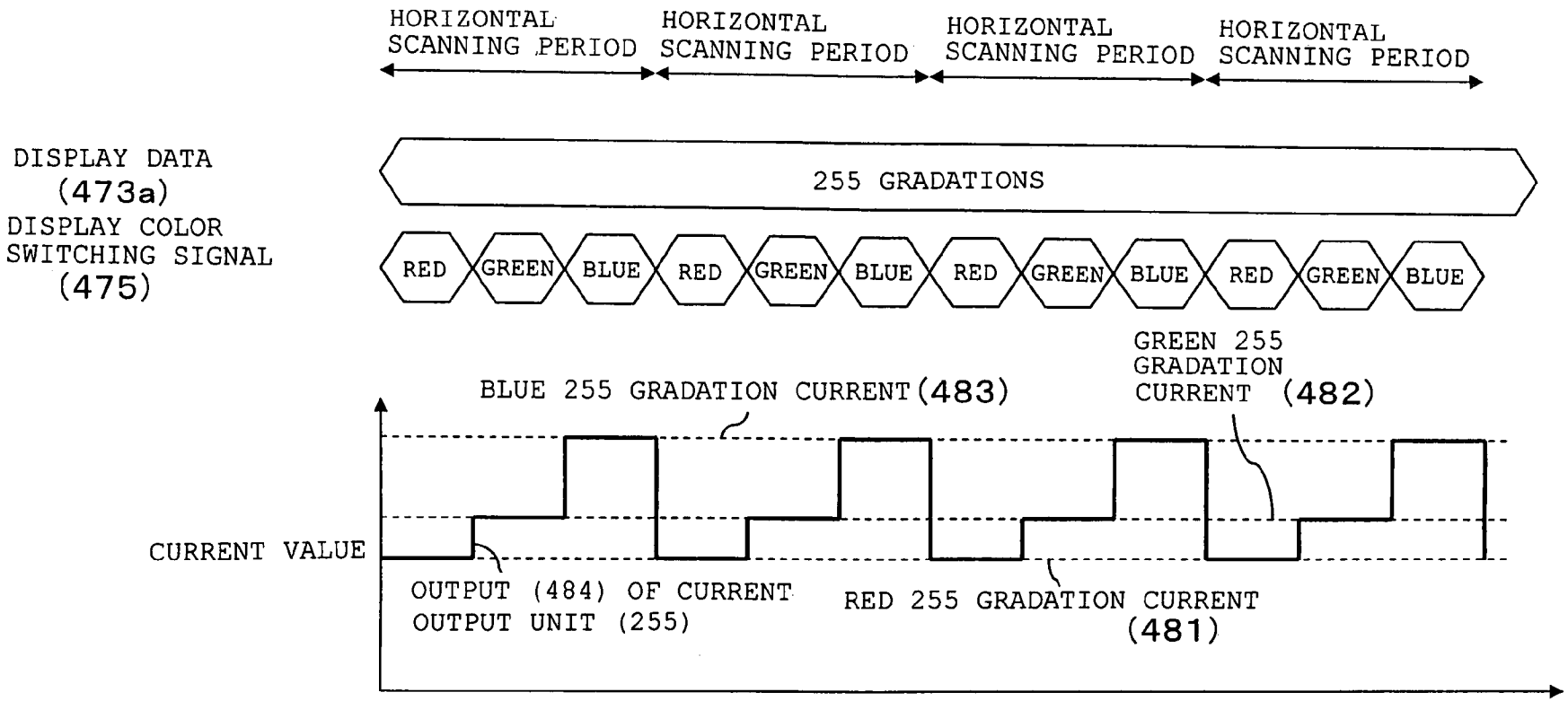
FIG. 48 is a diagram showing a relation among timing of a display color switching signal, an output current, and a horizontal scanning period.

For example, as shown in FIG. 48, assuming that reference current values of red, green, and blue are determined by the reference current generating units 61, currents at the time of 255 gradation display indicated by dotted lines 481 to 483 flow, and all display data have 255 gradations, an output 476 of a certain current output unit 255 changes three times to be outputted in one horizontal scanning period as indicated by a line 484. After the current output 476 is outputted to a circuit forming unit of the display device via the output of the driver IC, the current output 476 is distributed to the respective source signal lines again by the selector 472. At the time of distribution, it is possible to distribute the current output 476 if the display color switching signal 475 used for switching of a reference current is used.

Figure 49:
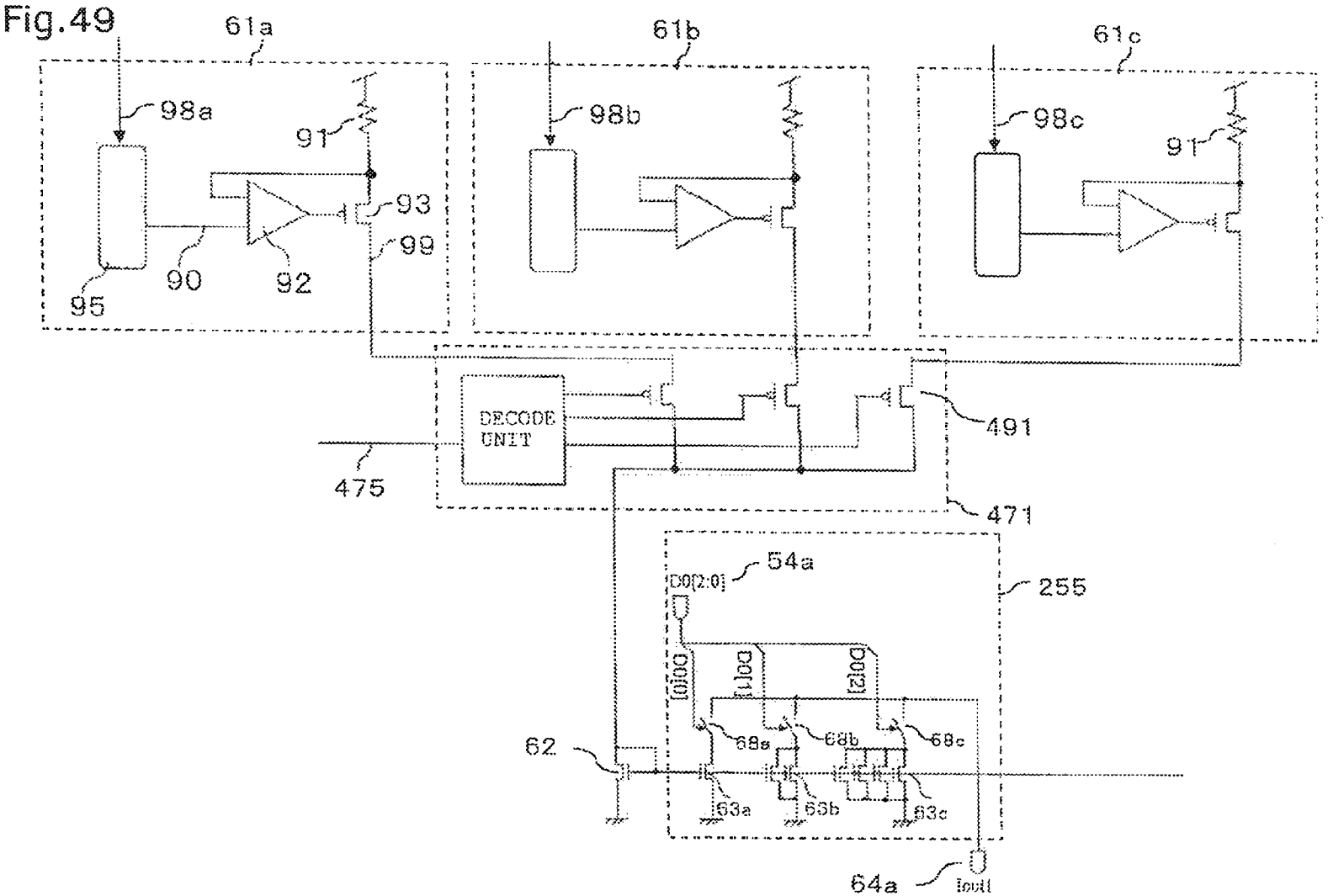
FIG. 49 is a diagram showing an example of a structure of a circuit related to a driver IC.

An example of a structure of a circuit related to the driver IC 36 in FIG. 47 is shown in FIG. 49.

Current values per one gradation for the respective colors are determined by the reference current generating units 61. The selector 471 selects only one current value and supplies the current value to the output unit 255. In this case, In this case, the current value is determined by ON/OFF of a transistor 491. According to this structure, a current flowing to the distributing mirror transistor 62 changes according to a value of the display color switching signal 475. As a result, a current value flowing to the current sources for gradation display 63 also changes. Thus, it is also possible to cope with outputs having different currents per one gradation even if gradation is identical.

Figure 50:
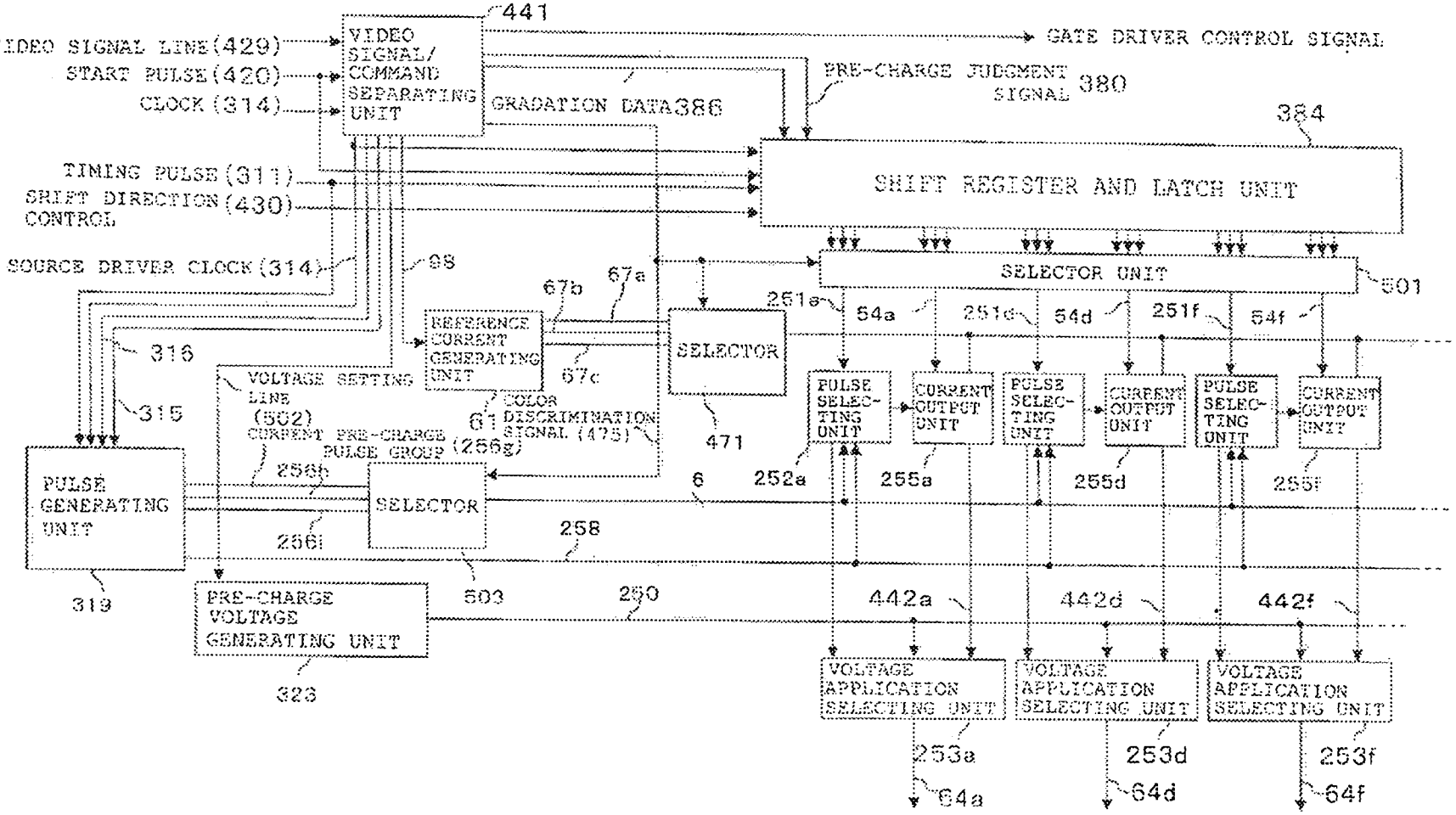
FIG. 50 is a diagram showing a structure of the driver IC.

A structure of the driver IC is shown in FIG. 50. Compared with FIG. 44, the number of pulse selecting units 252, the current output units 255, and the voltage application selecting unit 253 is reduced to one third. On the other hand, selectors 501, 503, and 471 for selecting and transmitting data corresponding to the respective colors in order are provided at the outputs of the latch unit 384, the pulse generating unit 319, and the reference current generating unit 61, respectively. Since the number of circuits deleted is larger than the number of selector units added, an area of the entire chip is reduced, cost is reduced, and a short side direction of the chip is reduced. It is possible to realize a reduction in a frame size.

When a difference of current values of the respective colors is large, this method is used in a variable range of about 1.5 times. Since a stride fluctuating at one stage of the voltage adjusting unit 95 is used in the white adjustment shown in FIG. 10, a function of changing a current at a stride equal to or smaller than 1.4% is required. Thus, if the variable range is increased, the number of adjusting stages inevitably increases and sizes of a switch and a circuit for controlling the switch increase. Therefore, the variable range can only be designed as about two times at the maximum.

The electronic volume is provided for the purpose of correcting efficiency fluctuation of about 10%. Efficiency fluctuation of about 1.5 times is a limit to absorb a difference for each color with a volume value. Therefore, in addition to the electronic volume, a resistance value of the resistor 91 is changed for each color and set.

With this method, although a resistance is externally attached, it is possible to reduce a circuit size of the reference current generating unit 61.

Figure 53:
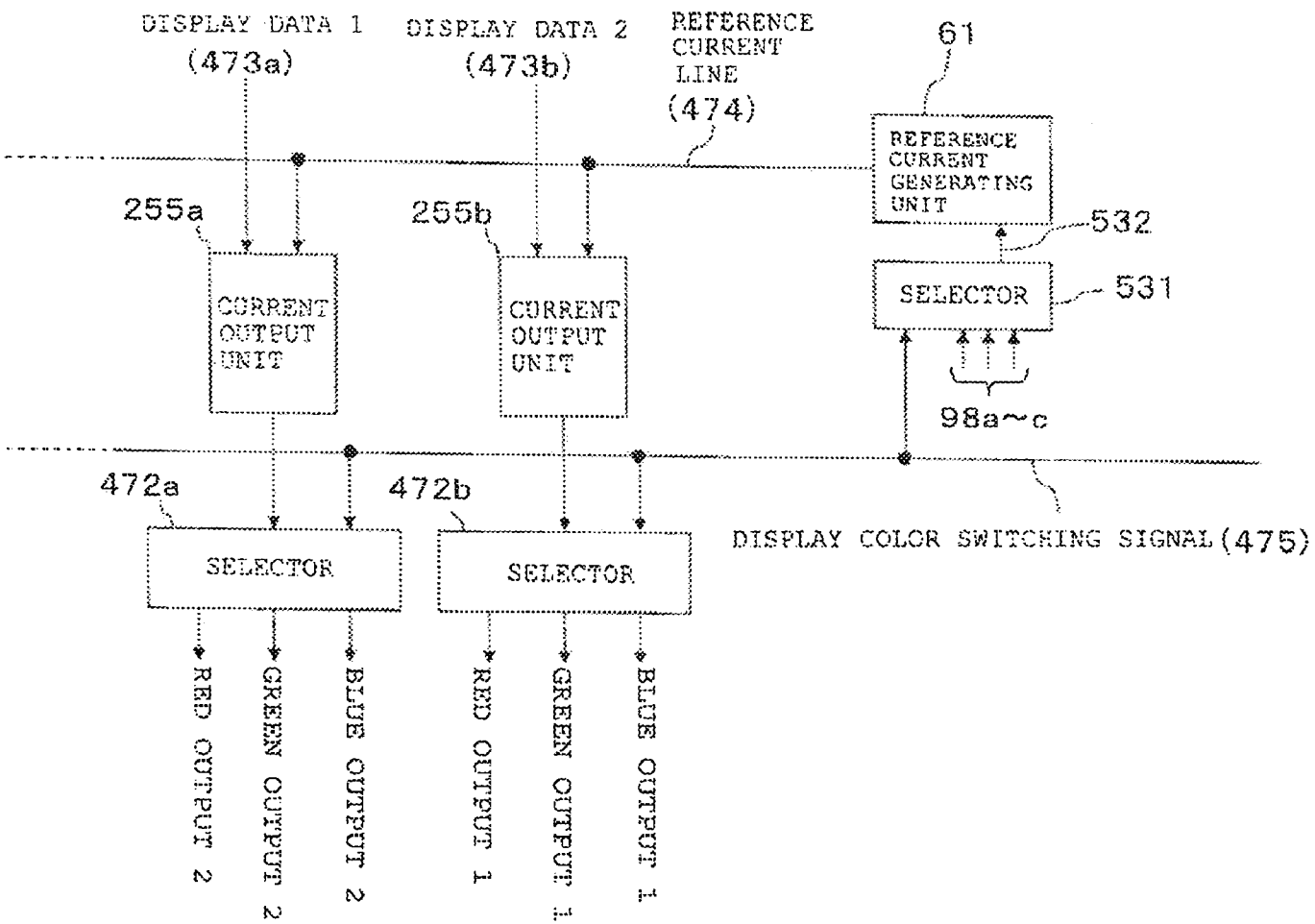
FIG. 53 is a diagram showing a circuit structure for outputting currents from one output in a time division manner.
Figure 54:
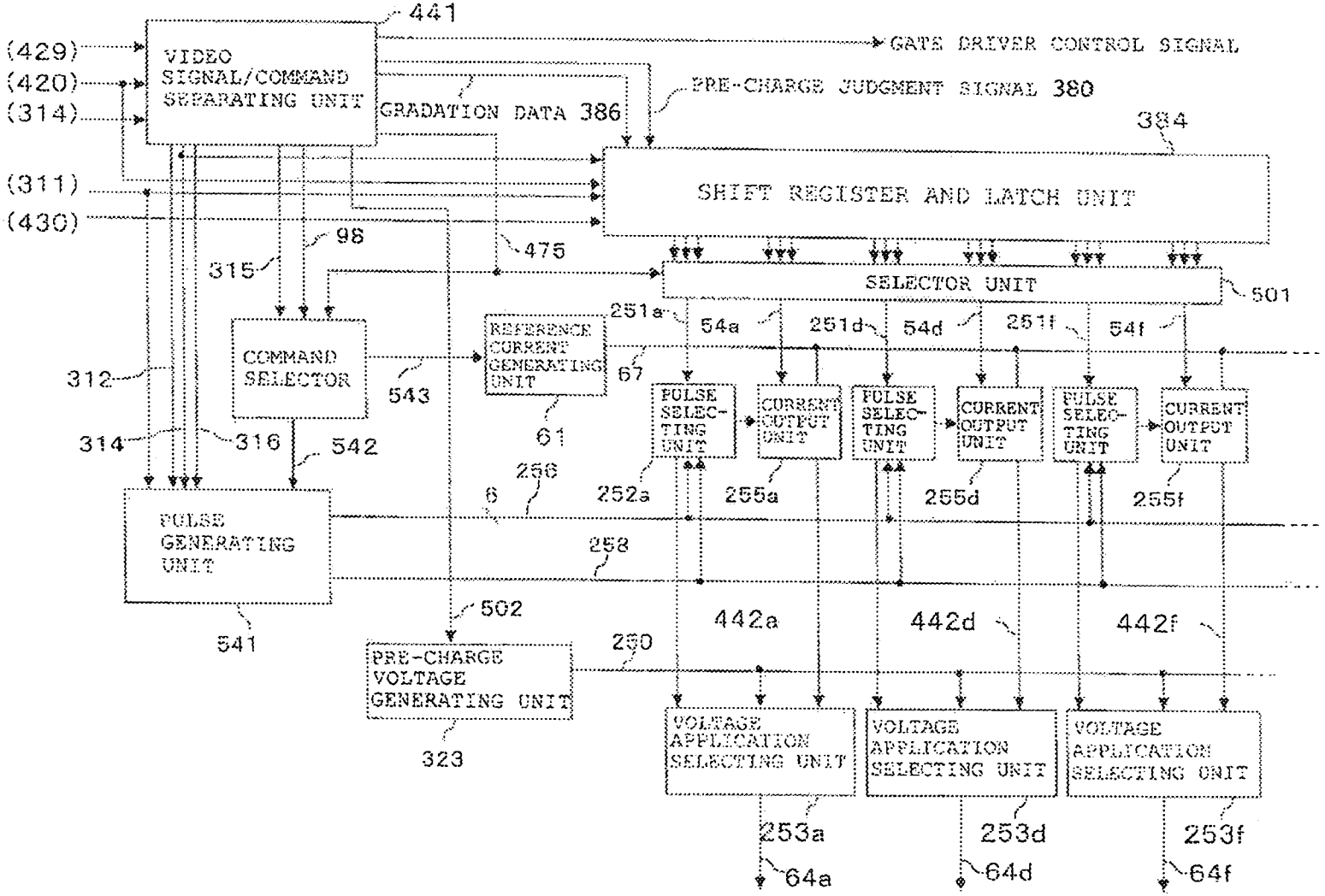
FIG. 54 is a diagram showing a structure of a driver which outputs a current identical with that of an output shown in FIG. 48.

On the other hand, when a difference of current values of the respective colors is small, it is possible to realize all adjustments including the adjustment of efficiency fluctuation among panels by adjusting an electronic volume value. In this case, as shown in FIG. 53, only one reference current generating unit 532 has to be provided. The control data 98 for setting a current value is changed for each display color. Using the selector 531, the control data 98 corresponding to the respective colors are inputted to the reference current generating unit 61 according to timing of the display color switching signal 475. Consequently, since the reference current line 474 is set differently for each display color, a current output identical with the output shown in FIG. 48 is realized. A drive structure in this case is shown in FIG. 54. An inserting position of a selector for outputting a reference current and a pre-charge pulse for each color in a time division manner is different from that in FIG. 50. As an advantage of this circuit, the number of reference current generating units 61 is reduced to one third and only one third of the current pre-charge pulse generating units are required for the pulse generating unit 541, it is possible to further reduce the circuit.

Figure 57:
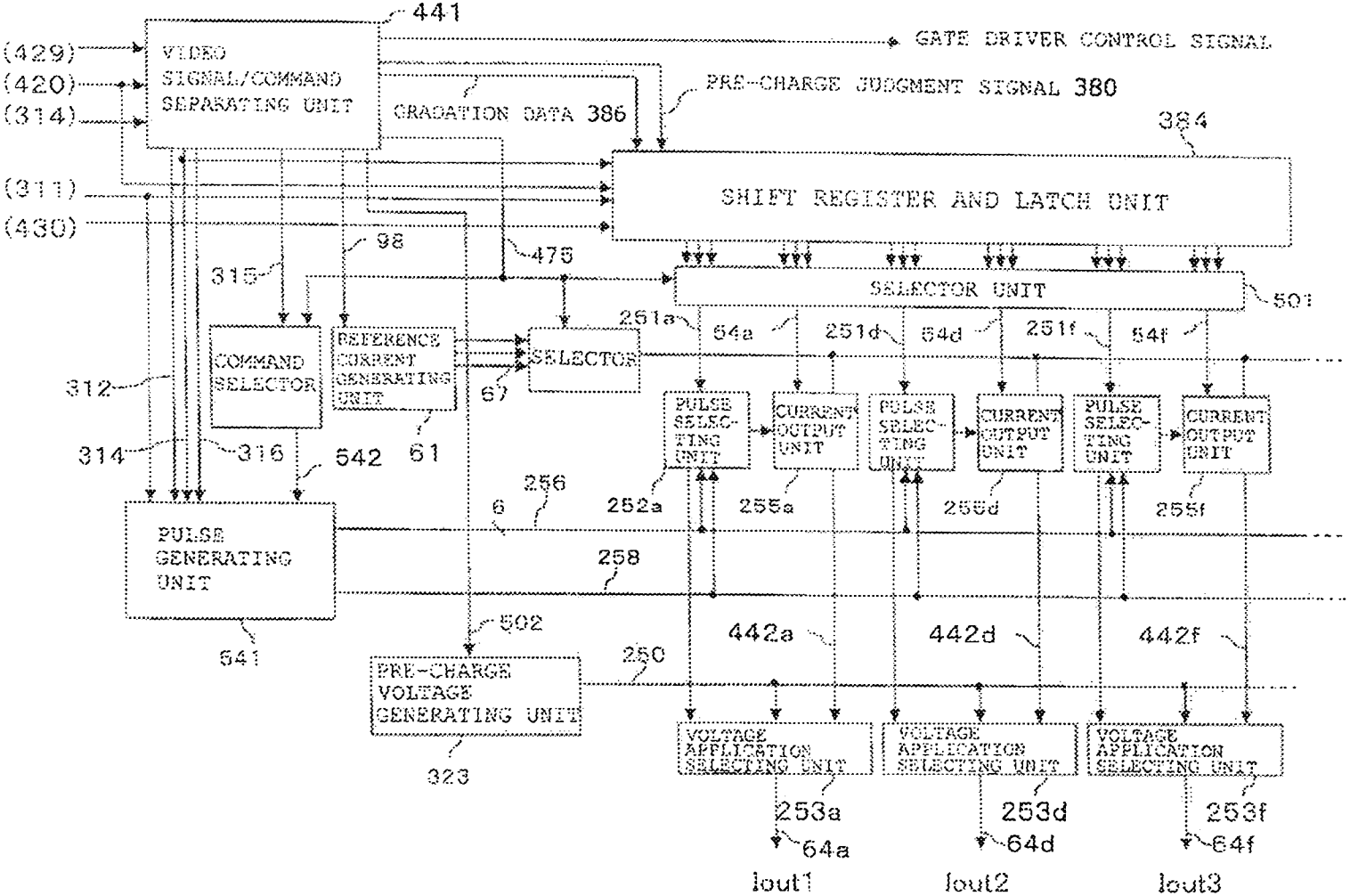
FIG. 57 is a diagram showing a circuit structure for reducing a circuit size of a pre-charge pulse generating unit.
Figure 58:
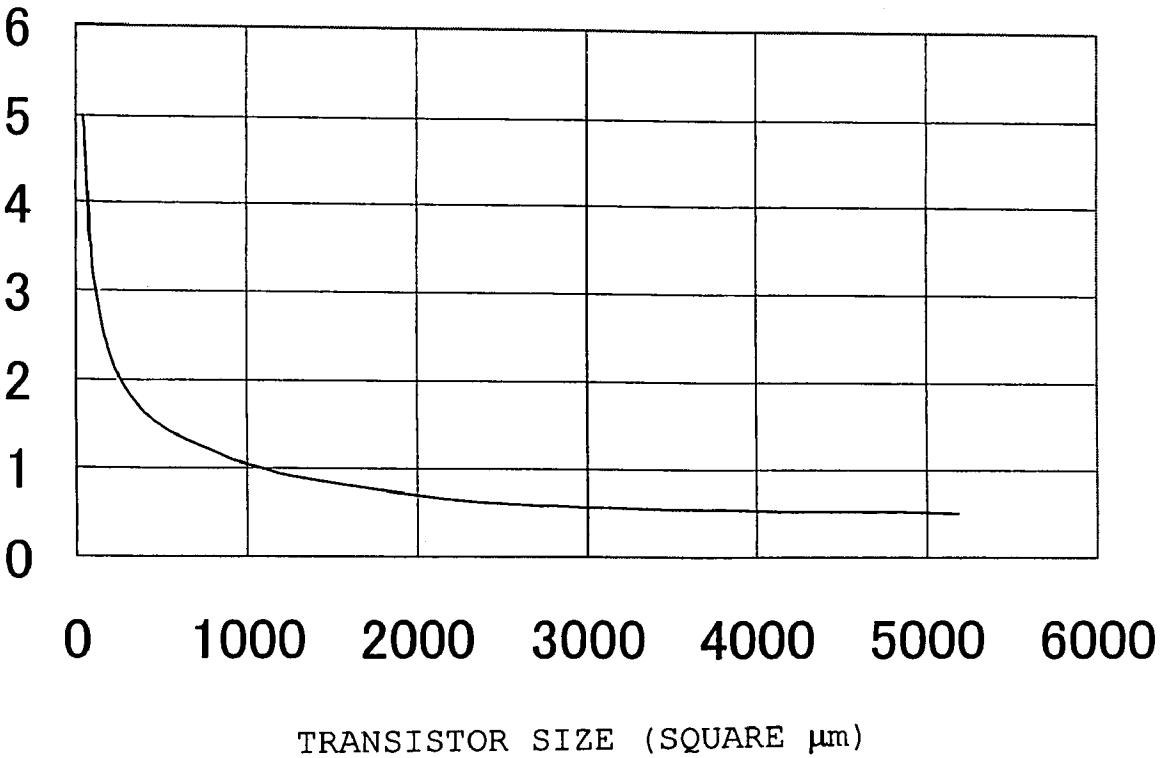
FIG. 58 is a graph showing fluctuation in a size of a transistor and an output current.

Besides, although a difference of currents of the respective colors is larger and three reference current generating units are necessary, there is also a method of using only a pre-charge pulse generating unit in common in order to reduce a circuit size. An example of a circuit structure in this case is shown in FIG. 57.

The selectors 471 and 551 perform switching by connecting the reference current generating unit 61 and the reference current line 474 using analog switches or the like and changing an analog switch to be made conductive according to a switching signal. In that case, in order to quickly supply a reference current of several microamperes to several hundred microamperes, it is preferable that a stray capacitance is as small as possible in a wiring path from the reference current generating unit 61 to the current output unit 255.

Therefore, it is preferable that the switch shown in FIG. 49 is constituted by a switch which has a low capacitance even if an ON resistance is slightly high.

The reference current flows from 99 to the distributing mirror transistor 62 via the transistor 491 in the selector 471. A current per one gradation is determined according to a current mirror ratio of the distributing mirror transistor 62 and the current source for gradation display 63. When the number of current sources for gradation display 63 from which a current is outputted changes depending on an input of gradation data, a current corresponding to gradation flows. The current flowing from 99 to 62 is several hundred microamperes at the maximum. Thus, even if an ON resistance of about 10 kΩ is provided by the transistor 491 in the middle, a voltage drop is about 1 V no matter how large the voltage drop is. If a power supply of the reference current generating unit 61 is equal to or higher than 3 V, a current output stage of the current output unit 255 and the reference current generating unit 61 smoothly operate. Therefore, unlike a voltage output driver, an ON resistance may be high. It is preferable that the switch is designed with priority given to a reduction in a channel width and a reduction in a capacitance.

Figure 51:
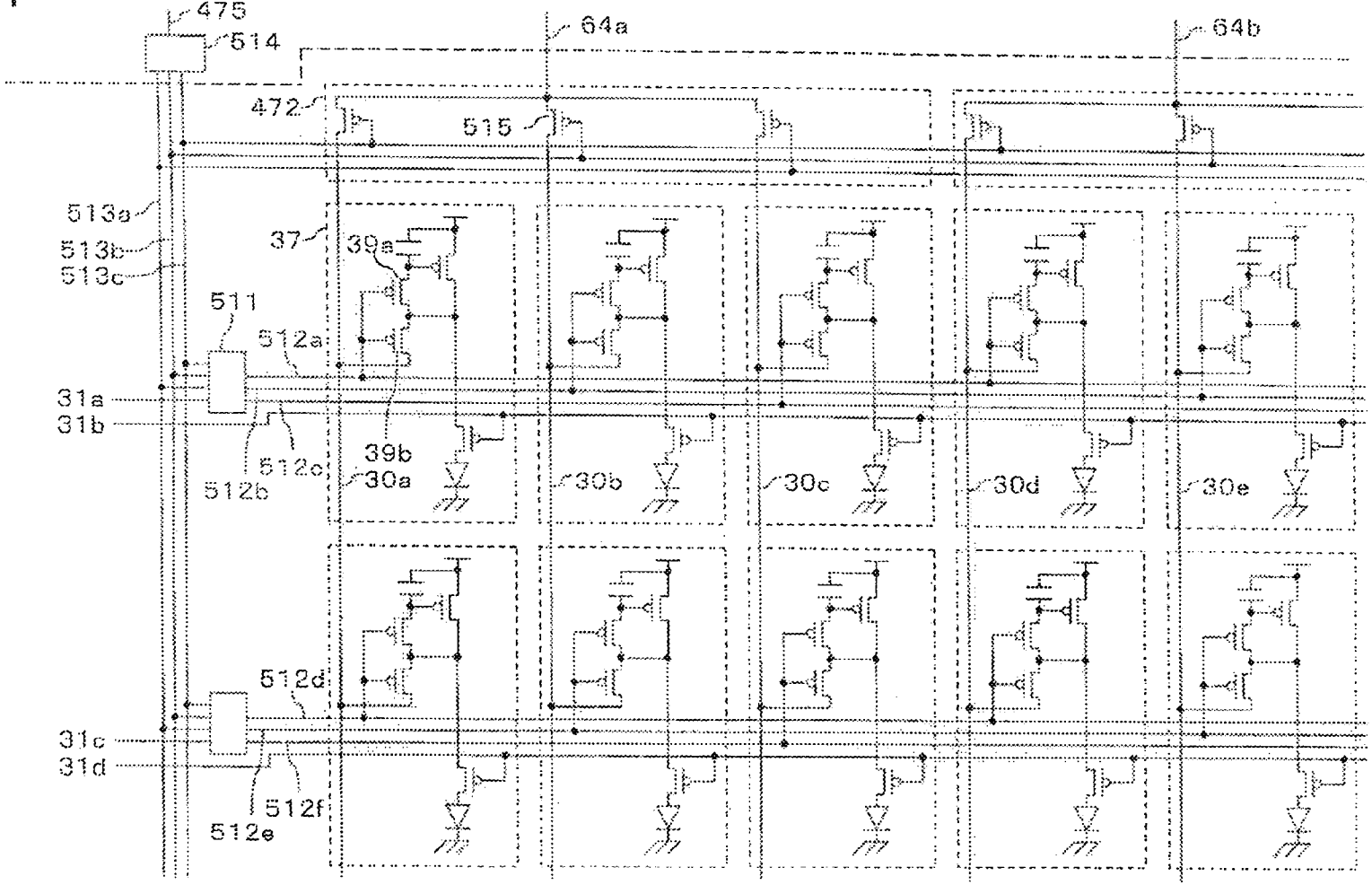
FIG. 51 is a diagram showing a structure of a pixel circuit, a source signal line, and a gate signal line in the case in which display for three colors is performed by one drive output.

A circuit structure on the display device side will be explained. FIG. 51 is a diagram showing a structure of a pixel circuit and source and gate signal lines in the case in which three colors are displayed by one driver output.

Source signal lines for three colors are connected to the output 64 of the source driver via the selector 472. (In this case, 30*a*, 30*b*, and 30*c* are connected to 64*a*.) As a difference from the circuit in the past, a gate signal line for writing a current in a pixel from the source signal line 30 is separately prepared for each display color.

For example, when a current is written in a first line, 39*a* and 39*b* are turned on by a gate signal line 31*a* to feed a current to the inside of the pixel. However, it is necessary to change the output 64 not to be connected to the source signal line 30 at the time when irrelevant two colors are written in the horizontal scanning period. This is a peculiar change for writing a current in the pixel. This is performed because, when all pixels of the three colors are in a writable state, a current value is shunted to the respective pixels and only one third of the current is written with respect to the current output 64.

Circuits for preventing a current from being written in a pixel of a color for which writing is not carried out are the selector 472 and a gate signal enable circuit 511. Both the circuits operate on the basis of a value of the display switching signal 475 in the source driver. The display switching signal 475 is not always controlled according to bits equivalent to the number of colors. Thus, the operation is an operation of 2 bits in the switching of three colors. It is necessary to decode the signal into a signal necessary for turning on and off the respective switches of the selector 472. A decode unit 514 may be implemented in the display device. However, in general, since the driver IC is formed as a circuit by crystal silicon and the display device is formed as a circuit by polysilicon or amorphous silicon, the decode unit 514 is formed in the driver IC judging from a size of the circuit. Consequently, in a decode unit output 513, only a line of a color corresponding to a color of the output 64 is, for example, at an "L" level and other lines are at an "H" level.

This means that the source signal line 30*c* writes a current when 513*a* is at the "L" level, the source signal line 30*b* writes a current when 513*b* is at the "L" level, and the source signal line 30*a* writes a current when 513*c* is at the "L" level (this is an explanation in the case in which a transistor 515 is constituted by a p-type TFT).

In this case, it is necessary to bring only a pixel connected to the respective source lines into a writable state. For example, when the transistors 39*a* and 39*b* are turned on in a state in which a current does not flow to the source signal line 30*a*, a gate potential of the driving transistor 32 changes and an operation for writing a current 0 is performed. The current is held in a capacitor. Consequently, black is written in this pixel. Even if a predetermined current is written in first one third of the horizontal scanning period, since black is written after that, predetermined luminance display cannot be performed. In order to prevent this, at least the transistor 39*a* is required to be turned off. In this case, three gate signal lines, each for each color, for 39*a* and one gate signal line for 39*b* is required. Thus, four gate signal lines are required in total. When the number of gate signal lines increase, an area of a wiring section increases in the pixel and an aperture ratio falls. Thus, in FIG. 51, a gate signal line for 39*a* and 39*b* are used in common to provide a separate signal line for each color.

Figure 52:
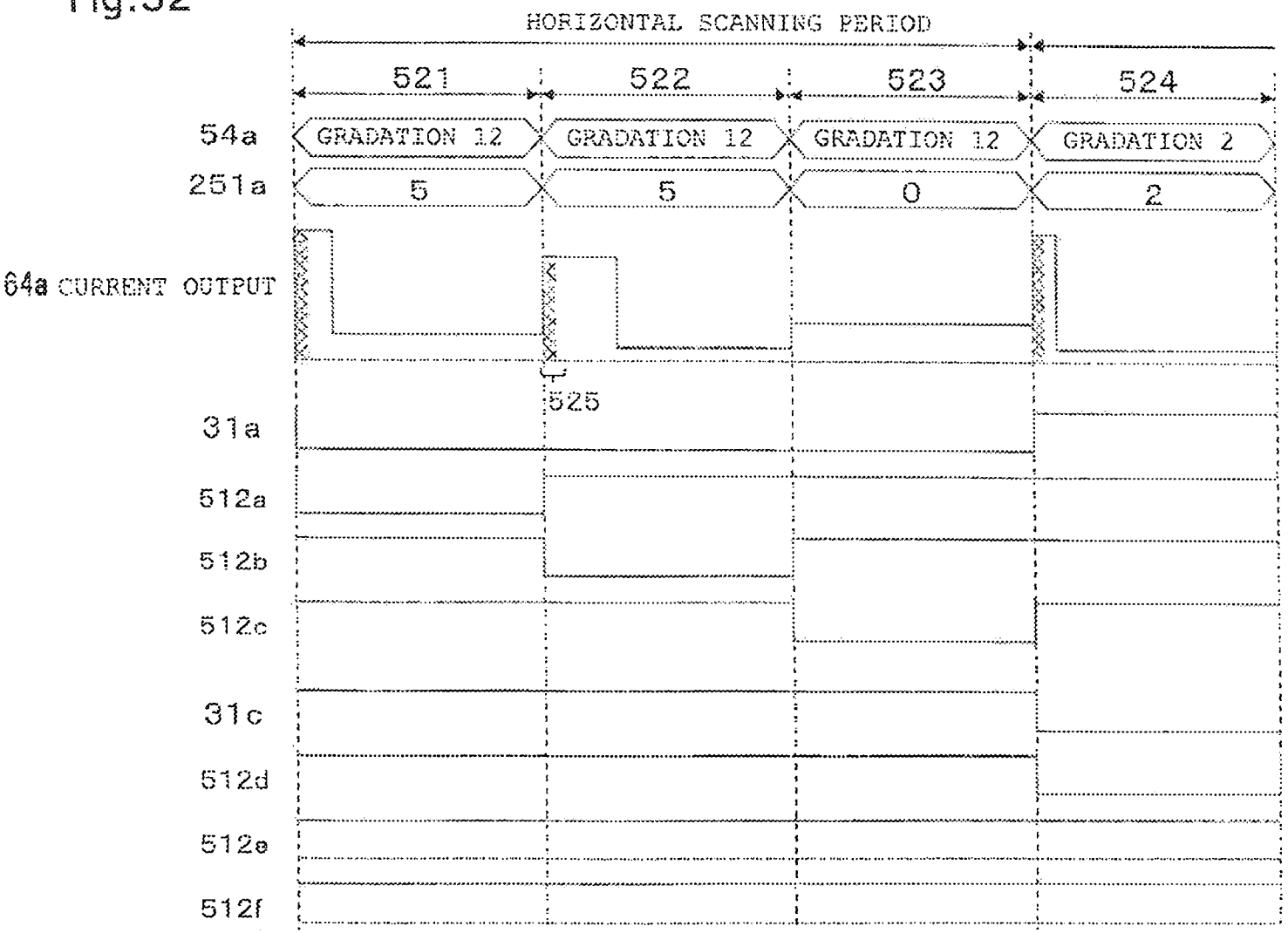
FIG. 52 is a diagram showing a signal line waveform.

As a signal line waveform in this case, as shown in FIG. 52, ON periods are provided to prevent one third periods of one horizontal scanning period from overlapping one another. A circuit for generating this signal is the gate signal enable circuit 511. The gate signal enable circuit 511 is designed to be turned on only in a period in which a relevant row is selected and which corresponds to the respective colors in the one horizontal scanning period.

The same applies to the gate signal line 31*c*. The same operation is performed in the next horizontal scanning period in the first row.

Consequently, it is possible to realize a display device which can output a current for three colors having different current values per one gradation and different pre-charge carrying-out amounts from one driver IC output in a time division manner and write the current in pixels of corresponding colors.

FIG. 52 shows a result (64*a* current output) obtained by outputting a current by carrying out current pre-charge 5 at red 12 gradation, the current pre-charge 5 at green 12 gradation, and no pre-charge at blue 12 gradation in a time division manner and respective gate signal line operations at that point. (The signal line 30*a* corresponds to a red pixel, the signal line 30*b* corresponds to a green pixel, and the signal line 30*c* corresponds to a blue pixel.) A hatching section indicated by a period 525 in the 64*a* current output is equivalent to a voltage pre-charge carrying-out period. A current value at this point is undefined because the current value depends upon a charging amount of a source signal line capacitance.

Current values at the current pre-charge time are different because a different current value is set for each display color by the reference current generating unit 61. Periods are different regardless of the fact that the current pre-charge 5 is selected. This is also because pulse setting is differently made for each color.

In the connection of the gate signal lines in FIG. 51, the selector 472 is not always necessary. It is possible to write a current in the same manner even if all the signal lines 30*a* to 30*c* are connected to the output 64*a*. However, since a source signal line capacitance with respect to the output 64*a* increases to be about three times as large as that in the conventional method, it is likely that it is less easy to change a current. Thus, in the present invention, the selector 472 is inserted for the purpose of reducing a capacitance of the source signal line 30. Therefore, in a display device with a screen size of 2 inches or less or low resolution and a sufficiently long horizontal scanning period, it is possible to obtain the effects of the present invention unless the selector 472 is provided.

In the above explanation, one terminal is used in three outputs. However, it is also possible that one terminal is used in two output terminals. This is effective as a method of realizing both a reduction in the number of terminals and writing when it is impossible to write a current in a pixel in short periods obtained by dividing a horizontal scanning period and it is possible to write a current in half the horizontal scanning period.

Figure 55:
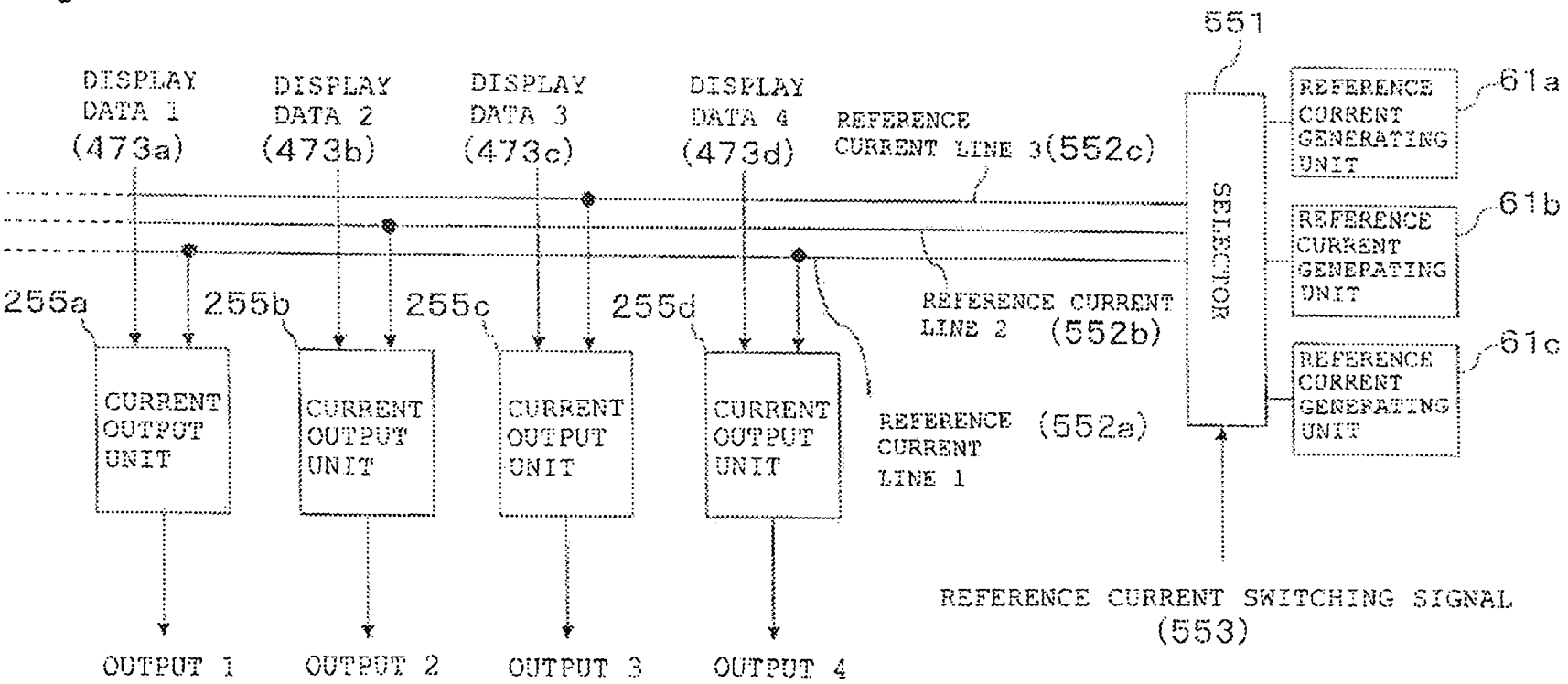
FIG. 55 is a diagram showing a circuit structure of a driver IC which outputs two currents from one current output unit in a time division manner.

In this case, a method of connecting reference current generating units and current output units is different. Since one output outputs adjacent signals of different colors in a half period of the horizontal scanning period, as shown in FIG. 55, for example, red and green are outputted in an output 1, blue and red are outputted in an output 2, and green and blue are outputted in an output 3. A necessary number of output terminals are formed by repetition. For ease of explanation, the three primary colors are used in this example. However, a combination of arbitrary three colors may be used. Red and blue may be interchanged depending upon which end of the display device the driver IC is formed or depending upon an arrangement of pixels. In that case, the same operation is performed.

A reference current is inputted to the respective current output units according to a color to be outputted. Therefore, in the example of the relation of output colors described above, as shown in FIG. 56, the selector determines a relation between the reference current generating units 61 and the reference current lines 1 to 3 (522). The reference current generating unit 61*a* outputs a reference current of red, the reference current generating unit 61*b* outputs a reference current of green, and the reference current generating unit 61*c* outputs a reference current of blue.

In this way, one current output unit is changed for each time and a common output unit is used for two source signal lines. Thus, there is an advantage that the number of outputs of a source driver is halved and the number of current output units 255 is halved.

If it is possible to realize an identical number of outputs, the number of source drivers is reduced even in the display device which performs display using plural driver ICs. Thus, it is possible to realize a reduction in cost.

For example, in the display device having the number of pixels of QVGA, it has been a general practice to perform display using two driver ICs. However, it is possible to perform display with one driver IC by using the present invention. Therefore, it is possible to prevent a problem in that deviation of current outputs of adjacent terminals among different chips (deviation due to fluctuation among chips) tends to occur. It is possible to perform display without adding a circuit for connecting driver ICs in a cascade and a circuit for preventing current deviation of adjacent terminal outputs among chips. Thus, it is possible to expect a reduction in a chip size of the display device as a whole.

Figure 45:
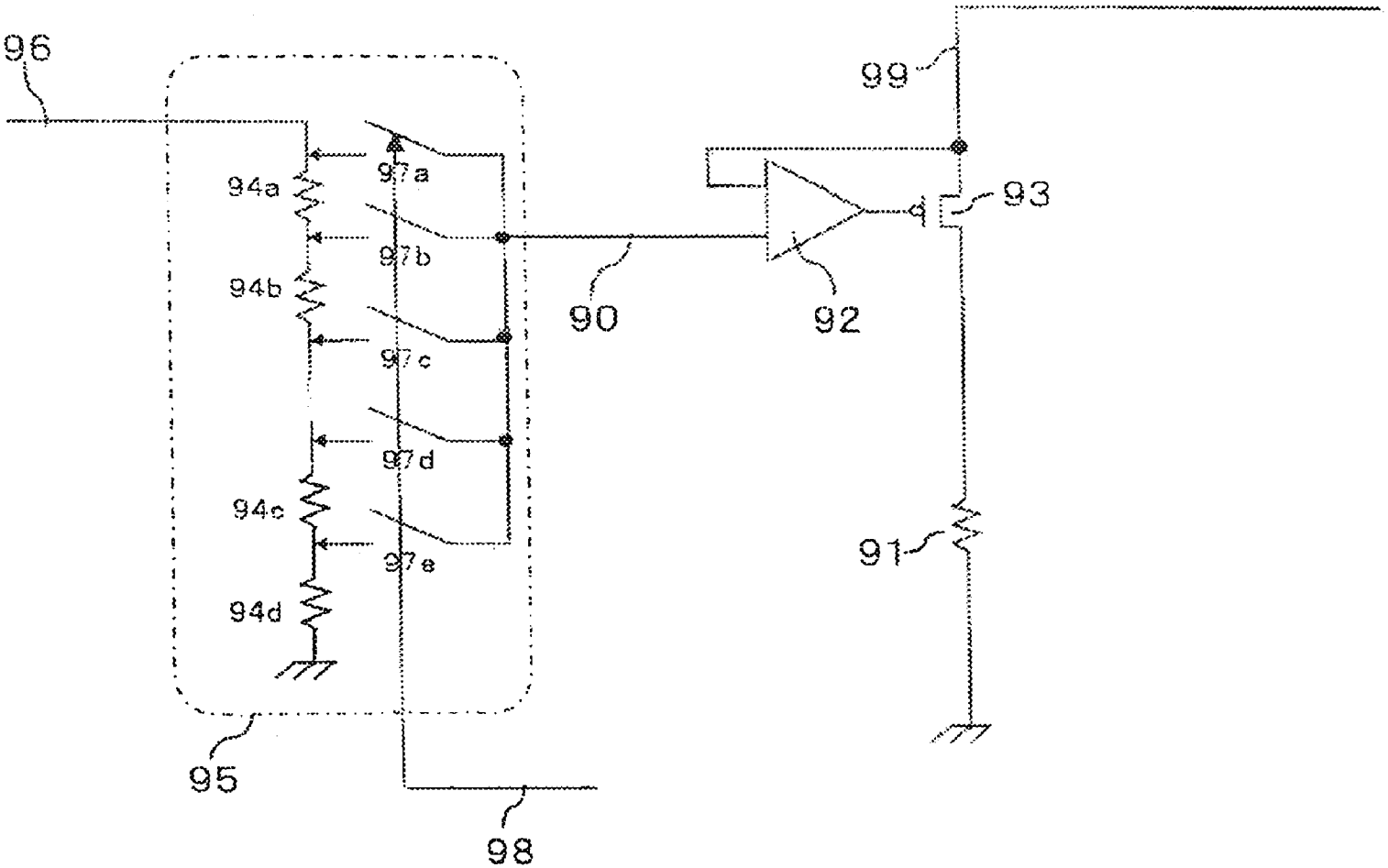
FIG. 45 is a diagram showing a reference current generating unit.
Figure 46:
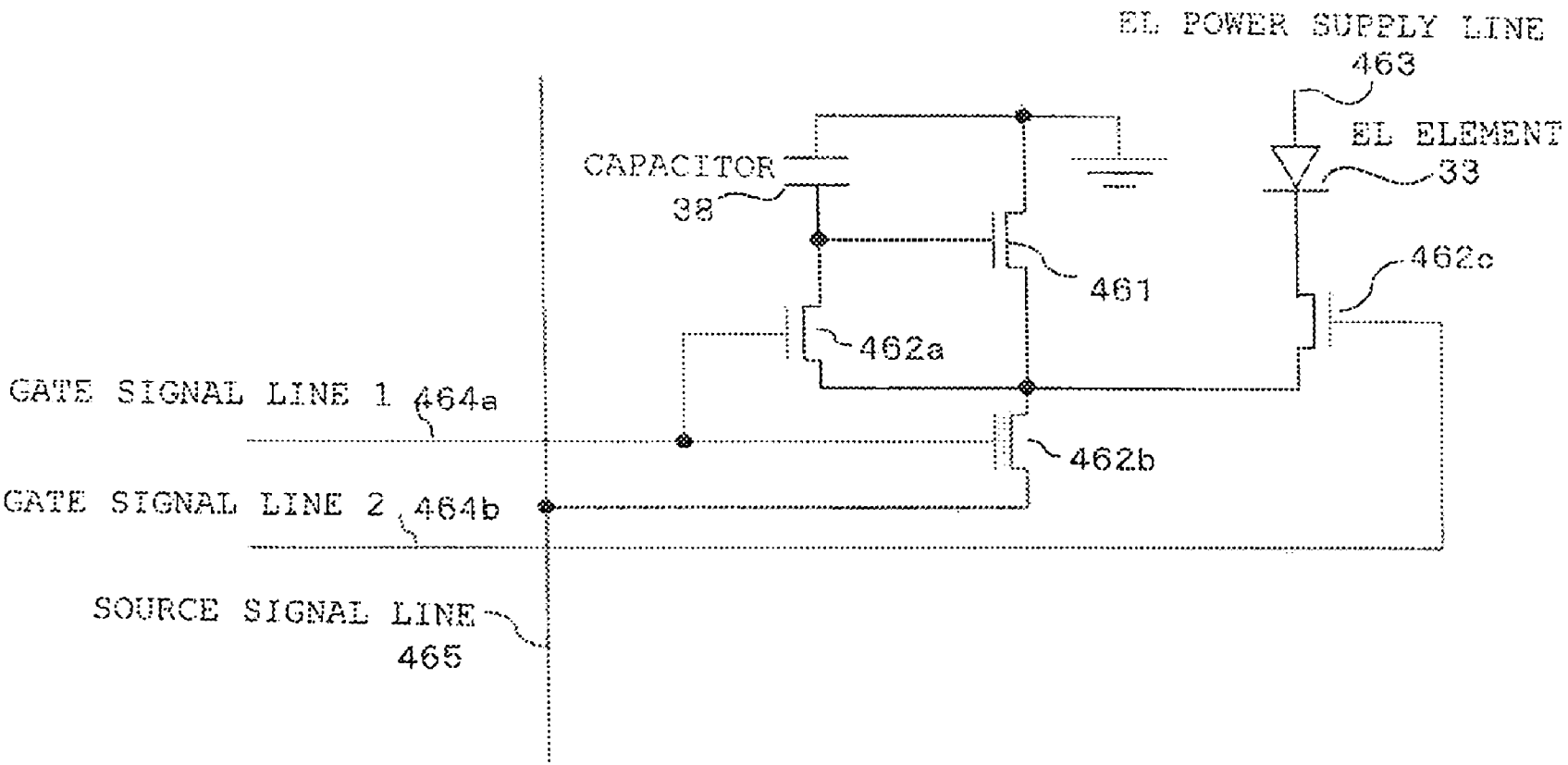
FIG. 46 is a diagram showing a pixel circuit which uses a current copier in the case in which an n-type transistor is used.

In the above explanation, the driving transistor 32 used in the pixel is a p-type TFT. However, the present invention is also applicable to an n-type TFT shown in FIG. 46. All what should be done is to constitute a reference current unit to generate a current in an opposite direction as shown in FIG. 45 and, concerning the current output circuit 65, the current source for gradation display 63 is constituted by a p-type TFT such that a current is discharged to a driver IC output. A source signal line potential with respect to gradation is higher for white gradation. (A potential relation is opposite to that explained above.) If a pre-charge voltage is set to a lowest voltage for black display and a source signal line potential is set to increase according to the current pre-charge, it is also possible to apply the pre-charge.

In the explanation of the present invention, the organic luminous element is used as a display element. However, it is possible to carry out the present invention using any element such as light-emitting diode, an SED (Surface Electric field Display), and an FED as long as the element is a display element in which a current and luminance is in a proportional relation.

Figure 59:
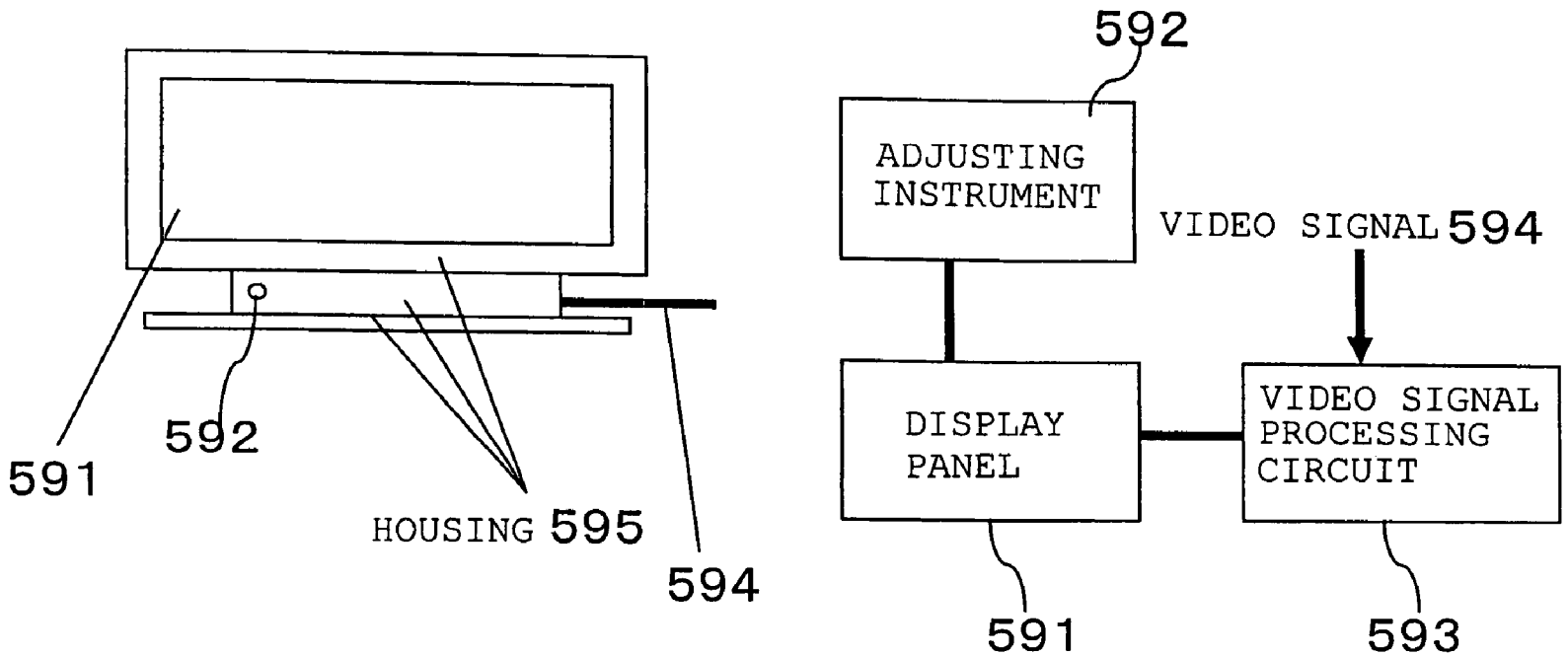
FIG. 59 is a diagram showing a case in which the present invention is applied to a television as a display device using an embodiment of the present invention.
Figure 60:
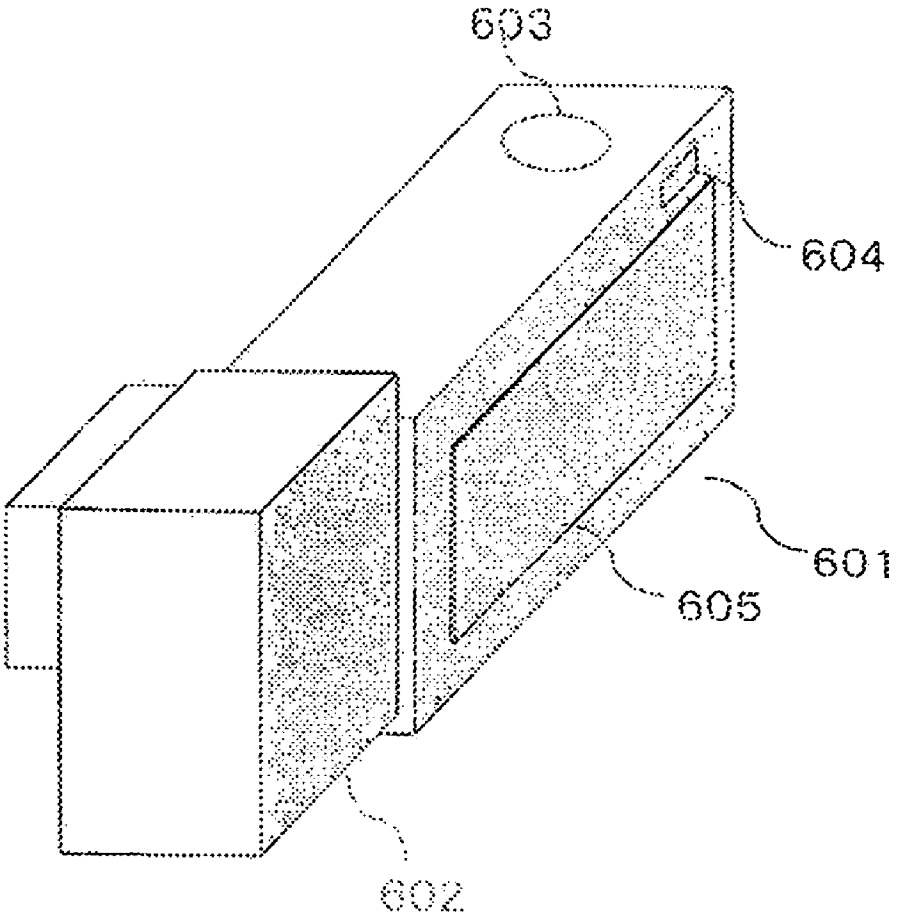
FIG. 60 is a diagram showing a case in which the present invention is applied to a digital camera as a display device using an embodiment of the present invention.
Figure 61:
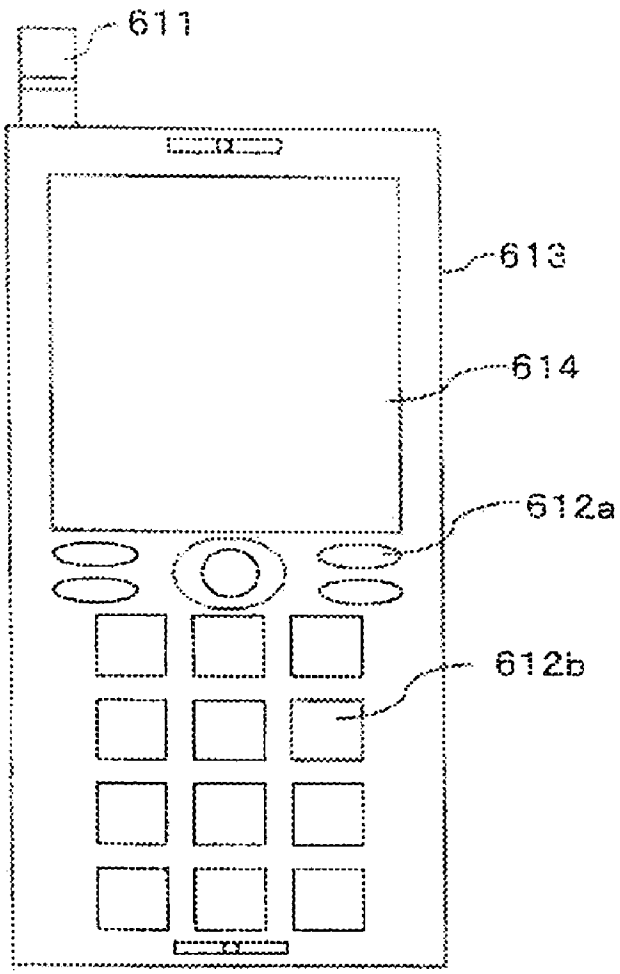
FIG. 61 is a diagram showing a case in which the present invention is applied to a portable information terminal as a display device using an embodiment of the present invention.

As shown in FIGS. 59 to 61, it is possible to realize a product having higher gradation display performance by applying the display device with the display element using the present invention to a television, a video camera, and a cellular phone.

In the present invention, the example in which the control IC 28 or the controller and the source driver 36 are realized by using separate ICs is shown in the figures and explained. However, it is also possible to carry out the present invention and the same effects are obtained when the control IC 28 or the controller and the source driver 36 are integrated to be created on an identical chip.

In the explanation of the present invention, the transistor is an MOS transistor. However, the present invention is also applicable when the transistor is an MIS transistor or a bipolar transistor.

The present invention is also applicable when a material such as crystal silicon, low-temperature polysilicon, high-temperature polysilicon, amorphous silicon, or gallium arsenide compound is used for the transistor.

It is possible to implement the source driver 36 shown in FIGS. 50, 54, and 57 without providing the pre-charge voltage generating unit 323.

According to the present invention, it is possible to provide a display device using self-luminous elements which has a small circuit size and is manufactured at low cost taking into account the problems of the conventional display device and a driving method.

What is claimed is:

1. A display device using self-luminous elements, comprising:

a reference current output unit which generates a first current adjusted depending on respective luminescent colors of self-luminous elements of a display device and outputs said first current for each of said luminescent colors, said display device being constituted by pixels in which said self-luminous elements are arranged in a matrix and displaying at least two or more colors on the basis of current value control;

plural current output units which convert said first current outputted from said reference current output unit into a second current reflecting information of display gradation data sent from a signal line and output said second current to a display area side; and a first selector unit which switches an output destination of said second current outputted from said current output units to respective pixel columns corresponding to said respective luminescent colors, wherein, said reference current output unit outputs said first current in response to switching in said first selector unit, and wherein, said reference current output unit includes:

plural reference current generating units which separately generate reference currents corresponding to said first current adjusted for each of said luminescent colors and output said reference currents; and a second selector unit which is connected between said plural reference current generating units and said plural current output units and outputs said reference currents depending on the switching in said first selector unit as said first current at same timing as the switching in said first selector unit.

2. The display device using self-luminous elements according to claim 1, wherein said second selector unit outputs said reference currents, which are outputted by said plural reference current generating units, as said first current in synchronization with a time division clock in one horizontal scanning period in accordance with a predetermined order.

3. The display device using self-luminous elements according to claim 1, wherein said second selector unit outputs said reference currents, which are outputted by said plural reference current generating units, as said first current in association with an electric switching instrument in accordance with a predetermined order.

4. The display device using self-luminous elements according to claim 1, comprising a display color switching signal line which is connected to a pre-stage of said first selector unit and inputs a display color switching signal for actuating said first selector unit and said second selector unit in association with each other to said first selector unit.

5. The display device using self-luminous elements according to claim 1, wherein a number of the pixel columns connected to said current output units via said first selector unit is two or three.

6. The display device using self-luminous elements according to claim 1, wherein said luminescent colors are two or more luminescent colors selected out of red, blue, green, yellow, cyan, and magenta.

7. The display device using self-luminous elements according to claim 1, comprising a pre-charge voltage generating unit which determines a pre-charge voltage for changing a voltage of a source signal line at high speed and generates and outputs said pre-charge voltage.

8. The display device using self-luminous elements according to claim 7, comprising a voltage application selecting unit which is connected between said pre-charge voltage generating unit and said first selector unit and judges whether said voltage pre-charge should be carried out, wherein said pre-charge voltage generating unit outputs said pre-charge voltage according to a result of the judgment by said voltage application selecting unit.

9. A driving method for a display device using self-luminous elements, comprising:

a reference current outputting step of generating a first current adjusted depending on respective luminescent colors of self-luminous elements of a display device and outputs said first current for each of the luminescent colors, said display device being constituted by pixels in which said self-luminous elements are arranged in a matrix and displaying at least two or more colors on the basis of current value control;

plural current outputting steps of converting said first current into a second current reflecting information of display gradation data sent from a signal line and outputting said second current to a display area side; and a first selecting step of switching an output destination of said second current to respective pixel columns corresponding to said respective luminescent colors, wherein, in said reference current outputting step, said first current is outputted in response to switching in said first selecting step, and wherein, said reference current outputting step includes:

a reference current generating step of separately generating reference currents corresponding to said first current adjusted for each of said luminescent colors and outputting said reference currents; and a second selecting step of outputting said reference currents depending on the switching in said first selecting step as said first current at same timing as the switching in said first selecting step.

10. The driving method for a display device using self-luminous elements according to claim 9, comprising a pre-charge voltage generating step of determining a pre-charge voltage for changing a voltage of a source signal line at high speed and generates and outputs said pre-charge voltage.

11. The driving method for a display device using self-luminous elements according to claim 10, comprising a voltage application selecting step of judging whether said voltage pre-charge should be carried out, wherein, in said pre-charge voltage generating step, said pre-charge voltage is outputted according to the judgment in said voltage application selecting step.

12. The driving method for a display device using self-luminous elements according to claim 9, wherein, in said second selecting step, the reference currents, which are outputted in said reference current generating step, is outputted as said first current in synchronization with a time division clock in one horizontal scanning period in accordance with a predetermined order.

13. The driving method for a display device using self-luminous elements according to claim 9, wherein, in said second selecting step, the reference currents, which are outputted in said reference current generating step, is outputted as said first current in association with an electric switching instrument in accordance with a predetermined order.

14. The driving method for a display device using self-luminous elements according to claim 9, comprising a display color switching step of inputting a display color switching signal for actuating said first selecting step and said second selecting step in association with each other.

15. The driving method for a display device using self-luminous elements according to claim 9, wherein an output destination in said current output step is two or three pixel columns.

16. The driving method for a display device using self-luminous elements according to claim 9, wherein said luminescent colors are two or more luminescent colors selected out of red, blue, green, yellow, cyan, and magenta.

17. A display device using self-luminous elements, comprising:

a reference current output unit which generates a first current adjusted depending on respective luminescent colors of self-luminous elements of a display device and outputs said first current for each of said luminescent colors, said display device being constituted by pixels in which said self-luminous elements are arranged in a matrix and displaying at least two or more colors on the basis of current value control;

plural current output units which convert said first current outputted from said reference current output unit into a second current reflecting information of display gradation data sent from a signal line and output said second current to a display area side;

a first selector unit which switches an output destination of said second current outputted from said current output units to respective pixel columns corresponding to said respective luminescent colors; and a pre-charge voltage for changing a voltage of a source signal line at high speed and generates and outputs said pre-charge voltage, wherein said reference current output unit outputs said first current in response to switching in said first selector unit, and said reference current output unit includes:

plural reference current generating units which separately generate reference currents corresponding to said first current adjusted for each of said luminescent colors and output said reference currents; and a second selector unit which is connected between said plural reference current generating units and said plural current output units and outputs said reference currents depending on the switching in said first selector unit as said first current at same timing as the switching in said first selector unit.

18. The display device using self-luminous elements according to claim 17, wherein said second selector unit outputs said reference currents, which are outputted by said plural reference current generating units, as said first current in synchronization with a time division clock in one horizontal scanning period in accordance with a predetermined order.

19. The display device using self-luminous elements according to claim 17, wherein said second selector unit outputs said reference currents, which are outputted by said plural reference current generating units, as said first current in association with an electric switching instrument in accordance with a predetermined order.

20. The display device using self-luminous elements according to claim 17, comprising a display color switching signal line which is connected to a pre-stage of said first selector unit and inputs a display color switching signal for actuating said first selector unit and said second selector unit in association with each other to said first selector unit.

21. The display device using self-luminous elements according to claim 17, wherein a number of the pixel columns connected to said current output units via said first selector unit is two or three.

22. The display device using self-luminous elements according to claim 17, wherein said luminescent colors are two or more luminescent colors selected out of red, blue, green, yellow, cyan, and magenta.

* * * * *